US007997016B2

(12) United States Patent
Yamazaki et al.

(10) Patent No.: US 7,997,016 B2
(45) Date of Patent: Aug. 16, 2011

(54) SELF-PROPELLED SNOW REMOVER

(75) Inventors: Nobuo Yamazaki, Wako (JP); Kenji Kuroiwa, Wako (JP); Kiyomi Yanai, Wako (JP); Yoshitaka Ohta, Wako (JP); Toshiaki Kawakami, Wako (JP); Seishu Sakai, Wako (JP); Norikazu Shimizu, Wako (JP); Masaki Takahashi, Wako (JP); Nobuyuki Hirose, Wako (JP); Tsutomu Wakitani, Wako (JP)

(73) Assignee: Honda Motor Co., Ltd. (JP)

( * ) Notice: Subject to any disclaimer, the term of this patent is extended or adjusted under 35 U.S.C. 154(b) by 502 days.

(21) Appl. No.: 11/493,276

(22) Filed: Jul. 26, 2006

(65) Prior Publication Data

US 2007/0022635 A1 Feb. 1, 2007

(30) Foreign Application Priority Data

| | | |
|---|---|---|
| Jul. 29, 2005 | (JP) | 2005-221050 |
| Jul. 29, 2005 | (JP) | 2005-221168 |
| Jul. 29, 2005 | (JP) | 2005-221325 |
| Jul. 29, 2005 | (JP) | 2005-221447 |
| Jul. 29, 2005 | (JP) | 2005-221495 |
| Jul. 29, 2005 | (JP) | 2005-221541 |
| Aug. 1, 2005 | (JP) | 2005-223491 |

(51) Int. Cl.
*E01H 5/04* (2006.01)

(52) U.S. Cl. ..... 37/234; 37/236; 37/247; 37/254; 37/257

(58) Field of Classification Search ..... 37/244, 37/245, 247, 249, 257, 234, 236, 254
See application file for complete search history.

(56) References Cited

U.S. PATENT DOCUMENTS

| | | | | |
|---|---|---|---|---|
| 4,934,463 | A * | 6/1990 | Ishida et al. | 172/4.5 |
| 5,018,592 | A * | 5/1991 | Buchdrucker | 180/19.3 |
| 5,088,020 | A * | 2/1992 | Nishida et al. | 700/40 |
| 5,462,125 | A * | 10/1995 | Stratton et al. | 172/826 |
| 5,487,428 | A * | 1/1996 | Yamamoto et al. | 172/4.5 |
| 5,685,377 | A * | 11/1997 | Arstein et al. | 172/2 |
| 5,819,190 | A * | 10/1998 | Nakagami et al. | 701/50 |
| 5,862,868 | A * | 1/1999 | Yamamoto et al. | 172/2 |
| 5,938,282 | A * | 8/1999 | Epple | 297/217.3 |
| 5,984,018 | A * | 11/1999 | Yamamoto et al. | 172/2 |
| 6,061,617 | A * | 5/2000 | Berger et al. | 701/50 |
| D435,552 | S * | 12/2000 | Dougan et al. | D14/401 |

(Continued)

FOREIGN PATENT DOCUMENTS

JP 64 28416 2/1989

(Continued)

*Primary Examiner* — Thomas B Will
*Assistant Examiner* — Mai Nguyen
(74) *Attorney, Agent, or Firm* — Adams & Wilks

(57) ABSTRACT

A self-propelled snow remover has a machine body, a snow-removing implement mounted to a front part of the machine body for undergoing rolling and vertical movement relative to the machine body, and an operating unit mounted to a rear part of the machine body. An alignment operating member is mounted to the operating unit for rolling and vertically moving the snow-removing implement. The alignment operating member is disposed on one of opposite sides of a widthwise central line of the machine body. A return operating member is mounted to the operating unit for automatically returning the snow-removing implement to a predetermined reference position. The return operating member is disposed proximate to the alignment operating member at a position closer to the widthwise central line of the machine body than the alignment operating member and further towards the rear part of the machine body than the alignment operating member.

13 Claims, 36 Drawing Sheets

U.S. PATENT DOCUMENTS

| | | | | |
|---|---|---|---|---|
| 6,154,985 | A * | 12/2000 | Champagne et al. | 37/222 |
| 6,256,909 | B1 * | 7/2001 | Kost et al. | 37/231 |
| D451,513 | S * | 12/2001 | Stewart et al. | D14/413 |
| 6,327,799 | B1 * | 12/2001 | Hanafusa et al. | 37/257 |
| 6,363,632 | B1 * | 4/2002 | Stentz et al. | 37/414 |
| D470,846 | S * | 2/2003 | Archambault et al. | D14/401 |
| 6,550,161 | B2 * | 4/2003 | Hanafusa et al. | 37/246 |
| D478,589 | S * | 8/2003 | Hussaini et al. | D14/401 |
| 6,718,246 | B2 * | 4/2004 | Griffith et al. | 701/50 |
| 7,058,495 | B2 * | 6/2006 | Budde et al. | 701/50 |
| 7,121,355 | B2 * | 10/2006 | Lumpkins et al. | 172/4.5 |
| 7,159,343 | B2 * | 1/2007 | Hanafusa et al. | 37/244 |
| 7,324,880 | B2 * | 1/2008 | Lueschow et al. | 701/50 |
| 7,430,983 | B2 * | 10/2008 | Hicok et al. | 116/313 |
| 7,484,587 | B2 * | 2/2009 | Portscheller et al. | 180/329 |
| 2002/0053479 | A1 * | 5/2002 | Wakitani et al. | 180/315 |
| 2003/0085680 | A1 | 5/2003 | Wakitani et al. | 318/432 |
| 2004/0041787 | A1 * | 3/2004 | Graves | 345/157 |
| 2006/0123667 | A1 * | 6/2006 | Mizoroke et al. | 37/257 |
| 2007/0062075 | A1 * | 3/2007 | Graham et al. | 37/234 |

FOREIGN PATENT DOCUMENTS

| | | |
|---|---|---|
| JP | 6 17418 | 3/1994 |
| JP | 10219643 | 8/1998 |
| JP | 2004278052 | 10/2004 |

* cited by examiner 10
13
25
27
29
131
14
133
132
40
42
18L
43L
17L
122
121
11L
22L
23L
24L

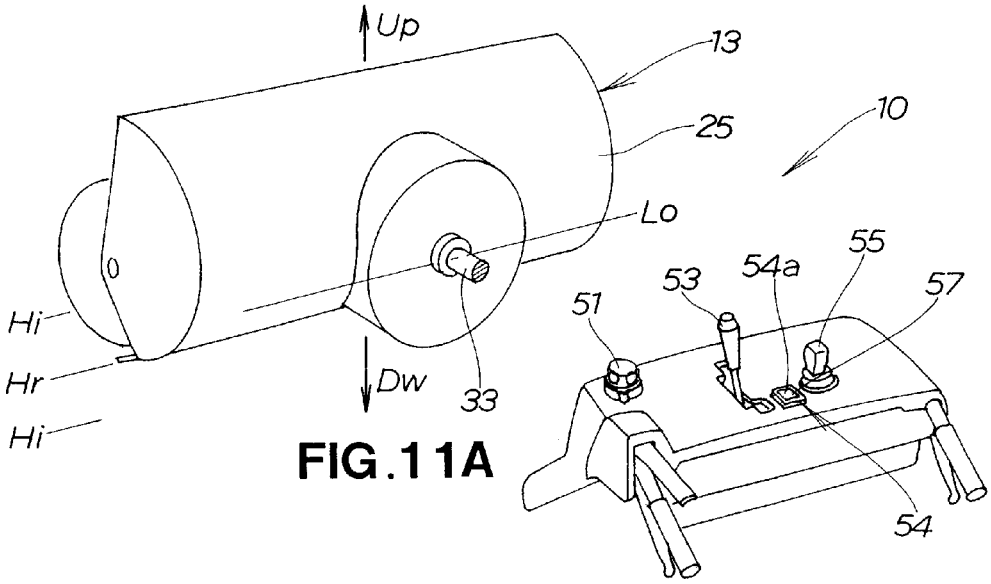
FIG.11A
FIG.11B
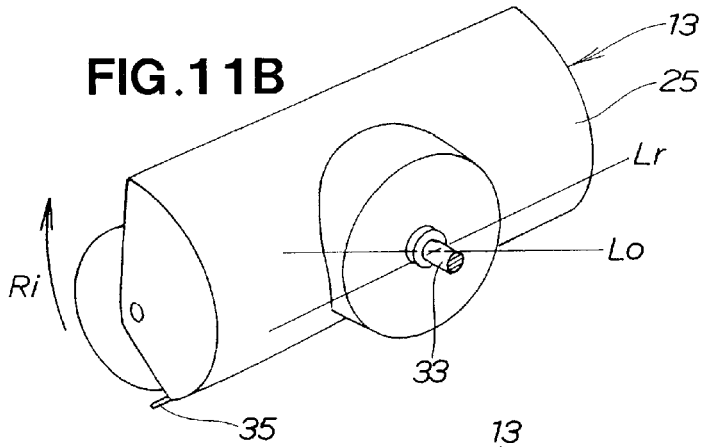
FIG.11C
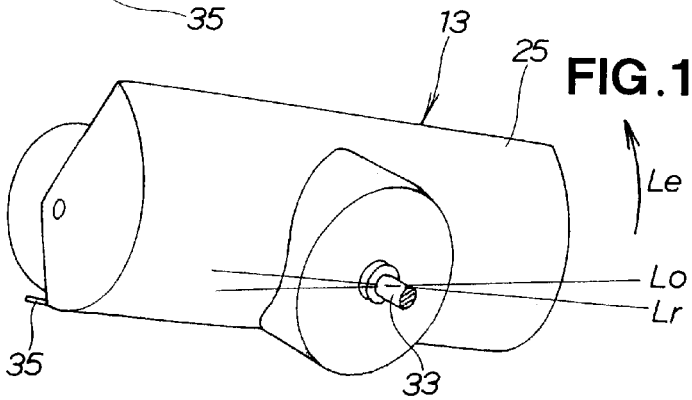

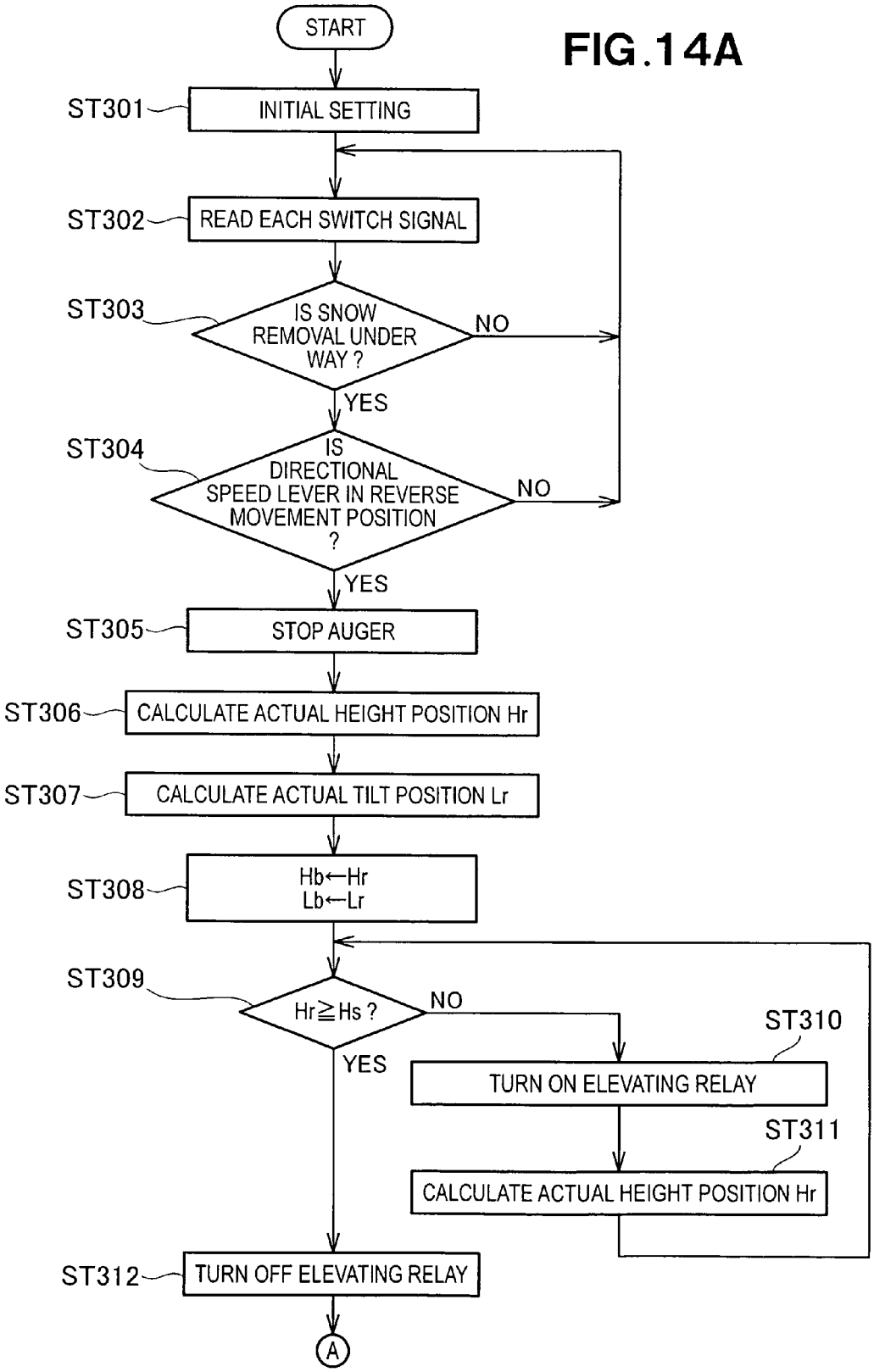
FIG.14A
START
ST301
INITIAL SETTING
ST302
READ EACH SWITCH SIGNAL
ST303
IS SNOW REMOVAL UNDER WAY ?
NO
YES
ST304
IS DIRECTIONAL SPEED LEVER IN REVERSE MOVEMENT POSITION ?
NO
YES
ST305
STOP AUGER
ST306
CALCULATE ACTUAL HEIGHT POSITION Hr
ST307
CALCULATE ACTUAL TILT POSITION Lr
ST308
Hb←Hr
Lb←Lr
ST309
Hr≧Hs ?
NO
YES
ST310
TURN ON ELEVATING RELAY
ST311
CALCULATE ACTUAL HEIGHT POSITION Hr
ST312
TURN OFF ELEVATING RELAY
A

SELF-PROPELLED SNOW REMOVER

FIELD OF THE INVENTION

The present invention relates to a self-propelled snow remover having a snow-removing implement.

BACKGROUND OF THE INVENTION

In some self-propelled snow removers, a snow-removing implement is attached to a machine body so as to be capable of lifting, lowering, and rolling, and a travel unit is provided to the machine body. The snow-removing implement is composed of an auger, for example. In a snow remover provided with an auger, a system is adopted whereby the height of the auger is varied according to snow removal circumstances. Such an auger-type snow remover is described in Japanese Patent Laid-Open Publication No. 10-219643.

The auger-type snow remover described in the 10-219643 publication has a travel unit; a machine body to which the travel unit is provided; a snow-removing implement attached to the front of the machine body so as to be capable of lifting, lowering, and rolling; and left and right operating handles and an operating unit attached to the rear of the machine body. An operator can steer the left and right operating handles and operate the operating unit while walking along behind the snow remover.

The operating unit of the auger-type snow remover (self-propelled snow remover) described in the 10-219643 publication will be described with reference to FIG. 28 hereof. FIG. 28 is a top plan view of the operating unit in the conventional self-propelled snow remover.

The operating unit 300 in the conventional self-propelled snow remover is elongated to the left and right and is provided with a travel shift lever 301 disposed in the center position, a four-way operating lever 302 disposed on the right side of the shift lever 301, a slide switch 303 disposed at the top of the four-way operating lever 302, a rolling auto-switch lever 304 disposed on the left side of the shift lever 301, and a manual switching lever 305 disposed immediately to the right of the rolling auto-switch lever 304.

When the four-way operating lever 302 is swung forward or backward, the snow-removing implement is lifted or lowered. When the four-way operating lever 302 is swung to the left or right, the travel units travel and make a turn. When the slide switch 303 is slid to the left or right, the snow-removing implement rolls regardless of the switching position of the rolling auto-switch lever 304. When the operator lets go of the slide switch 303, the snow-removing implement automatically returns to the horizontal state.

When the rolling auto-switch lever 304 is moved into the automatic position, a control unit controls the snow-removing implement so that a horizontal state is constantly maintained. When the rolling auto-switch lever 304 is moved into the manual position, the snow-removing implement can be rolled by swinging the manual switching lever 305.

During snow removal, the operator raises, lowers, and rolls the snow-removing implement according to the terrain being cleared. The snow-removing implement can be raised, lowered, and rolled by operating the four-way operating lever 302 and the slide switch 303 with the right hand.

However, the snow-removing implement automatically returns to the horizontal state when the operator removes his right hand from the slide switch 303. The operator cannot let go of the slide switch 303 when he wishes to stop the snow-removing implement in an arbitrary rolling position. Therefore, when the operator wishes to stop the snow-removing implement in an arbitrary rolling position, he uses his left hand to swing the manual switching lever 305 disposed on the left side of the operating unit 300. Since lifting/lowering and rolling of the snow-removing implement are performed with different hands, operation is complicated and inconvenient. The ability to enhance the ease of operation is limited in this case. In contrast, it is conceivable that lifting/lowering and rolling of the snow-removing implement could both be performed by swinging the four-way operating lever 302 forward, backward, left, and right using one hand.

It is sometimes preferable to return the orientation of the snow-removing implement to a predetermined initial position with one operation during snow removal. For example, the operator often turns the snow remover according to the snow removal situation. Because the snow removal operation is under way, the auger and auger housing are lowered to a point near the road surface. When the snow remover is turned in this state, accumulated snow interferes with turning depending on the state of snow accumulated around the snow remover. The snow-removing implement must therefore be raised each time the operator turns the snow remover. Once the turn is completed, the snow-removing implement is again lowered to a point near the road surface and aligned with the angle of the road surface. Due to the inconvenience of this type of operation, greater efficiency is obtained by returning the snow-removing implement to a reference position using a single operation, and then performing fine adjustment using this reference position as a reference.

Even when raising/lowering and rolling of the snow-removing implement are both performed by swinging the four-way operating lever 302 forward, backward, left, and right as described above, rapidly returning the snow-removing unit to a reference position is preferred.

There is therefore a need for a technique whereby the orientation of the snow-removing implement can easily be manipulated, and the operation for returning the snow-removing implement to a reference position can be rapidly performed.

SUMMARY OF THE INVENTION

According to an aspect of the present invention, there is provided a self-propelled snow remover which comprises: a machine body; a snow-removing implement mounted to a front part of the machine body rollably and vertically movably, an operating unit mounted to a rear part of the machine body; an alignment operating member mounted to the operating unit; and a return operating member mounted to the operating unit, wherein the alignment operating member is disposed on a right or left side with respect to a center of width of the machine body, for rolling and vertically moving the snow-removing implement, and the return operating member is designed to be operated for automatically returning the snow-removing implement to a predetermined reference position and is disposed in the vicinity of the alignment operating member.

In the snow remover thus arranged, an operator can automatically and rapidly return the snow-removing implement to the predetermined reference position merely by operating the return operating member during snow removal. Even when the operator does not operate the alignment operating member, the position of the snow-removing implement at the present time can be automatically and rapidly returned to the reference position. The operator may then operate the alignment operating member to finely adjust the position of the snow-removing implement to conform to the terrain being cleared. Since the position of the snow-removing implement can thus be finely adjusted using the reference position as a reference after being returned to the reference position in a single operation, work can be performed with good efficiency. Accordingly, the snow-removing implement can be rapidly returned to the reference position, and the alignment of the snow-removing implement can easily be manipulated. Particularly for an inexperienced novice operator, it is usually difficult to rapidly set the snow-removing implement to the appropriate position in response to a change in the situation during snow removal. According to the present invention, however, the snow-removing implement can be automatically and rapidly returned to the reference position, and the snow remover is therefore easy for a novice operator to use. The snow-removing implement can be returned to the reference position by the simple operation of merely operating the return operating member. The self-propelled snow remover can therefore be made easier to operate.

Furthermore, since the return operating member is disposed in the vicinity of the alignment operating member, the operator can easily and rapidly operate the return operating member by a slight movement of the hand used to operate the alignment operating member. The operator can therefore select and comfortably operate one member selected from the alignment operating member and the return operating member by a slight movement of one hand. The burden of operation placed on the operator can therefore be alleviated.

The alignment of the snow-removing implement can thus be easily manipulated, and the operation for returning the snow-removing implement to the reference position can be rapidly performed.

Preferably, the return operating member is disposed in a position nearer to the center of width of the machine body than the alignment operating member, and further towards the rear than the alignment operating member.

It is preferred that the snow remover further comprise a lift drive mechanism for lifting and lowering the snow-removing implement, a rolling drive mechanism for rolling the snow-removing implement, and a control unit for controlling the lift drive mechanism and the rolling drive mechanism, wherein the reference position consists of two values comprising a height reference position as a reference for the height position of the snow-removing implement, and a rolling reference position as a reference for the rolling position of the snow-removing implement; and the control unit executes a reference position return mode for issuing two instructions whereby an adjustment drive instruction is issued to the lift drive mechanism so as to match the height position of the snow-removing implement to the height reference position, and whereby an adjustment drive instruction is issued to the rolling drive mechanism so as to match the rolling position of the snow-removing implement to the rolling reference position according to the operating signal of the return operating member.

In a preferred from, the snow remover further comprises a height position detector for detecting the height position of the snow-removing implement, and a rolling position detector for detecting the rolling position of the snow-removing implement, wherein the control unit issues an adjustment drive instruction to the lift drive mechanism so as to match the height position detected by the height position detector to the height reference position, and issues an adjustment drive instruction to the rolling drive mechanism so as to match the rolling position detected by the rolling position detector to the rolling reference position.

It is also preferred that the snow remover further comprise a display unit for indicating that the snow-removing implement has returned to the reference position.

It is also preferred that besides the reference position return mode, the control unit further executes a reference position changing mode for arbitrarily changing the value of the height reference position and the value of the rolling reference position.

It is also preferred that the control unit switch to and execute one mode selected from the reference position return mode and the reference position changing mode on the basis of the switching operation of the return operating member.

It is also preferred that the snow remover further comprise travel units for performing self-propulsion, and a travel operating member capable of switching the travel units between forward travel and reverse travel, wherein the control unit stores the height position of the snow-removing implement at the time at which it is determined that two conditions are satisfied that include a condition wherein the snow-removing implement is in operation and a condition wherein the travel operating member is switched to reverse travel, issues a lift drive instruction to the lift drive mechanism so as to lift the snow-removing implement, and then issues a lowering drive instruction so as to return the height position of the snow-removing implement to the stored original height position when a condition is satisfied wherein the travel operating member is switched to forward travel.

It is also preferred that the control unit store the rolling position of the snow-removing implement at the time at which it is determined that the aforementioned two conditions are satisfied, and issue an adjustment drive instruction to the rolling drive mechanism so as to match the tilt of the snow-removing implement to the stored original rolling position when the condition is satisfied wherein the travel operating member is switched to forward travel.

It is also preferred that the control unit issue a control signal to the rolling drive mechanism so as to make the snow-removing implement horizontal when it is determined that the aforementioned two conditions are satisfied.

It is also preferred that the snow-removing implement further comprise an auger, and the control unit perform control so as to stop the auger when it is determined that the aforementioned two conditions are satisfied.

It is also preferred that the snow remover further comprise a drive source for driving the snow-removing implement, and a height position detector for detecting the height position of the snow-removing implement, wherein the machine body comprises a travel frame provided with travel units for performing self-propulsion, and a vehicle body frame attached to the travel frame so as to be able to swing vertically about the back end portion thereof; the snow-removing implement, the drive source, and the height position detector are mounted to the vehicle body frame in the machine body; and the height position detector is disposed near the drive source.

It is also preferred that the snow remover further comprise a bottom cover under the height position detector, for preventing adhesion of snow particles carried up by the travel units.

It is also preferred that the snow remover further comprise a top cover for covering the drive source, wherein the top cover covers both the drive source and the top of the height position detector.

It is also preferred that the travel frame comprise a fixing arm extending upward; the height position detector comprise a detector body portion mounted to the vehicle frame and an actuating arm mounted to the detector body portion so as to be capable of swinging, and detect the height position of the snow-removing implement according to the amount of swing of the actuating arm; and the actuating arm be connected to the top of the fixing arm via a linking rod so as to be capable of swinging.

It is also preferred that the snow remover further comprise a drive source for driving the snow-removing implement, a top cover for covering the drive source, and a rolling position detector for detecting the rolling position of the snow-removing implement, wherein the rolling position detector comprises a swinging member, a transmission unit, and a rolling position detector; the swinging member is mounted to the rear portion of the snow-removing implement, and is a member for performing swinging in conjunction with the rolling of the snow-removing implement; the transmission unit is mechanically linked to the swinging member and the rolling position detector, and is a member for transmitting the amount of swing of the swinging member to the rolling position detector; the rolling position detector detects the rolling position of the snow-removing implement on the basis of the amount of swing transmitted from the transmission unit; the machine body comprises a travel frame provided with left and right travel units for performing self-propulsion, and a vehicle frame attached to the travel frame so as to be able to swing vertically about the back end portion thereof; the snow-removing implement, the drive source, and the rolling position detector are mounted to the vehicle body frame in the machine body; and the top cover covers both the drive source and the rolling position detector.

It is also preferred that the rolling position detector be disposed at a higher elevation than the left and right travel units.

It is also preferred that the travel frame be disposed between the left and right travel units and comprise a pair of left and right side frames, and that the swinging member be disposed between the left and right side frames.

It is also preferred that the upper surfaces of the left and right side frames be higher than the left and right travel units.

It is also preferred that the snow remover further comprise a bracket extending upward from the vehicle frame, wherein the bracket has the transmission unit and the rolling position detector attached thereto and comprises a front wall extending upward from above the vehicle frame, a ceiling portion extending to the rear from the upper end of the front wall, and a rear wall extending downward from the rear end of the ceiling portion; and the transmission unit is covered by the front wall, the ceiling portion, and the rear wall.

BRIEF DESCRIPTION OF THE DRAWINGS

Certain preferred embodiments of the present invention will be described in detail below, by way of example only, with reference to the accompanying drawings, in which:

FIGS. 11A through 11C are views showing orientations of the snow-removing implement based on the control routine of the first embodiment shown in FIG. 8;

FIGS. 14A through 14C are charts of the control routine of a second embodiment of the control unit shown in FIG. 7;

DETAILED DESCRIPTION OF THE PREFERRED EMBODIMENTS

Figure 1:
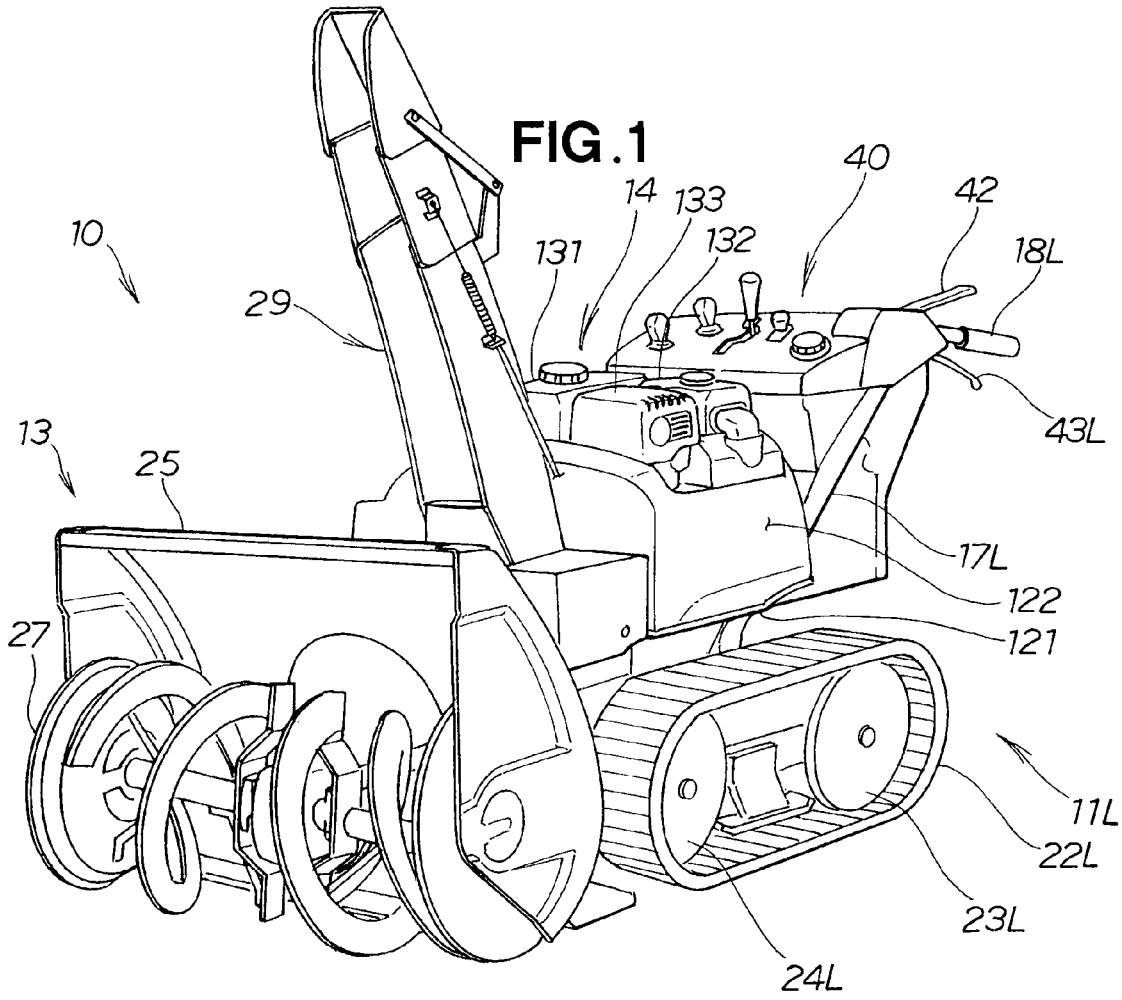
FIG. 1 is a perspective view of the self-propelled snow remover according to the present invention.
Figure 2:
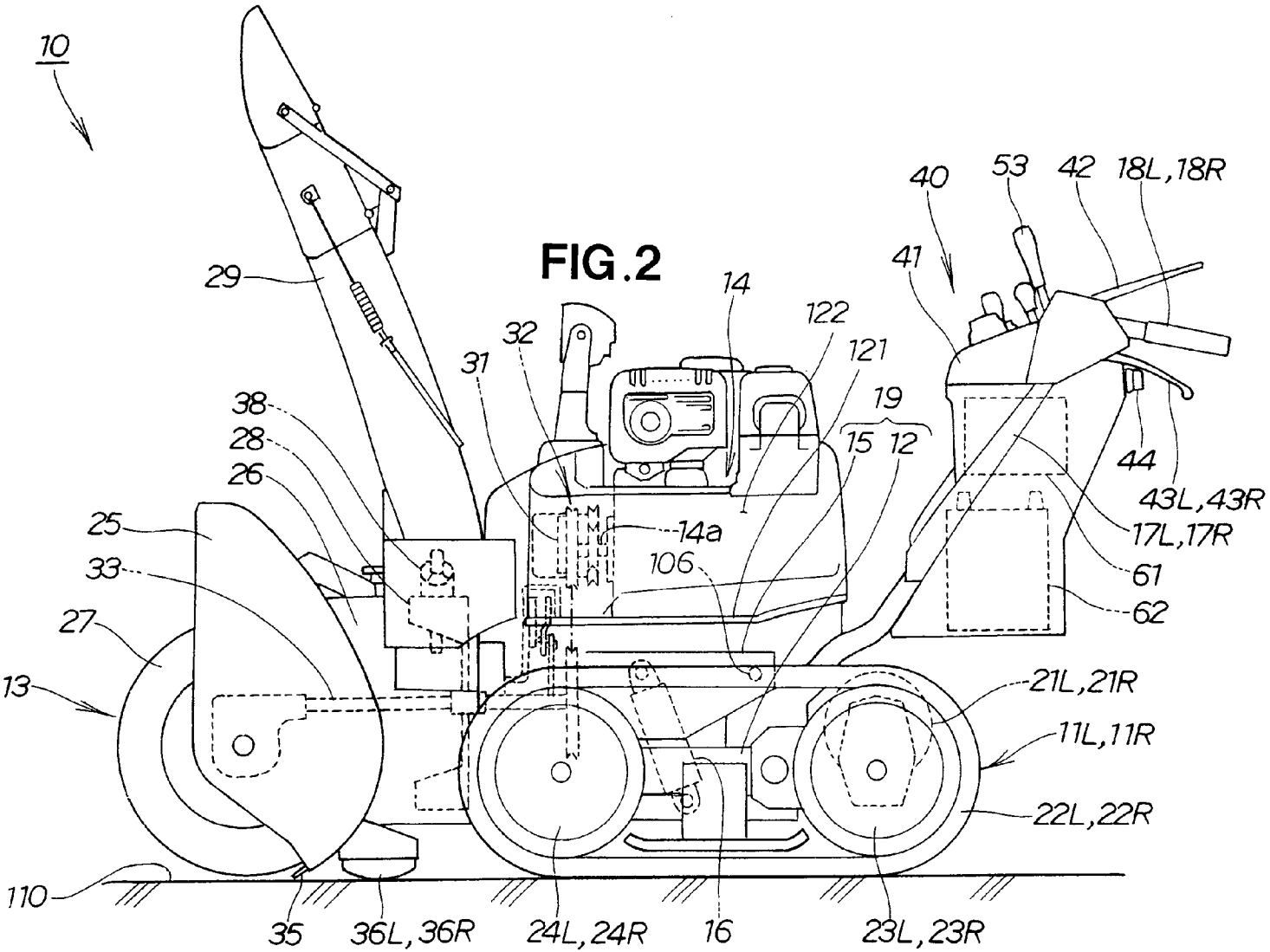
FIG. 2 is a side view of the self-propelled snow remover shown in FIG. 1.
Figure 3:
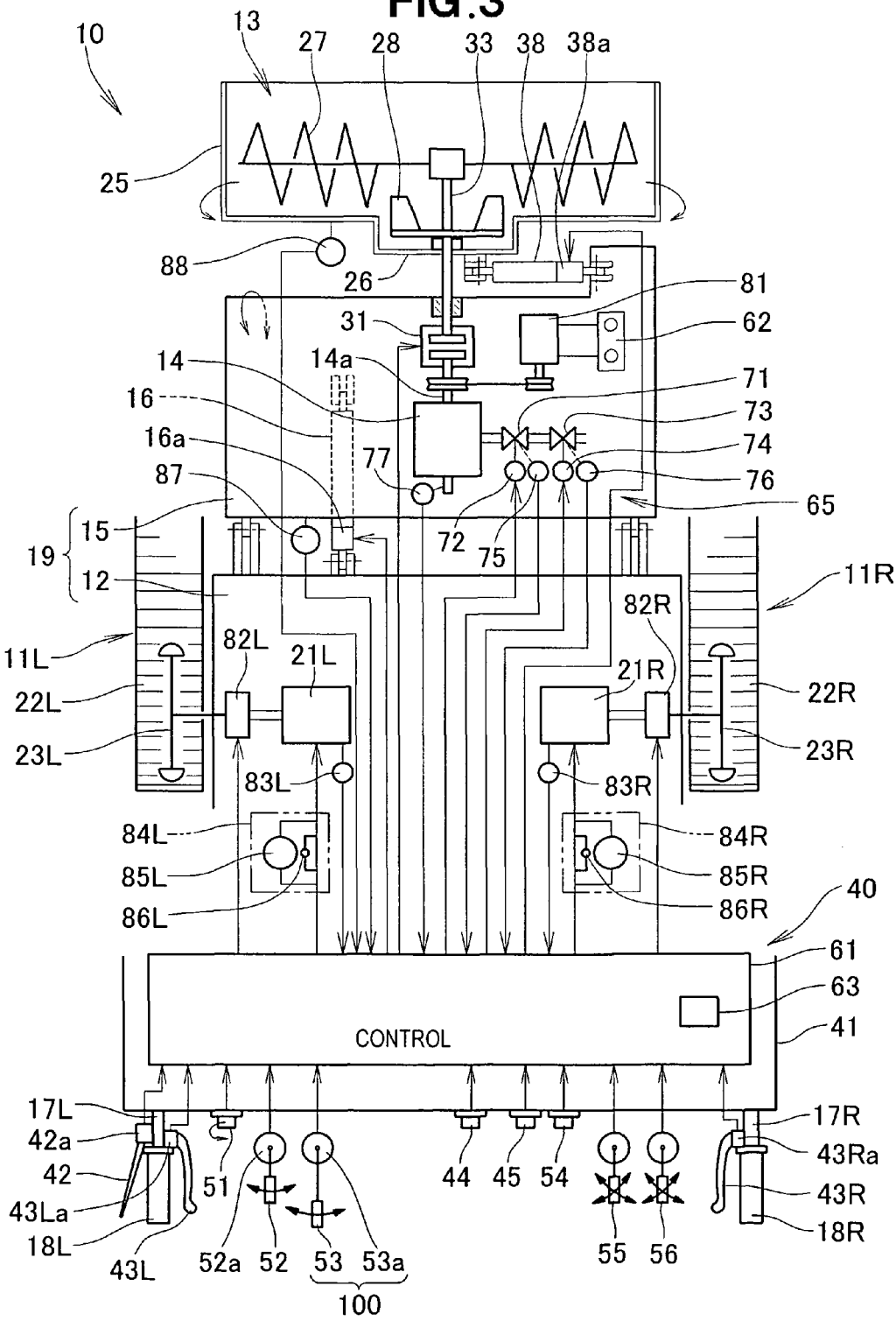
FIG. 3 is a schematic plan view of the self-propelled snow remover shown in FIG. 1.

As shown in FIGS. 1, 2, and 3, the self-propelled snow remover 10 is composed of left and right travel units 11L, 11R, left and right electric motors 21L, 21R for driving the travel units 11L, 11R, an auger-type snow-removing implement 13, an engine 14 for driving the snow-removing implement 13, and a machine body 19. This self-propelled snow remover 10 is referred to as a self-propelled auger-type snow remover. The self-propelled snow remover 10 hereinafter will be referred to simply as the snow remover 10. The snow-removing implement 13 will be referred to simply as the implement 13.

The machine body 19 is composed of a travel frame 12 and a vehicle body frame 15 attached to the travel frame 12 so as to be able to swing vertically about the back end portion thereof. This machine body 19 is provided with a lift drive mechanism 16 for lifting and lowering the front portion of the vehicle body frame 15 in relation to the travel frame 12.

The lift drive mechanism 16 is an actuator whereby a piston can move in and out of a cylinder. This actuator is an electro-hydraulic cylinder in which hydraulic pressure generated by a hydraulic pump (not shown) using an electric motor 16*a* (see FIG. 3) causes a piston to move telescopically, and is also referred to as a height adjustment cylinder. The electric motor 16*a* is a drive source used for lifting, and the motor is built into the side portion of the cylinder of the lift drive mechanism 16.

The travel frame 12 is provided with the left and right travel units 11L, 11R, the left and right electric motors 21L, 21R, and two operating handles 17L, 17R on the left and right. The left and right operating handles 17L, 17R extend upward and to the rear from the rear of the travel frame 12, and have grips 18L, 18R at the distal ends thereof. An operator can operate the snow remover 10 using the operating handles 17L, 17R while walking along with the snow remover 10. The implement 13 and the engine 14 are attached to the vehicle body frame 15.

The left and right travel units 11L, 11R are composed of left and right crawler belts 22L, 22R, left and right drive wheels 23L, 23R disposed at the rear of the travel frame 12, and left and right rolling wheels 24L, 24R disposed at the front of the travel frame 12. The left and right drive wheels 23L, 23R function as traveling wheels. The left crawler belt 22L can be independently driven via the left drive wheel 23L by the drive power of the left electric motor 21L. The right crawler belt 22R can be independently driven via the right drive wheel 23R by the drive power of the right electric motor 21R.

The implement 13 is composed of an auger housing 25, a blower case 26 formed integrally with the back surface of the auger housing 25, an auger 27 disposed inside the auger housing 25, a blower 28 disposed inside the blower case 26, and a shooter 29 (see FIG. 2) disposed on the top of the blower case 26. The implement 13 is further provided with an auger transmission shaft 33 for transmitting the motive force of the engine 14 to the auger 27 and the blower 28. The auger transmission shaft 33 extends to the front and back of the snow remover 10, and is rotatably supported by the auger housing 25 and the blower case 26. A scraper 35 for scraping the snow surface, and left and right skids 36L, 36R that slide on the snow surface or road surface, are provided to the bottom rear end of the auger housing 25.

The blower case 26 is attached to the front-end portion of the vehicle body frame 15 so as to be able to roll (left/right rotation; left/right tilting; swaying). An auger housing 25 integrated with the blower case 26 is also attached to the vehicle body frame 15 so as to be able to roll. As is clear from the above description, the auger housing 25 and the blower case 26 are able to roll in relation to the travel frame 12. In other words, the implement 13 is attached to the front of the machine body 19 so as to be able to roll and move up and down.

The machine body 19 is provided with a rolling drive mechanism 38 for causing the auger housing 25 and the blower case 26 to roll in relation to the travel frame 12. The rolling drive mechanism 38 is an actuator that allows a piston to move in and out of a cylinder. This actuator is a type of electrohydraulic cylinder for causing a piston to move telescopically by using hydraulic pressure generated from a hydraulic piston (not shown) in an electric motor 38*a* (see FIG. 3), and is also referred to as a tilting cylinder. The electric motor 38*a* is a drive source used for rolling, and the motor is built into the side portion of the cylinder of the rolling drive mechanism 38.

As shown in FIG. 2, the engine 14 is a snow removal drive source for driving the implement 13 via an electromagnetic clutch 31 and a transmission mechanism 32. The transmission mechanism 32 is a belt-type transmission mechanism in which motive force is transmitted by a belt to the auger transmission shaft 33 from the electromagnetic clutch 31 attached to a crankshaft 14*a* of the engine 14. The motive force of the engine 14 is transferred to the auger 27 and the blower 28 through the crankshaft 14*a*, the electromagnetic clutch 31, the transmission mechanism 32, and the auger transmission shaft 33. Snow gathered by the auger 27 can be thrown clear by the blower 28 via the shooter 29.

In the snow remover 10 as shown in FIGS. 1 and 2, an operating unit 40, a control unit 61, and a battery 62 are mounted between the left and right operating handles 17L, 17R. The operating unit 40 will be described hereinafter.

Figure 4:
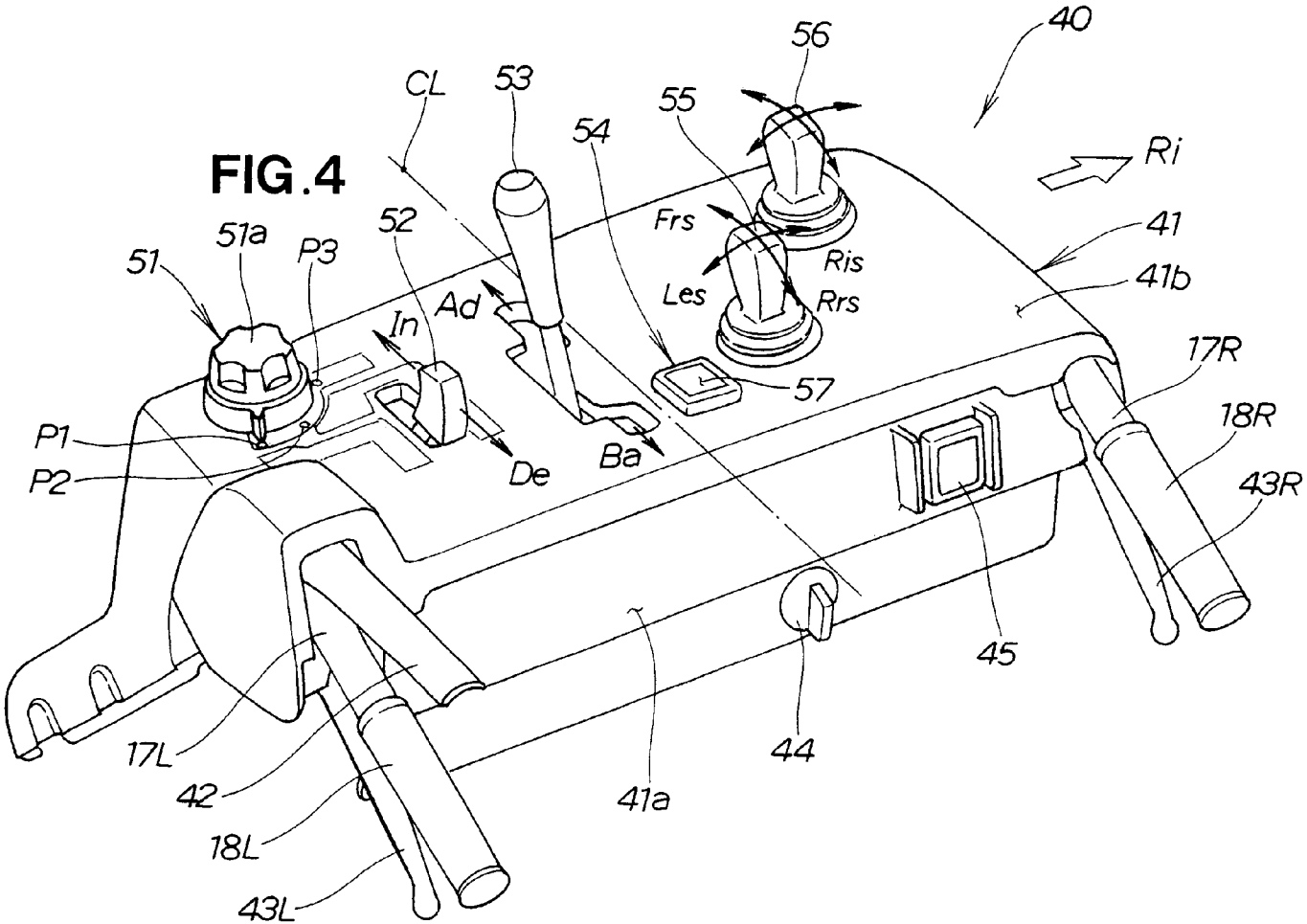
FIG. 4 is a perspective view of the operating unit shown in FIG. 1.
Figure 5:
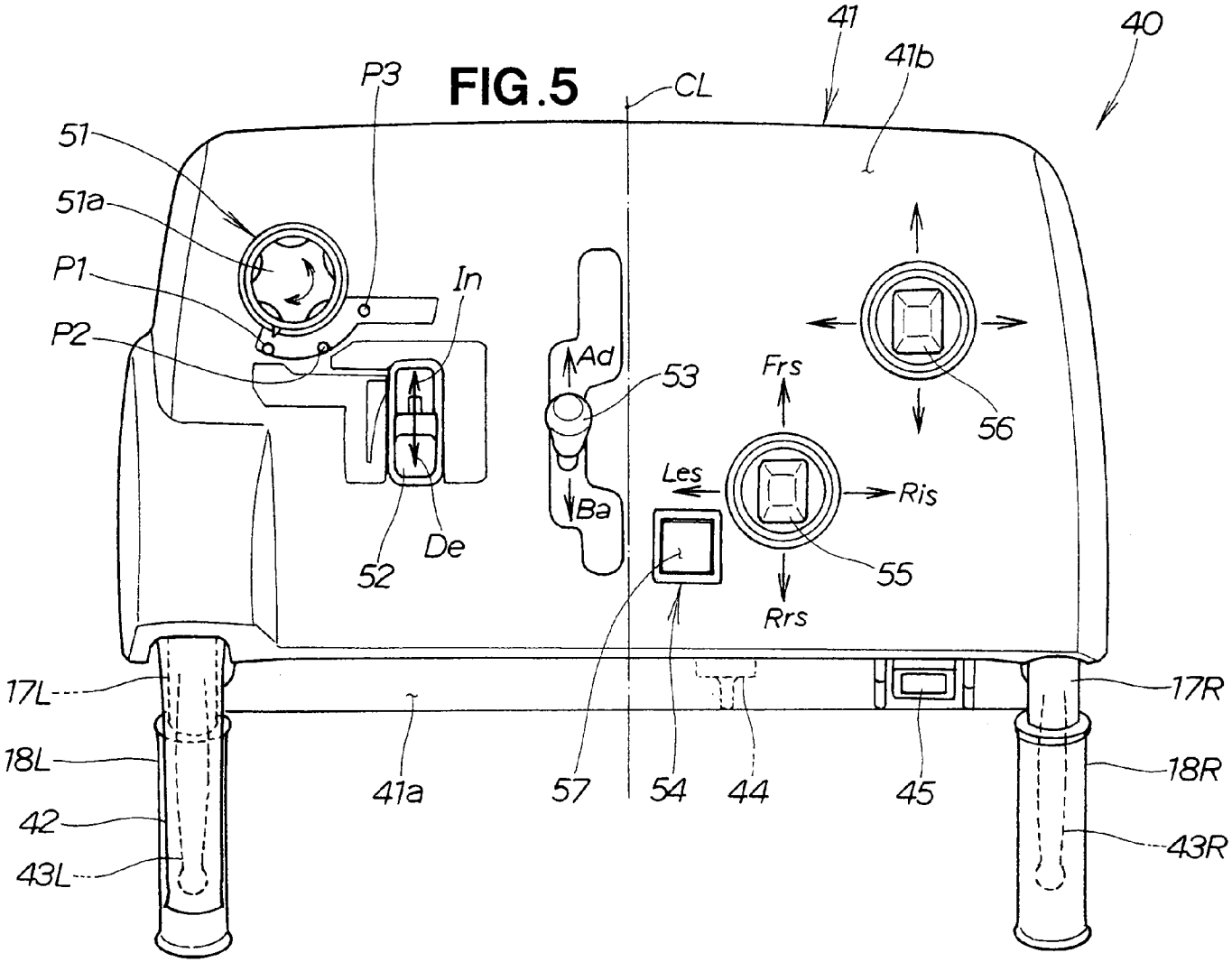
FIG. 5 is a plan view of the operating unit shown in FIG. 4.

As shown in FIGS. 4 and 5, the operating unit 40 is composed of an operating box 41, a travel preparation lever 42, a left-turn lever 43L, and a right-turn lever 43R. The operating box 41 spans the length between the left and right operating handles 17L, 17R. The travel preparation lever 42 and the left-turn lever 43L are attached near the left grip 18L to the left operating handle 17L. The right-turn lever 43R is attached near the right grip 18R to the right operating handle 17R.

The travel preparation lever 42 acts on a switch 42*a* (see FIG. 3) and is a member used to prepare for travel. The switch 42*a* is off when in the free state shown in the drawing, and is pressed into the ON state only when swung to the side of the grip 18L after the travel preparation lever 42 is grasped in the operator's left hand.

The left- and right-turn levers 43L, 43R are steering members that are operated by the hands that grip the left and right grips 18L, 18R, respectively, and are operating members that act on the corresponding turn switches 43La, 43Ra (see FIG. 3).

The left-turn switch 43La is off when in the free state shown in FIG. 4, and is pressed into the ON state only when swung to the side of the grip 18L after the left-turn lever 43L is grasped in the left hand of the operator. In other words, the left-turn switch 43La is ON when the left-turn lever 43L is turned, and is OFF when turning of the left-turn lever 43L is stopped.

The right-turn switch 43Ra is operated in the same manner. Specifically, the right-turn switch 43Ra is ON when the right-turn lever 43R is turned, and is OFF when turning of the right-turn lever 43R is stopped.

It can thereby be detected by the turn switches 43La, 43Ra whether the left- and right-turn levers 43L, 43R are being grasped.

The operating box 41 and the operating members disposed in the operating box 41 will next be described with reference to FIG. 3.

In the operating box 41 as shown in FIGS. 4 and 5, a main switch 44 and an auger switch 45 are provided to the back face 41*a* (the side that faces the operator). The main switch 44 is a manually operated power switch whereby the engine 14 can be started by turning a knob to the ON position. The auger switch 45, also referred to as the "clutch-operating switch 45" or the "work drive instruction unit 45," is a manually operated switch for switching the electromagnetic clutch 31 on and off. The switch may be composed of a push-button switch, for example.

The operating box 41 is furthermore provided with a mode switch 51, a throttle lever 52, a directional speed lever 53, a reset switch 54, an auger housing alignment lever 55, and a shooter-operating lever 56 arranged in this sequence from the left side to the right side on the upper surface 41*b* thereof. More specifically, the directional speed lever 53 is disposed on the left next to the vehicle widthwise center CL, and the reset switch 54 is disposed on the right next to the vehicle width center CL in the upper surface 41*b* of the operating box 41.

The mode switch 51 is a manually operated switch for switching the travel control mode controlled by the control unit 61 (see FIG. 3). The switch may be composed of a rotary switch, for example. A switch to a first control position P1, a second control position P2, and third control position P3 can be made by turning a knob 51*a* in the counterclockwise direction in the drawing. The mode switch 51 generates a switch signal in correspondence to the positions P1, P2, and P3 switched to by the knob 51*a*.

The first control position P1 is a switch position in which a switch signal indicating "first control mode" is issued to the control unit 61. The second control position P2 is a switch position in which a switch signal indicating "second control mode" is issued to the control unit 61. The third control position P3 is a switch position in which a switch signal indicating "third control mode" is issued to the control unit 61.

The first control mode is a mode wherein the travel speed of the travel units 11L, 11R is controlled according to the manual operation of the operator. This mode may also be referred to as "manual mode." For example, the operator may operate the snow remover while monitoring the rotational speed of the engine 14.

The second control mode is a mode wherein the travel speed of the travel units 11L, 11R is controlled so as to be gradually reduced according to the amount of increase in the travel of the throttle valve 71. This mode may also be referred to as "power mode."

The third control mode is a mode whereby the travel speed of the travel units 11L, 11R is controlled so as to be reduced more significantly than in the second control mode according to the amount of increase in the travel of the throttle valve 71. This mode may also be referred to as "auto mode (automatic mode)."

The second and third control modes may control the travel speed of the travel units 11L, 11R in accordance with the rotational speed of the engine 14, instead of according to the travel of the throttle valve 71.

The load control modes of the control unit 61 are thus set to three modes that include (1) a first control mode for manual operation used by an advanced operator who is sufficiently accustomed to operating the machine, (2) a semi-automatic second control mode used by an intermediate operator who has a certain level of experience operating the machine, and (3) an automatic third control mode used by a novice operator who has no experience operating the machine. By appropriately selecting these modes, a single snow remover 10 can easily be used in operating states that are optimized for novice-to-advanced operators.

The throttle lever 52 is an operating member that affects the rotation of a first control motor 72 in the electronic governor 65 (also referred to as an "electric governor 65") via the control unit 61. A potentiometer 52*a* issues a predetermined voltage signal (rotational speed variation instruction signal) to the control unit 61 according to the position of the throttle lever 52. The throttle lever 52 is an operating member that issues a rotational speed variation instruction to vary the rotational speed of the engine 14, and may therefore be also referred to as the "rotational speed variation instruction unit 52." The operator can swing or slide the throttle lever 52 forward and backward as indicated by arrows In and De. The throttle valve 71 can be opened and closed by operating the throttle lever 52 to cause a first control motor 72 to rotate. In other words, the rotational speed of the engine 14 can be adjusted by operating the throttle lever 52. Specifically, the throttle valve 71 can be opened all the way by moving the throttle lever 52 in the direction indicated by arrow In. The throttle valve 71 can be closed all the way by moving the throttle lever 52 in the direction indicated by arrow De.

Figure 6:
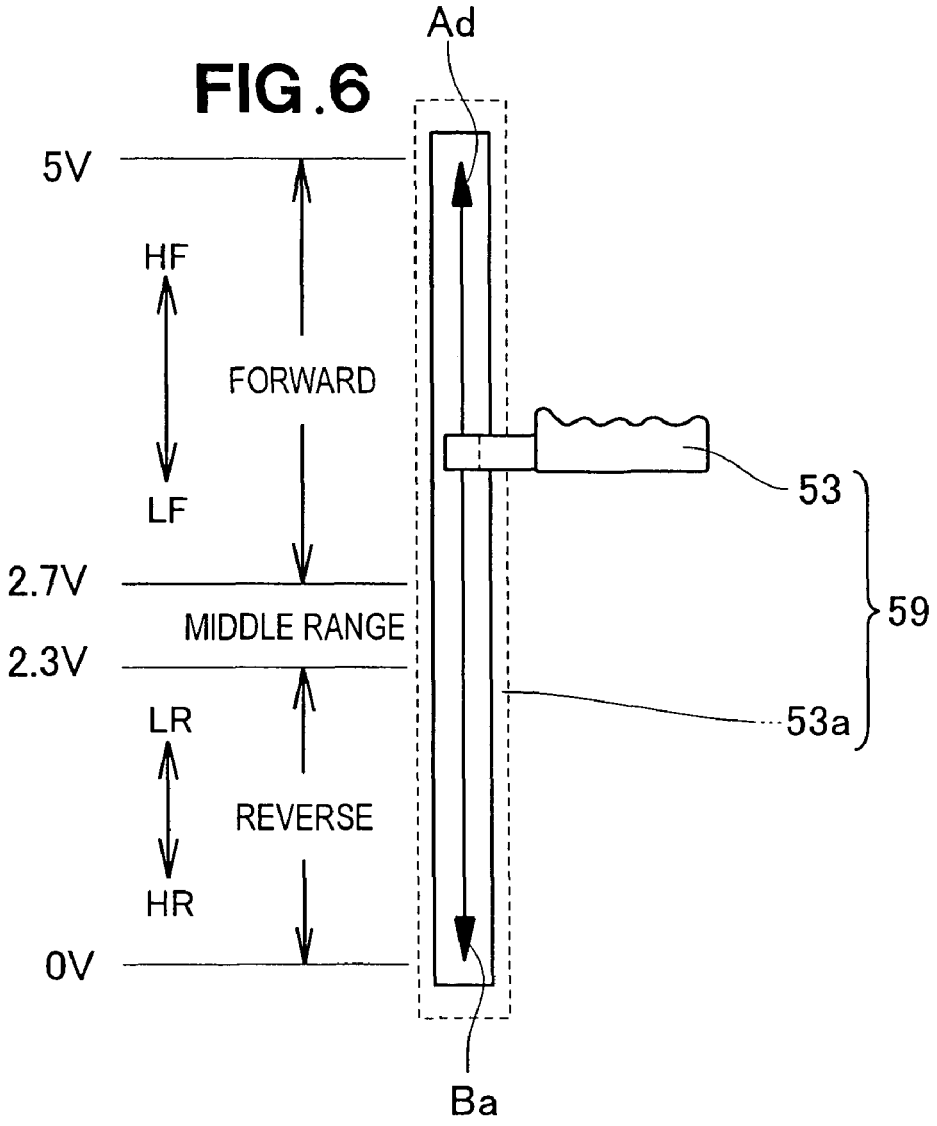
FIG. 6 is a view showing the operation of the directional speed lever shown in FIG. 4.

As shown in FIGS. 4 and 6, the directional speed lever 53 is an operating member for controlling the rotation of the electric motors 21L, 21R via the control unit 61. This directional speed lever 53 is also referred to as a "forward/reverse speed adjustment lever 53," a "target speed adjustment unit 53," or a "travel drive instruction unit 53," and the operator can swing or slide the directional speed lever 53 forward and backward as indicated by arrows Ad and Ba.

When the directional speed lever 53 is moved from the "middle range" to "forward," the electric motors 21L, 21R are caused to rotate forward, and the travel units 11L, 11R can be moved forward. In the "forward" region, the travel speed of the travel units 11L, 11R can be controlled so that LF represents forward movement at low speed, and HF represents forward movement at high speed.

In the same manner, when the directional speed lever 53 is moved from the "middle range" to "reverse," the electric motors 21L, 21R are caused to rotate backward, and the travel units 11L, 11R can be moved in reverse. In the "reverse" region, the travel speed of the travel units 11L, 11R can be controlled so that LR represents reverse movement at low speed, and HR represents reverse movement at high speed.

In this example, the potentiometer 53*a* (see FIG. 3) causes a voltage to be generated in accordance with the position so that the maximum speed of reverse movement occurs at 0 V (volts), the maximum speed of forward movement occurs at 5 V, and the middle range of speeds occurs at 2.3 V to 2.7 V, as indicated on the left side of FIG. 6. Forward or reverse movement and speed control between high and low speed can thus both be set by a single directional speed lever 53. The assembly of the directional speed lever 53 and the potentiometer 53*a* constitutes a travel operation unit 59.

As shown in FIGS. 2, 4, and 5, the reset switch 54 is a manual switch for restoring the alignment (position) of the auger housing 25 to a preset origin point (reference position). Specifically, the reset switch 54 is a member operated when the implement 13 is automatically returned to the predetermined reference position. This reset switch 54 is also referred to as the "switch 54 for automatically returning the auger to its original position," and the "return operating member 54," and is composed of a push-button switch provided with a display lamp 57, for example.

The auger housing alignment or aligning lever 55 is an operating member (joystick) that can swing in four directions and is also referred to as the "alignment operating member 55." Specifically, the aligning lever 55 is a member that affects both the lifting/lowering and the rolling of the implement 13.

The relationship between the positions of the reset switch 54 and the aligning lever 55 will next be described in detail.

The aligning lever 55 is disposed to the left or right with respect to the center CL (vehicle width center CL) of the width of the machine body 19. Specifically, the aligning lever 55 is disposed on the right side with respect to the center CL in order to accommodate a right-handed operator. It is more preferred for a right-handed operator to be able to operate the aligning lever 55 with the right hand in order to smoothly operate the aligning lever 55. In this case, the operator grasps the travel preparation lever 52 with the left hand.

The reset switch 54 is disposed in the vicinity of the aligning lever 55. More specifically, the reset switch 54 is disposed in a position nearer to the center of width CL of the machine body 19 than the aligning lever 55 and further towards the rear than the aligning lever 55. In other words, the reset switch 54 is disposed to the left and towards the rear with respect to the aligning lever 55. The reset switch 54 is disposed in a range that enables operation with the right thumb when the aligning lever 55 is grasped in the right hand, which is preferred for enhancing ease of operation. When the reset switch 54 is disposed to the right and towards the rear of the aligning lever 55, care must be taken so that the outside of the right hand grasping the aligning lever 55 does not come in contact with the reset switch 54.

Since the reset switch 54 is thus disposed in the vicinity of the aligning lever 55, the locations of these two operating members 54, 55 can be concentrated in a specific portion of the operating unit 40. The operator therefore selects one of the two operating members 54, 55 merely by a slight movement of one hand, and the operating member can be easily and rapidly operated. The burden of operation placed on the operator can therefore be alleviated.

Since a pushbutton switch is used as the reset switch 54, this button can be pushed while the aligning lever 55 is grasped. The reset switch 54 can therefore be made easier to operate.

The shooter-operating lever 56 is an operating member capable of swinging in four directions in order to change the orientation of the shooter 29 (see FIG. 1).

To summarize the description given above, the snow remover 10 is provided with travel units 11L, 11R disposed on the left and right of the machine body 19, an implement 13 disposed at the front of the machine body 19, left- and right-turn levers 43L, 43R disposed in the machine body 19, and a lift drive mechanism 16 and rolling drive mechanism 38 disposed in the machine body 19.

The left-turn lever 43L is a steering member for switching the left and right travel units 11L, 11R so that a left turn is made. The right-turn lever 43R is a steering member for switching the left and right travel units 11L, 11R so that a right turn is made. The lift drive mechanism 16 lifts and lowers the implement 13 in relation to the machine body 19. The rolling drive mechanism 38 causes the implement 13 to roll in relation to the machine body 19.

The control system of the snow remover 10 will next be described with reference to FIG. 3. The control system of the snow remover 10 is centralized in the control unit 61. The control unit 61 includes memory 63 and is configured so as to appropriately read various types of information (including the control routine described hereinafter) stored in the memory 63 and perform control. This control unit 61 controls the electronic governor 65, coordinates the operation of the electronic governor 65 with the operation of the electric motors 21L, 21R, and controls the travel speed.

The engine 14 will first be described. The air intake system of the engine 14 is configured so that the travel of the choke valve 73 and the travel of the throttle valve 71 are adjusted by the electronic governor 65. In other words, the first control motor 72 of the electronic governor 65 automatically adjusts the travel of the throttle valve 71 on the basis of the signal of the control unit 61. The second control motor 74 of the electronic governor 65 automatically adjusts the travel of the choke valve 73 on the basis of the signal of the control unit 61.

The electronic governor 65 has an automatic choke (also referred to as auto-choke) function for automatically opening and closing the choke valve 73 according to the temperature state of the engine 14. The engine 14 can be more appropriately and easily warmed up by automatically opening and closing the choke valve 73 according to the temperature state of the engine 14 when the engine 14 is started.

The engine 14 is provided with a throttle position sensor 75, a choke position sensor 76, an engine rotation sensor 77, and a generator 81. The throttle position sensor 75 detects the travel of the throttle valve 71 and issues a detection signal to the control unit 61. The choke position sensor 76 detects the travel of the choke valve 73 and issues a detection signal to the control unit 61. The engine rotation sensor 77 detects the speed of rotation (rotational speed) of the engine 14 and issues a detection signal to the control unit 61. The generator 81 is rotated by the engine 14 and feeds the resultant electrical power to a battery 62, the left and right electric motors 21L, 21R, and other electrical components.

By grasping the travel preparation lever 42 and turning the auger switch 45 ON, the electromagnetic clutch 31 can be connected (ON), and the auger 27 and blower 28 can be rotated by the motive force of the engine 14. The electromagnetic clutch 31 can be disengaged (OFF) by freeing the travel preparation lever 42 or turning off the auger switch 45.

The system that includes the travel units 11L, 11R will next be described. The snow remover 10 is provided with left and right electromagnetic brakes 82L, 82R for restricting the movement of the travel units 11L, 11R. The left and right electromagnetic brakes 82L, 82R correspond to a parking brake in a normal automobile, and are configured so as to restrict the movement of the motor shafts of the left and right electric motors 21L, 21R, for example. When the machine is parked, the electromagnetic brakes 82L, 82R are placed in a braking state (ON state) by the control action of the control unit 61.

The control unit 61 releases the electromagnetic brakes 82L, 82R when all of the conditions are satisfied from among a first condition wherein the main switch 44 is in the ON position, a second condition wherein the travel preparation lever 42 is grasped, and a third condition wherein the directional speed lever 53 is in the forward movement or reverse movement position. The control unit 61 then causes the left and right electric motors 21L, 21R to rotate via left and right motor drivers 84L, 84R on the basis of information as to the position of the directional speed lever 53 obtained from a potentiometer 53*a*. The control unit 61 also executes feedback control so that the speed of rotation (rotational speed) of the electric motors 21L, 21R detected by motor rotation sensors 83L, 83R conforms to a predetermined value. As a result, the left and right travel units 11L, 11R turn at a predetermined speed in a predetermined direction and allow the machine to travel.

The motor drivers 84L, 84R have regenerative brake circuits 85L, 85R, and short-circuit brake circuits 86L, 86R. The short-circuit brake circuits 86L, 86R are a type of braking means.

When the left-turn lever 43L is being grasped and the left-turn switch 43La is turned ON, the control unit 61 actuates the left regenerative brake circuit 85L on the basis of the switch-ON signal thus generated. As a result, the speed of the left electric motor 21L decreases. The snow remover 10 can therefore be turned left only when the left-turn lever 43L is grasped.

When the right-turn lever 43R is being grasped and the right-turn switch 43Ra is turned ON, the control unit 61 actuates the right regenerative brake circuit 85R on the basis of the switch-ON signal thus generated. As a result, the speed of the right electric motor 21R decreases. The snow remover 10 can therefore be turned right only when the right-turn lever 43R is grasped.

The travel units 11L, 11R can be stopped and the electromagnetic brakes 82L, 82R returned to the braking state by performing any of the operations that include (i) returning the main switch 44 to the OFF position, (ii) releasing the travel preparation lever 42, or (iii) returning the directional speed lever 53 to the middle position.

Figure 7:
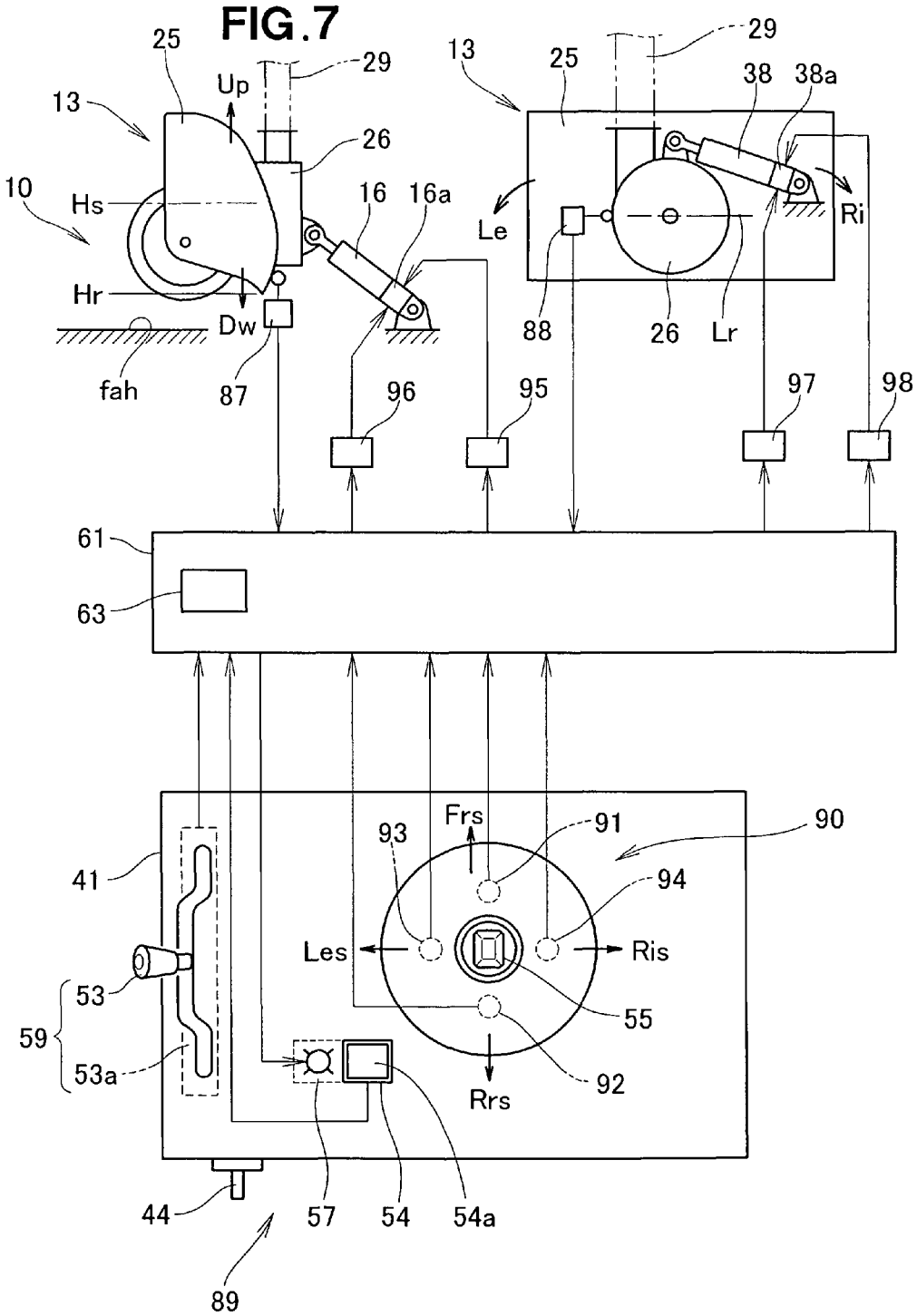
FIG. 7 is a view of the control system of the snow-removing implement shown in FIG. 3.

The control system for the auger housing 25 will next be described. FIG. 7 is a more detailed view of the control system of the auger housing 25 shown in FIG. 3.

As shown in FIG. 7, the operating box 41 is provided with four switches 91 through 94 used to align the auger housing and disposed on the periphery of the auger housing alignment lever 55. These four switches include a lowering switch 91 disposed in front of the auger housing alignment lever 55, an elevating switch 92 disposed to the rear thereof, a left-rolling switch 93 disposed to the left thereof, and a right-rolling switch 94 disposed to the right thereof. For example, when snow is removed by the snow remover 10, the operator operates the auger housing alignment lever 55 so that the alignment of the auger housing 25 conforms to the height of the snow to be removed.

When the auger housing alignment lever 55 is swung forward Frs, the lowering switch 91 is turned ON. The control unit 61, having received the ON signal, turns ON a lowering relay 95, whereby the electric motor 16*a* is powered and caused to rotate forward. As a result, the lift drive mechanism 16 lowers the implement 13 as indicated by arrow Dw.

When the auger housing alignment lever 55 is swung in reverse Rrs, the elevating switch 92 is turned ON. The control unit 61, having received the ON signal, turns ON an elevating relay 96, whereby the electric motor 16*a* is powered and caused to rotate backward. As a result, the lift drive mechanism 16 raises the implement 13 as indicated by arrow Up.

When the auger housing alignment lever 55 is swung to the left Les, the left-rolling switch 93 is turned ON. The control unit 61, having received the ON signal, turns ON a left-rolling relay 97, whereby the electric motor 38*a* is powered and caused to rotate forward. As a result, the rolling drive mechanism 38 causes the implement 13 to roll to the left as indicated by arrow Le.

When the auger housing alignment lever 55 is swung to the right Ris, the right-rolling switch 94 is turned ON. The control unit 61, having received the ON signal, turns ON a right-rolling relay 98, whereby the electric motor 38*a* is powered and caused to rotate backward. As a result, the rolling drive mechanism 38 causes the implement 13 to roll to the right as indicated by arrow Ri.

When the auger housing alignment lever 55 is thus swung forward Frs or backward Rrs, the piston of the lift drive mechanism 16 extends or retracts. As a result, the auger housing 25 and the blower case 26 are lifted or lowered. When the auger housing alignment lever 55 is swung to the left Les or right Ris, the piston of the rolling drive mechanism 38 is extended or retracted. As a result, the auger housing 25 and the blower case 26 perform a rolling movement.

The assembly composed of the aligning lever 55 and the four switches 91 through 94 constitutes an auger housing alignment operating unit 90.

The snow remover 10 is provided with a height position sensor 87 and a rolling position sensor 88. The height position sensor 87 is also referred to as a height position detector or angle detector. The rolling position sensor 88 is also referred to as a rolling position detector or tilt movement detector.

The height position sensor 87 is a vertical movement detection unit for detecting the lift position Hr (height position Hr) of the auger housing 25 in relation to the machine body 19 and issuing a detection signal to the control unit 61. The sensor may, for example, be composed of a potentiometer. The detection signal of the height position sensor 87 is a voltage signal (height position detection signal) that corresponds to the height position Hr of the auger housing 25.

The rolling position sensor 88 is a left-right tilt detection unit for detecting the rolling position (position Lr of tilt to the left and right) of the auger housing 25 in relation to the machine body 19, and issuing a detection signal to the control unit 61. The sensor may, for example, be composed of a potentiometer. The detection signal of the rolling position sensor 88 is a voltage signal (tilt position detection signal) that corresponds to the tilt position Lr.

The term "height position Hr" herein refers to the actual height position of the implement 13. The actual height position Hr will be referred to hereinafter as the "actual height position Hr." More specifically, the actual height position Hr is the height of the lower end of the scraper 35 (see FIG. 2) when the auger housing 25 is in a horizontal state.

The term "tilt position Lr" refers to the actual tilt position of the implement 13. The actual tilt position Lr will be referred to hereinafter as the "actual tilt position Lr." More specifically, the actual tilt position Lr is the amount of tilt of the lower end of the scraper 35 (see FIG. 2) when the auger housing 25 is rolled (tilted to the left or right) from a horizontal state in the transverse direction in relation to the machine body 19.

The assembly composed of the reset switch 54, the height position sensor 87, the rolling position sensor 88, and the control unit 61 constitutes an alignment return unit 89. The alignment return unit 89 executes a reference position return mode and a reference position changing mode.

The "reference position return mode" is a control mode whereby the lift drive mechanism 16 and the rolling drive mechanism 38 are controlled so as to automatically return the implement 13 to the reference position Hi, Lo. The reference position Hi, Lo consists of a height position and a rolling position for maintaining a reference alignment of the implement 13, and these positions are stored in memory 63. The "reference position changing mode" is a control mode for changing the reference position Hi, Lo to an arbitrary value. The reference position Hi, Lo consists of a height reference position Hi and a tilt reference position Lo.

The "reference alignment" of the implement 13 is set in the following manner, for example, upon shipment from the factory. Specifically, the optimum position in which snow can be removed from a flat surface fah when the snow remover 10 is placed on a horizontal, flat surface fah is used as the reference alignment of the implement 13.

The height reference position Hi in this instance is, for example, the position (height) at which the lower end of the scraper 35 (see FIG. 2) provided to the auger housing 25 touches the flat surface fah when the auger housing 25 is placed in a horizontal state. The lower end of the scraper 35 is then on the same level as the lower surfaces of the crawler belts 22L, 22R (see FIG. 2). The tilt reference position Lo is, of course, a horizontal position.

The reset switch 54 is thus operated not only when the implement 13 is automatically returned to the reference position, but also when the reference position changing mode is executed (details of this operation will be described hereinafter).

A plurality of control routines will next be described for each embodiment in a case in which the control unit 61 shown in FIG. 3 is a microcomputer. The plurality of control routines is executed by a single control unit 61. These control routines initiate control when the main switch 44 is turned ON, for example, and end control when the main switch 44 is turned OFF.

A first embodiment of the control routine will first be described based on FIGS. 8 through 10 with reference to FIGS. 7 and 11A through 11C.

Step (hereinafter abbreviated as ST) ST01: The switch signal of the reset switch 54 is read. The reset switch 54 is turned ON by the operator pressing the button 54*a* of the reset switch 54.

ST02: It is determined whether the reset switch 54 is ON. If YES, then the process proceeds to ST03. If NO, then the process returns to ST01.

ST03: The count time Tc of a timer housed in the control unit 61 is reset to zero (Tc=0).

ST04: The timer is started.

ST05: It is determined whether the count time Tc (elapsed time Tc) indicates that a preset definite reference time Ts has not yet elapsed (Tc<Ts). If YES, then the process proceeds to ST06. If NO, then the process proceeds to ST11.

ST06: The switch signal of the reset switch 54 is read.

ST07: It is determined whether the reset switch 54 is OFF. If YES, then the process proceeds to ST08. If NO, then the process returns to ST05.

ST08: The timer is stopped.

ST09: The count time Tc of the timer is set to zero (Tc=0)

ST10: The reference position return mode for returning the implement 13 to the reference position Hi, Lo is executed. A subroutine for specifically executing ST10 will be described in detail hereinafter using FIG. 9.

ST11: The reference position changing mode for arbitrarily changing the reference position Hi, Lo is executed. A subroutine for specifically executing ST11 will be described in detail hereinafter using FIG. 10.

As described above, the current position of the auger housing 25 is returned to the reference position Hi, Lo as shown in FIG. 11A when the count time Tc for which the reset switch 54 is turned ON is shorter than the reference time Ts. On the other hand, the reference position Hi, Lo can be arbitrarily changed to a new value when the count time Tc for which the reset switch 54 is turned ON is equal to or greater than the reference time Ts.

The reference time Ts herein is a "threshold value" used as a determining reference for switching between the two modes according to the length of time (count time Tc) that the reset switch 54 is turned ON. Therefore, the reference time Ts is set to a predetermined time which can be clearly determined and in which the operating properties of the reset switch 54 are taken into account.

The subroutine for specifically executing control of the reference position return mode of step ST10 shown in FIG. 8 will next be described based on FIG. 9.

ST101: An indicator lamp 57 provided to the reset switch 54 is flashed. The operator can be notified by this flashing display that the implement 13 is in the process of returning to the reference position Hi, Lo.

ST102: The reference position Hi, Lo of the implement 13, i.e., the height reference position Hi and the tilt reference position Lo, are read from the memory 63.

ST103: The actual height position Hr of the implement 13 is calculated. The detection signal from the height position sensor 87 may be read as the actual height position Hr.

ST104: The actual height position Hr and the height reference position Hi are compared with each other. The process proceeds to ST105 if it is determined that the actual height position Hr is lower than the height reference position Hi (Hi>Hr). The process proceeds to ST106 if it is determined that the actual height position Hr is higher than the height reference position Hi (Hi<Hr). The process proceeds to ST107 if it is determined that the actual height position Hr matches the height reference position Hi (Hi=Hr).

ST105: The elevating relay 96 is turned ON. As a result, the lift drive mechanism 16 raises the implement 13 as indicated by arrow Up in FIG. 11A.

ST106: The lowering relay 95 is turned ON. As a result, the lift drive mechanism 16 lowers the implement 13 as indicated by arrow Dw in FIG. 11A.

ST107: The lowering relay 95 and the elevating relay 96 are turned OFF. As a result, the lift drive mechanism 16 stops lifting and lowering the implement 13.

ST108: The actual tilt position Lr of the implement 13 is calculated. The detection signal from the rolling position sensor 88 may be read as the actual tilt position Lr.

ST109: The tilt reference position Lo and the actual tilt position Lr are compared with each other.

As shown in FIG. 11B, the process proceeds to ST110 when it is determined that the actual tilt position Lr is tilted downward and to the left with respect to the tilt reference position Lo (Lr>Lo), i.e., when it is determined that the left end of the auger housing 25 is lowered.

As shown in FIG. 11C, the process proceeds to ST111 when it is determined that the actual tilt position Lr is tilted downward and to the right with respect to the tilt reference position Lo (Lr<Lo), i.e., when the right end of the auger housing 25 is lowered.

As shown in FIG. 11A, the process proceeds to ST112 when it is determined that the actual tilt position Lr matches the tilt reference position Lo (Lr=Lo).

ST110: The right-rolling relay 98 is turned ON. As a result, the rolling drive mechanism 38 causes the implement 13 to roll to the right as indicated by arrow Ri in FIG. 11B.

ST111: The left rolling relay 97 is turned ON. As a result, the rolling drive mechanism 38 causes the implement 13 to roll to the left as indicated by arrow Le in FIG. 11C.

ST112: The left and right rolling relays 97, 98 are turned OFF. As a result, the lift drive mechanism 16 stops the rolling of the implement 13.

ST113: It is determined whether conditions are satisfied wherein the actual height position Hr matches the height reference position Hi (Hi=Hr), and the actual tilt position Lr matches the tilt reference position Lo (Lo=Lr). If YES, then the process returns to ST114. If NO, then the process returns to ST103.

Steps ST103 through ST113 are thus repeated until the following conditions are satisfied: "Hi=Hr" and "Lo=Lr." The implement 13 can thereby be returned to the height reference position Hi and the tilt reference position Lo. The conditions "Hi=Hr" and "Lo=Lr" are satisfied herein by stopping the lifting and lowering of the implement 13 in ST107 and stopping the rolling of the implement 13 in ST112. The implement 13 can thereby be returned to the reference position Hi, Lo.

ST114: The indicator lamp 57 is switched from a flashing state to a constant lit state, after which the process returns to ST10 in FIG. 8. The operator can be notified by the lit display that the implement 13 has returned to the reference position Hi, Lo. The operator can easily recognize that the implement 13 has returned to the reference position Hi, Lo. As a result, the snow remover 10 can be made easier to operate.

An example was described in this embodiment in which the routine for returning the actual height position Hr of the implement 13 to the height reference position Hi according to ST103 through ST107 and the routine for returning the actual tilt position Lr of the implement 13 to the tilt reference position Lo according to ST108 through ST112 were executed separately. However, the routine of ST103 through ST107 and the routine of ST108 through ST112 may be configured as parallel routines that are executed simultaneously.

The subroutine for specifically executing control of the reference position changing mode of step ST11 shown in FIG. 8 will next be described based on FIG. 10.

ST201: The indicator lamp 57 provided to the reset switch 54 is flashed. The operator can be notified by this flashing display that the reference position Hi, Lo is being changed. The frequency of flashing at this time is preferably different from the flashing frequency in ST101 shown in FIG. 9. This is to make it even easier to confirm whether the reference position return mode is being executed or the reference position changing mode is being executed.

ST202: The actual height position Hr of the implement 13 is calculated.

ST203: The actual tilt position Lr of the implement 13 is calculated.

ST204: The switch signal of the reset switch 54 is read.

ST205: It is determined whether the reset switch 54 is ON. If YES, then the process proceeds to ST206. If NO, then the process returns to ST202.

ST206: The value of the height reference position Hi is changed to the value of the actual height position Hr calculated in ST202. Specifically, the actual height position Hr is set as the new height reference position Hi.

ST207: The value of the tilt reference position Lo is changed to the value of the actual tilt position Lr calculated in ST203. Specifically, the actual tilt position Lr is set as the new tilt reference position Lo.

ST208: The new value for the height reference position Hi set in ST206 and the new value for the tilt reference position Lo set in ST207 are written into memory 63. As a result, the height reference position Hi and the tilt reference position Lo change to new values.

ST209: After the indicator lamp 57 is turned off, the process returns to ST11 in FIG. 8. The operator can be notified that changing of the reference position Hi, Lo is completed by the fact that the indicator lamp 57 is turned off.

The following is a summary of the description given above.

Two control modes ST10 and ST11 can be switched according to the time Tc during which the reset switch 54 is turned ON. In other words, the control unit 61 executes the reference position return mode (ST10) when the turned-ON time Tc is shorter than the reference time Ts (YES in ST05 and ST07). The control unit 61 thus controls the lift drive mechanism 16 and the rolling drive mechanism 38 by issuing two instructions that include the adjustment drive instruction issued to the lift drive mechanism 16 and the adjustment drive instruction issued to the rolling drive mechanism 38.

Therefore, the current positions Hr and Lr of the implement 13 can be automatically and rapidly returned to the reference position Hi, Lo even when the operator does not operate the aligning lever 55. The operator may then operate the aligning lever 55 to finely adjust the position of the implement 13 in accordance with the terrain where snow is cleared. Since the position of the implement 13 can be finely adjusted using the reference position Hi, Lo as a reference after returning the implement 13 to the reference position Hi, Lo in one operation, good working efficiency is obtained. Accordingly, the implement 13 can be rapidly returned to the reference position Hi, Lo, and the alignment of the implement 13 can be easily manipulated.

Particularly for an inexperienced novice operator, it is usually difficult to rapidly set the implement 13 to the appropriate position in response to a change in the situation during snow removal. According to the present invention, however, the implement 13 can be automatically and rapidly returned to the reference position Hi, Lo, and the snow remover is therefore easy for a novice operator to use.

The implement 13 can be returned to the reference position Hi, Lo by the simple operation of merely operating the reset switch 54. The snow remover 10 can therefore be made easier to use.

When the ON time Tc has passed the reference time Ts (NO in ST05), the control unit 61 executes the reference position changing mode (ST11), and the reference position Hi, Lo can be arbitrarily changed to a new value. In other words, in the reference position changing mode shown in FIG. 10, the aligning lever 55 is operated, and the implement 13 is freely moved to the position desired by the operator, after which the reset switch 54 is again turned ON (ST205). As a result, the control unit 61 changes the reference position Hi, Lo to a new value (ST206 to ST208).

The control unit 61 then again executes (ST10) the reference position return mode by the reset switch 54 being turned ON only for a short time (YES in ST05 and ST07). The implement 13 can therefore be automatically returned to the new reference position Hi, Lo. The reference position Hi, Lo of the implement 13 can thus be arbitrarily changed to adapt to rolling terrain, to an area with a large amount of accumulated snow, or to another condition.

As is clear from the above description, merely by turning ON reset switch 54 in accordance with the control routine of the first embodiment, it is possible to arbitrarily switch between two control modes that include the reference position return mode (ST10) and the reference position changing mode (ST11) according to the length of time Tc that the reset switch 54 is turned ON. Since two control modes can be switched and executed using a single reset switch 54, operation is extremely simple. Since the operating member 54 can also be integrated, it is possible to reduce the size of the operating unit 40.

Furthermore, since the indicator lamp 57 is provided to the operating unit 40, the operator can be notified of the difference between the reference position return mode, the reference position changing mode, and another mode according to the state in which the indicator lamp 57 is lit. For example, a certain amount of time is required for the implement 13 to return to the reference position Hi, Lo. However, the operator can be notified by the indicator lamp 57 that the implement 13 is in the process of returning. The snow remover 10 is therefore made easier to operate.

Figure 8:
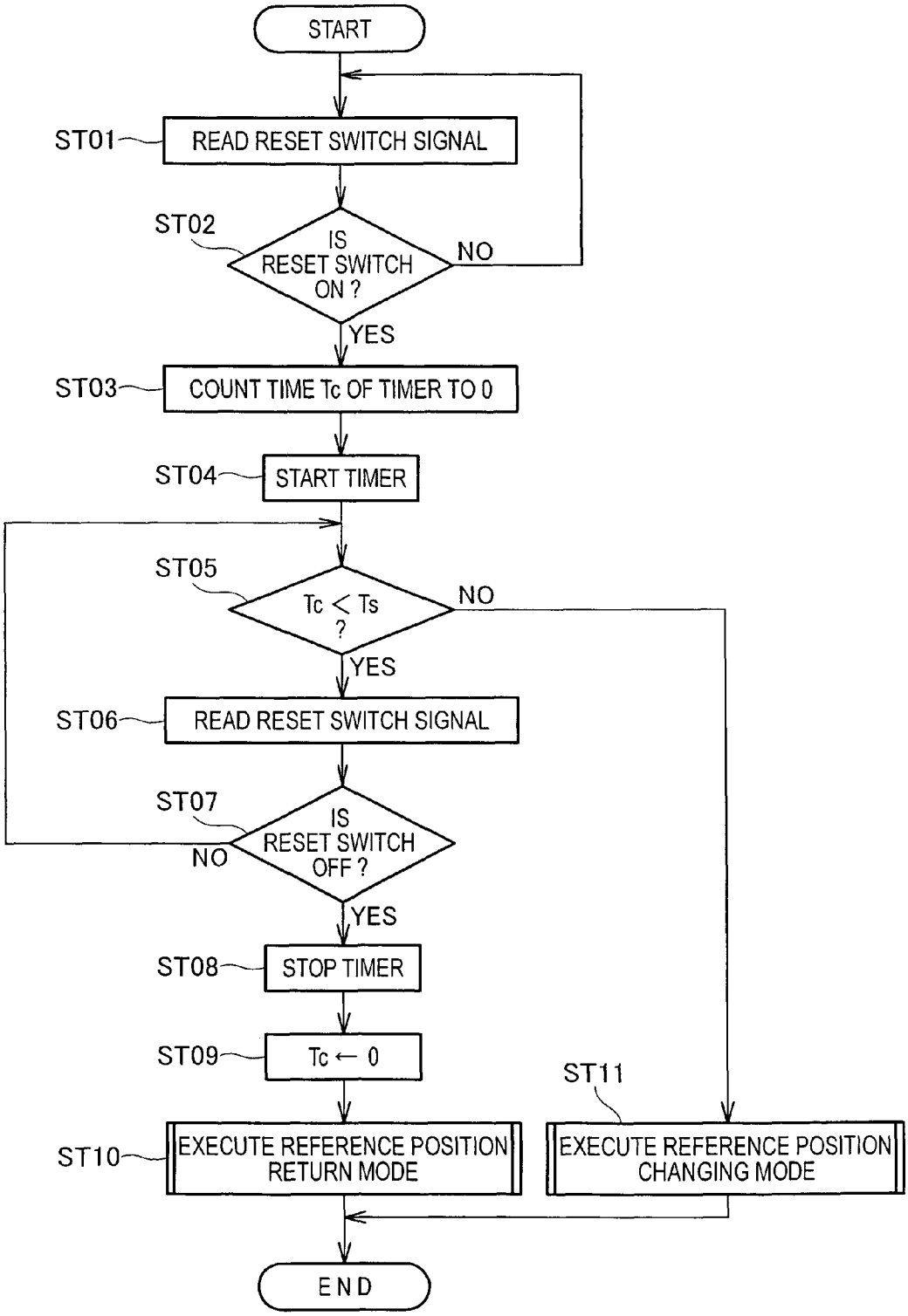
FIG. 8 is a chart of the control routine of a first embodiment of the control unit shown in FIG. 7.
Figure 9:
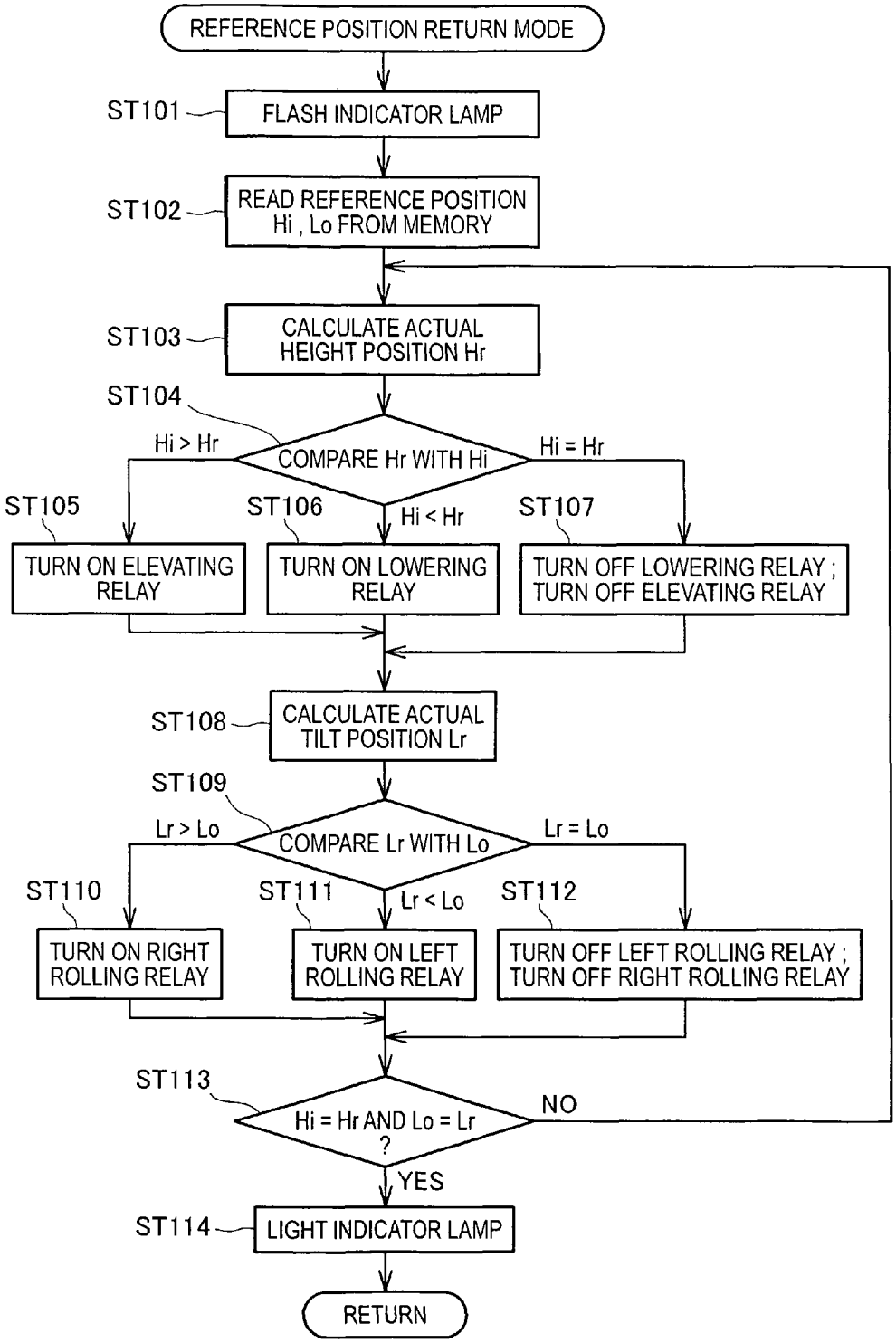
FIG. 9 is a chart of the specific control routine for the reference position return mode in the control routine chart shown in FIG. 8.
Figure 10:
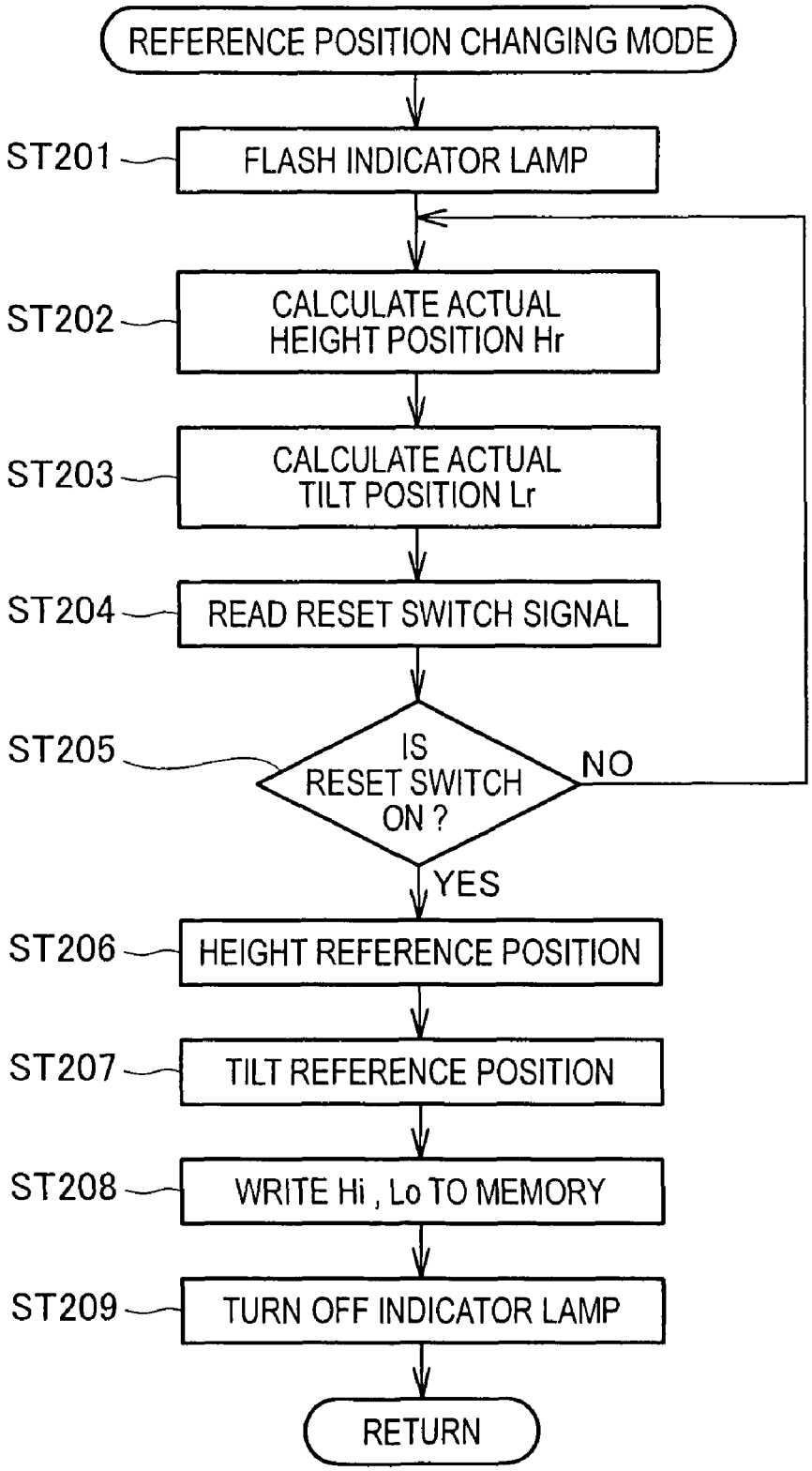
FIG. 10 is a chart of the specific control routine for the reference position changing mode in the control routine chart shown in FIG. 8.

In the control routine of the first embodiment shown in FIGS. 8 through 10, the height reference position Hi and the tilt reference position Lo were both set, and the implement 13 was returned to both of these reference positions Hi and Lo, but this configuration is not limiting. For example, a configuration may be adopted in which only one position selected from the height reference position Hi and tilt reference position Lo is set, and the implement 13 is returned to the reference position (height reference position Hi or tilt reference position Lo).

An example of the operating sequence of the snow remover 10 (see FIG. 1) will next be described based on FIGS. 12A through 12L.

Figure 12A:
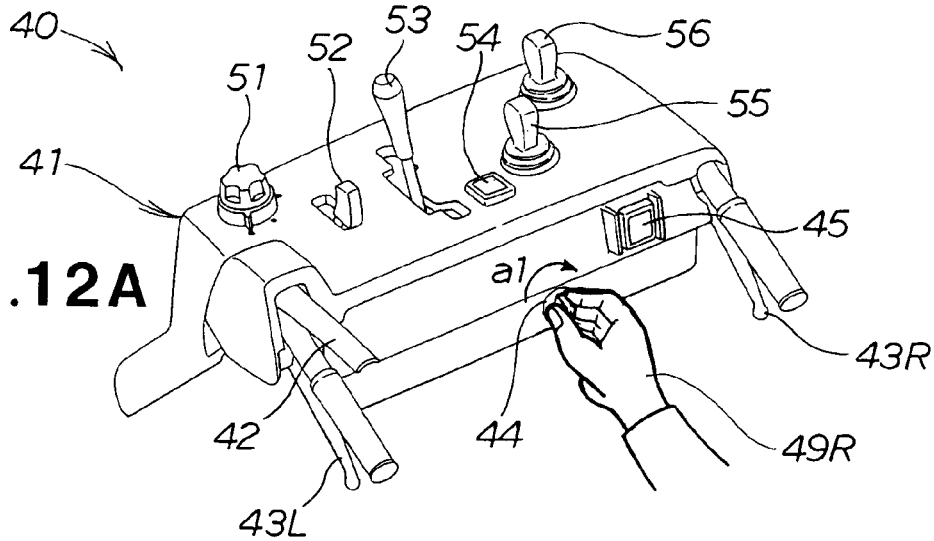
FIGS. 12A through 12L are views showing examples of the operation of the operating unit shown in FIG. 4.

First, the operator turns the main switch 44 with his right hand 49R as indicated by arrow a1 in FIG. 12A. As a result, the engine 14 (see FIG. 1) is started.

Figure 12B:
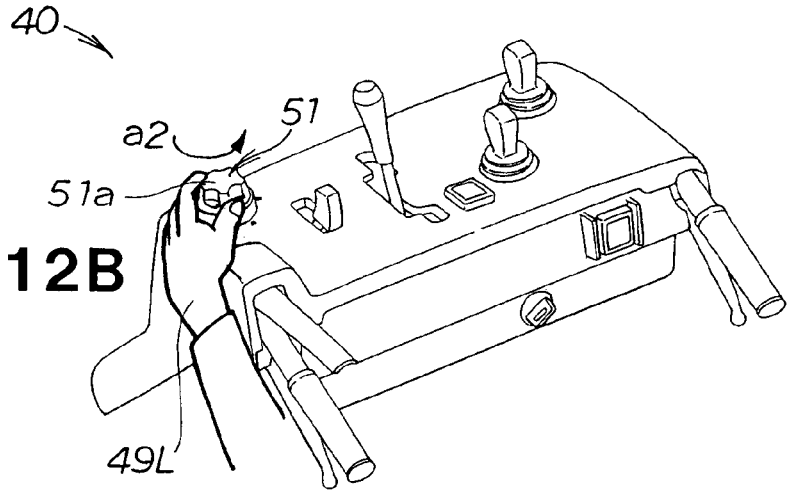

The knob 51*a* of the mode switch 51 is then turned with the left hand 49L as indicated by arrow a2 in FIG. 12B, and the control mode is switched.

Figure 12C:
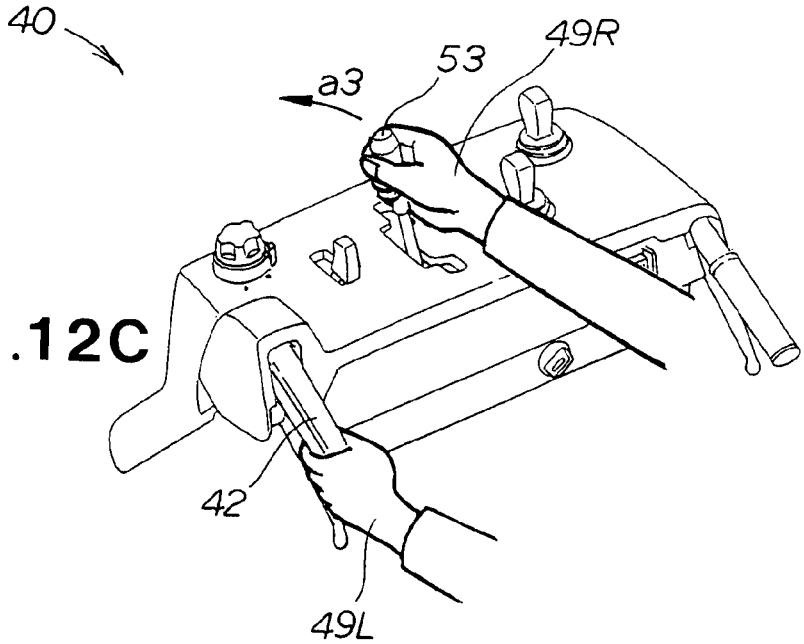

The travel preparation lever 42 is then grasped with the left hand 49L, and the directional speed lever 53 is moved by the right hand 49R into the forward position as indicated by arrow a3 in FIG. 12C. As a result, the snow remover 10 travels forward. The left hand 49L is grasping the travel preparation lever 42 as shown in FIG. 12C in the description of the subsequent operating sequence.

Figure 12D:
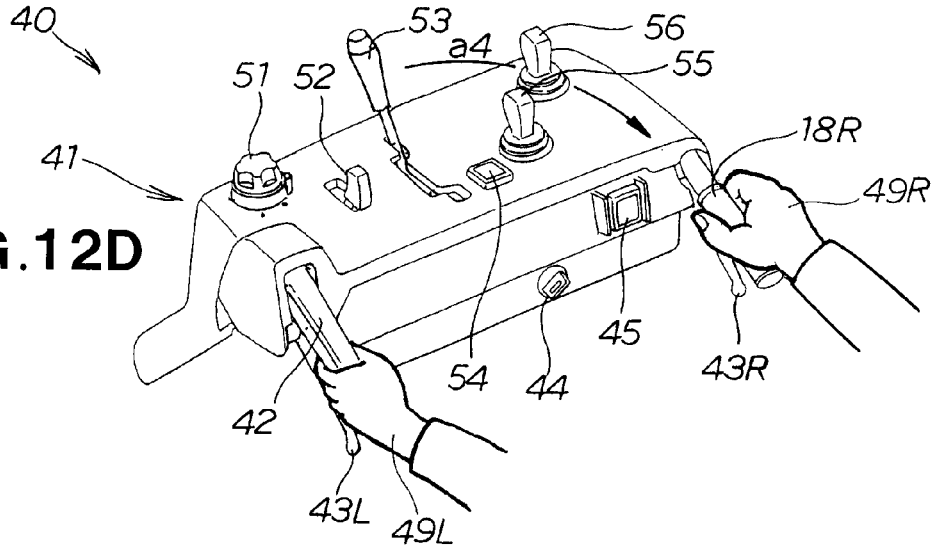

The right hand 49R then moves to and steers the right grip 18R as indicated by arrow a4 in FIG. 12D.

Figure 12E:
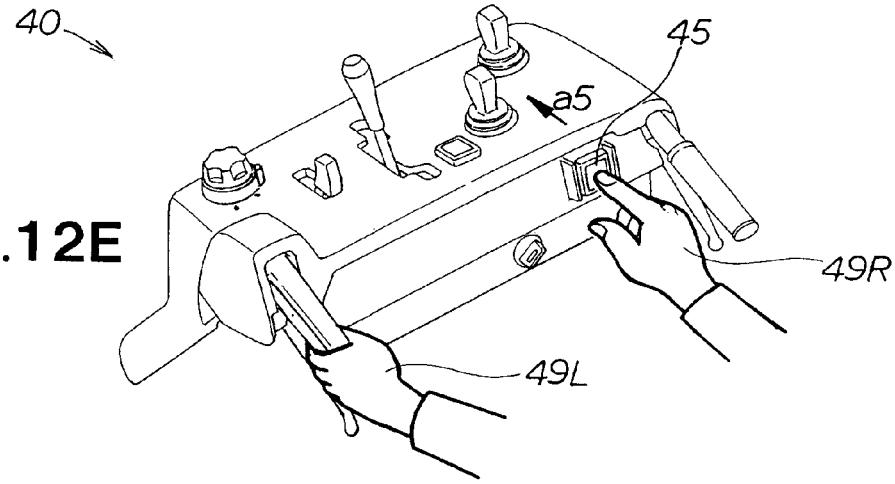

The auger switch 45 is then pushed by the right hand 49R as indicated by arrow a5 in FIG. 12E, and preparation for snow removal is begun by the rotation of the auger 27 (see FIG. 1).

Figure 12F:
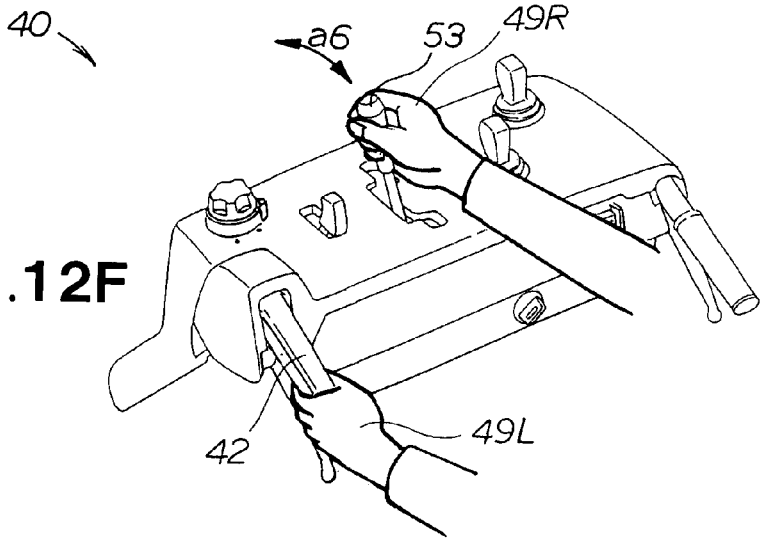

The directional speed lever 53 is then adjusted by the right hand 49R as indicated by arrow a6 in FIG. 12F, and the forward travel speed is adjusted.

Figure 12G:
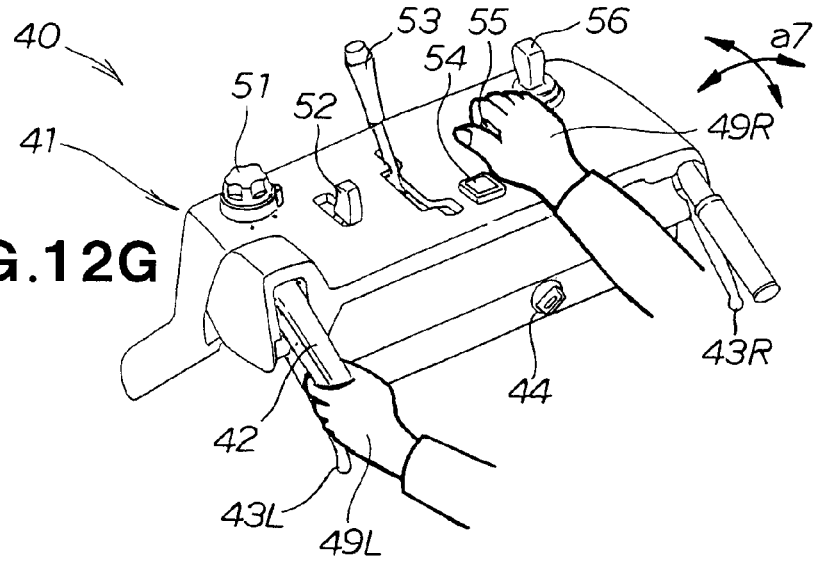

The aligning lever 55 is then moved forward, backward, left, and right as indicated by arrow a7 in FIG. 12G, whereby snow removal is continued while the height and left/right tilt of the implement 13 (see FIG. 7) are adjusted.

Figure 12H:
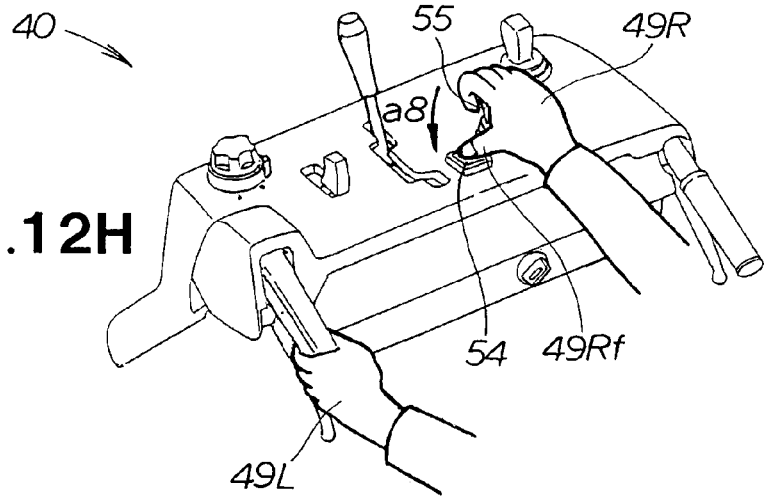

When the need arises to return the height and left/right tilt of the implement 13 to the reference position, the implement 13 can be returned to the initial position by pressing the reset switch 54 with the thumb 49Rf of the right hand 49R, for example, as indicated by arrow a8 in FIG. 12H.

Figure 12I:
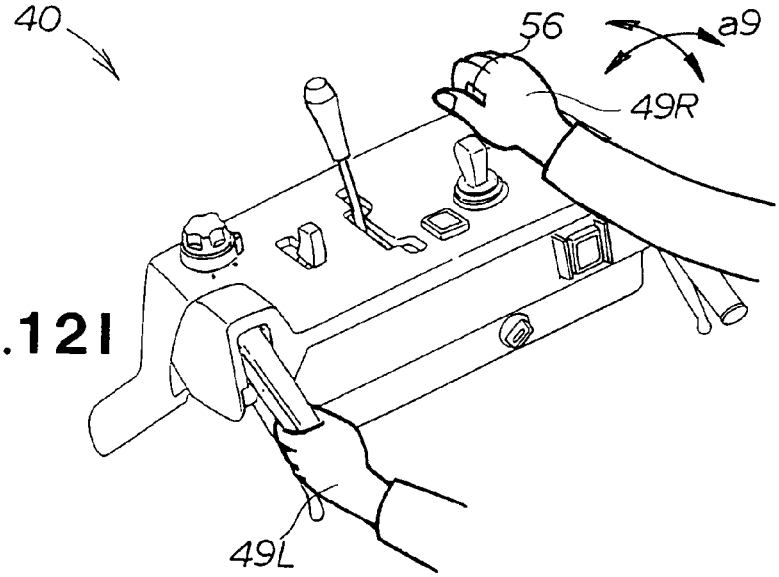

The shooter operating lever 56 is then moved forward, backward, left, and right as indicated by arrow a9 in FIG. 12I to adjust the direction in which snow is ejected by the shooter 29 (see FIG. 1), enabling the direction in which snow is ejected to be adjusted.

Figure 12J:
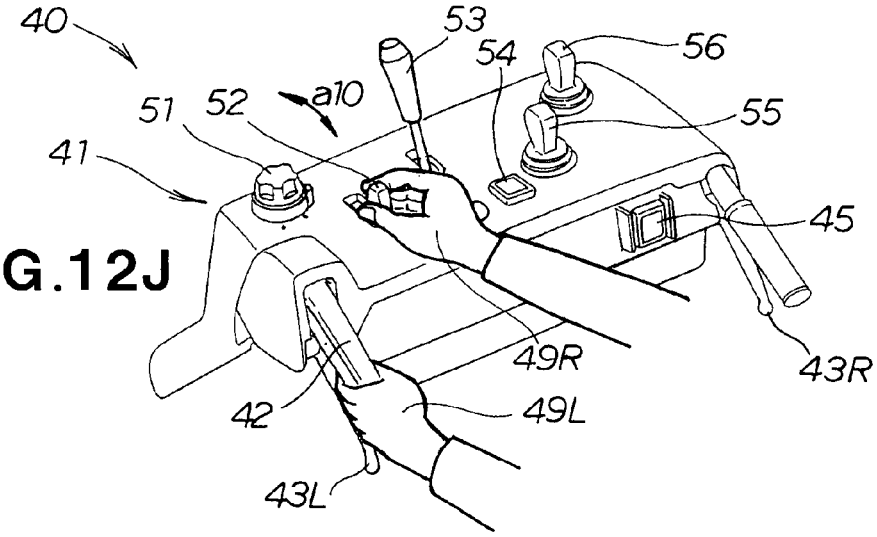

The throttle lever 52 is then moved as needed by the right hand 49R in the manner indicated by arrow a10 in FIG. 12J, and snow removal is continued while the rotational speed of the engine 14 (see FIG. 1) is adjusted.

Figure 12K:
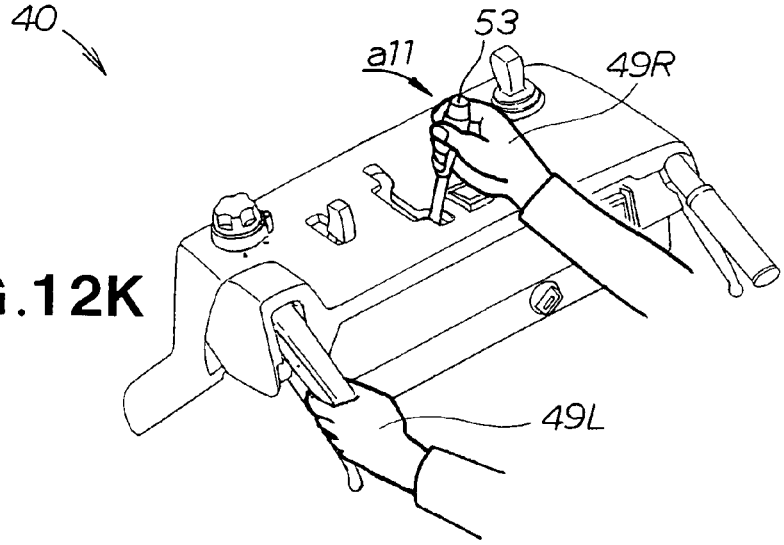

The snow remover 10 travels in reverse when the directional speed lever 53 is moved by the right hand 49R to the reverse position as indicated by arrow all in FIG. 12K.

Figure 12L:
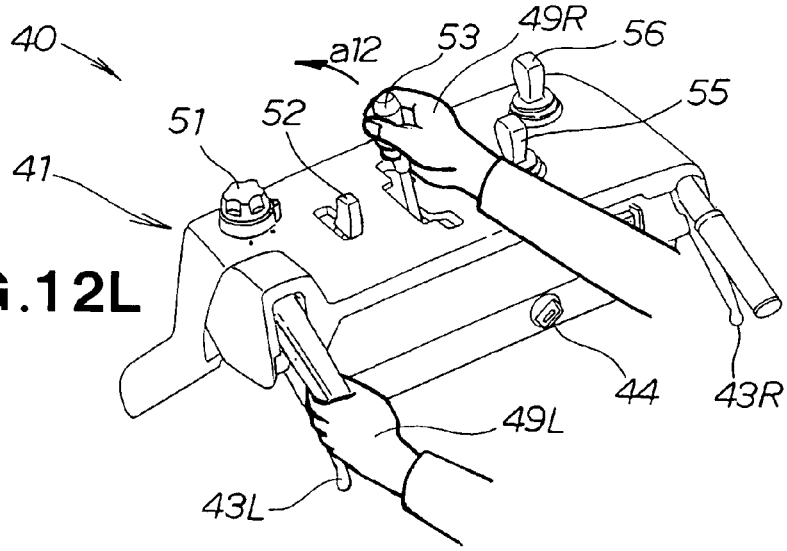

The snow remover 10 travels forward when the directional speed lever 53 is moved by the right hand 49R into the forward position as indicated by arrow a12 in FIG. 12L. Snow removal can thus be resumed.

A modified example of the operating unit 40 will next be described based on FIG. 13. The same reference symbols are used for structures and operations that are the same as in the working example shown in FIGS. 1 through 12L, and description thereof is omitted.

Figure 13:
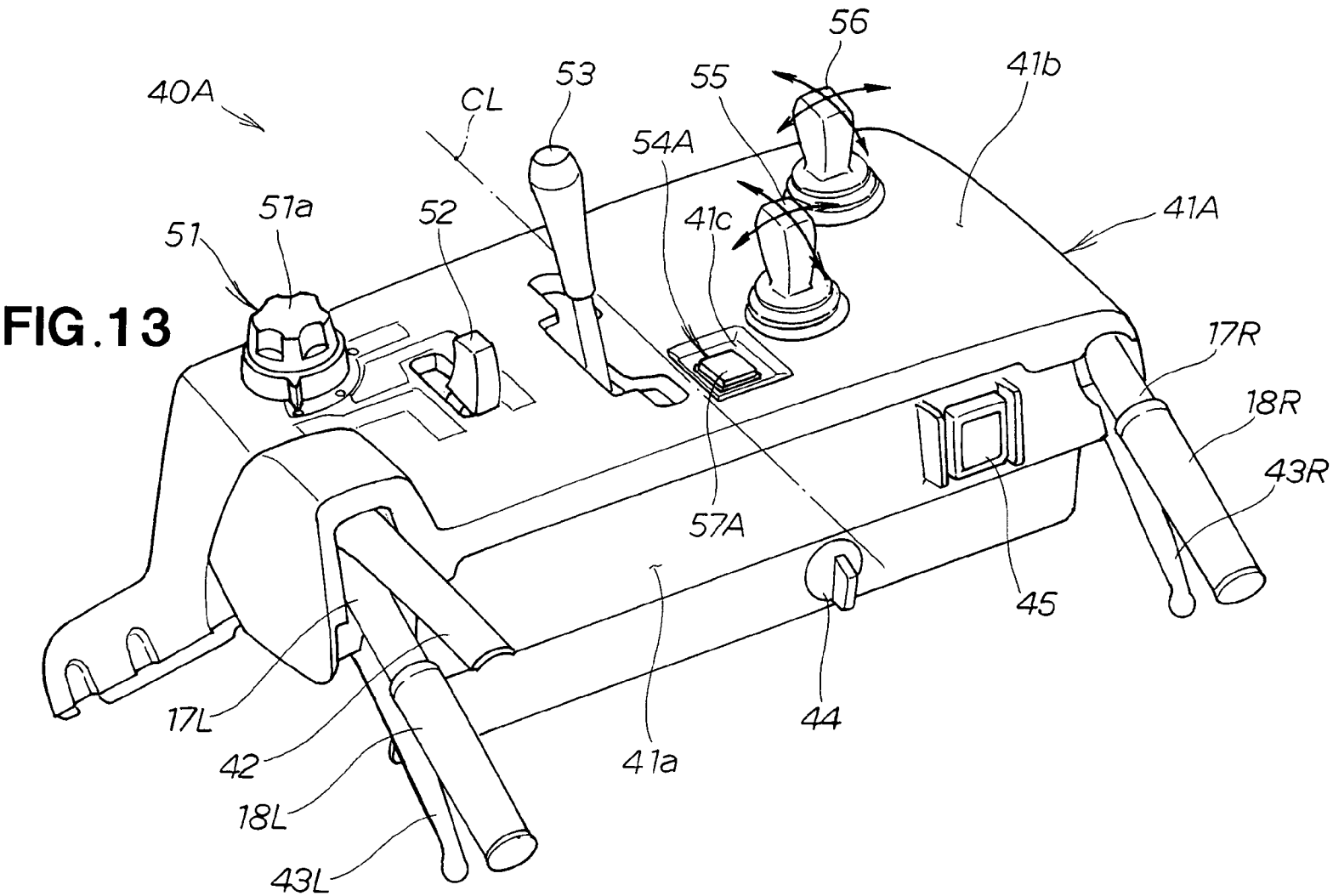
FIG. 13 is a perspective view of a modified example of the operating unit shown in FIG. 4.

FIG. 13 is a view of the operating unit 40A according to the modified example shown in correlation with the operating unit 40 shown in FIG. 4. An essential feature of the operating unit 40A of the modified example is that the structure of the reset switch 54A is altered.

The basic structure of the operating box 41A in the operating unit 40A of the modified example is the same as that of the operating box 41 shown in FIG. 4, and the operating box 41A has a back surface 41*a* (surface facing the operator) and an upper surface 41*b*. The upper surface 41*b* of the operating box 41A has a recessed portion 41*c*. The reset switch 54A is mounted in the recessed portion 41*c*.

The reset switch 54A has the same basic structure as the reset switch 54 shown in FIG. 4, and is composed of a push-button switch provided with an indicator lamp 57A. The operating surface (upper end surface) of the reset switch 54A is set to the same level as the upper surface 41*b* of the operating box 41. In other words, the operating surface of the reset switch 54A does not protrude from the upper surface 41*b* of the operating box 41A. Therefore, when the operator is operating the aligning lever 55, there is no risk of the reset switch 54A being pressed by mistake. It can be ensured that the reset switch 54A is operated only when consciously moved by the operator.

The operating surface of the reset switch 54A may also be lower than the upper surface 41*b* of the operating box 41A in a range within which operability is unaffected.

Figure 14B:
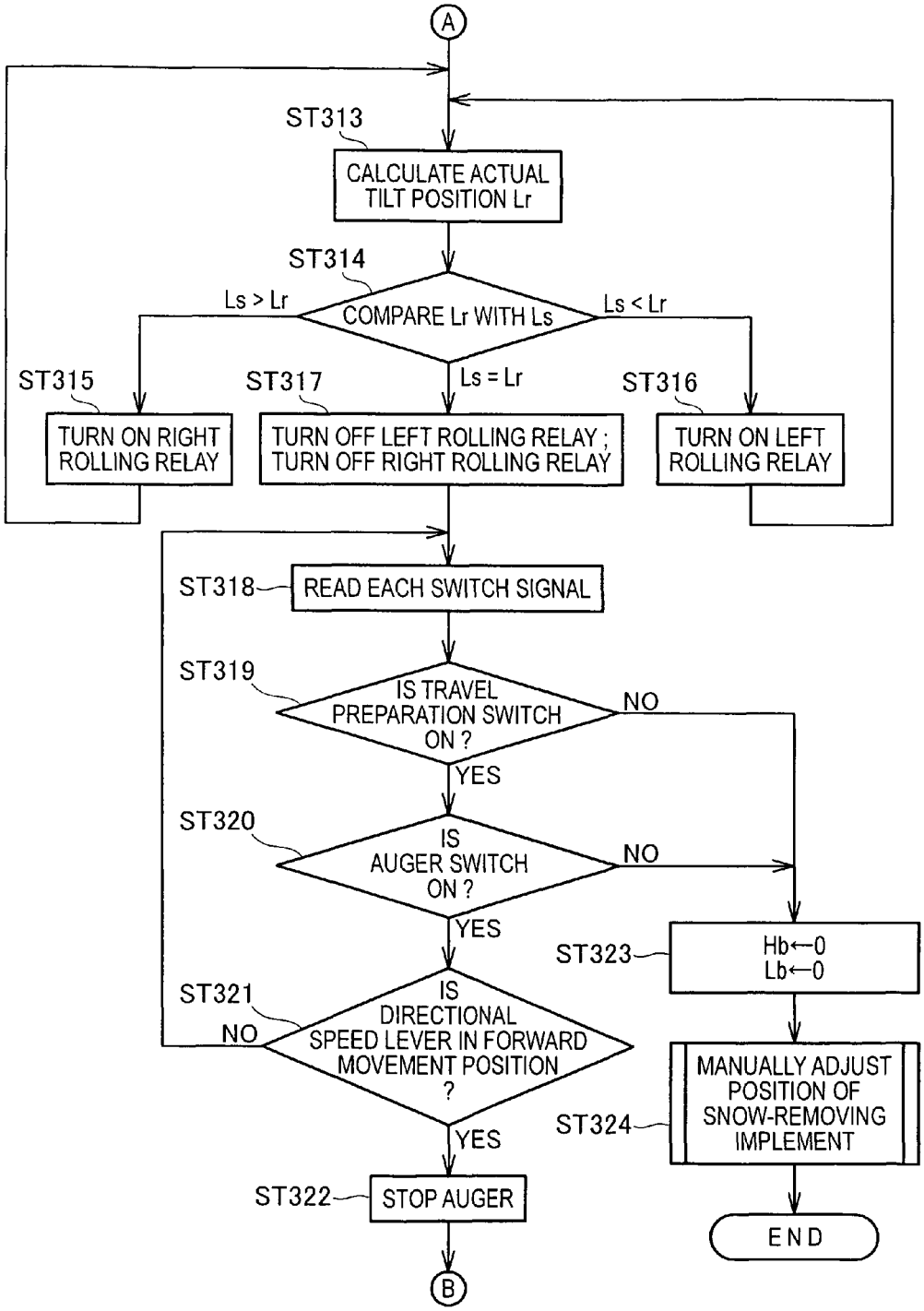
Figure 14C:
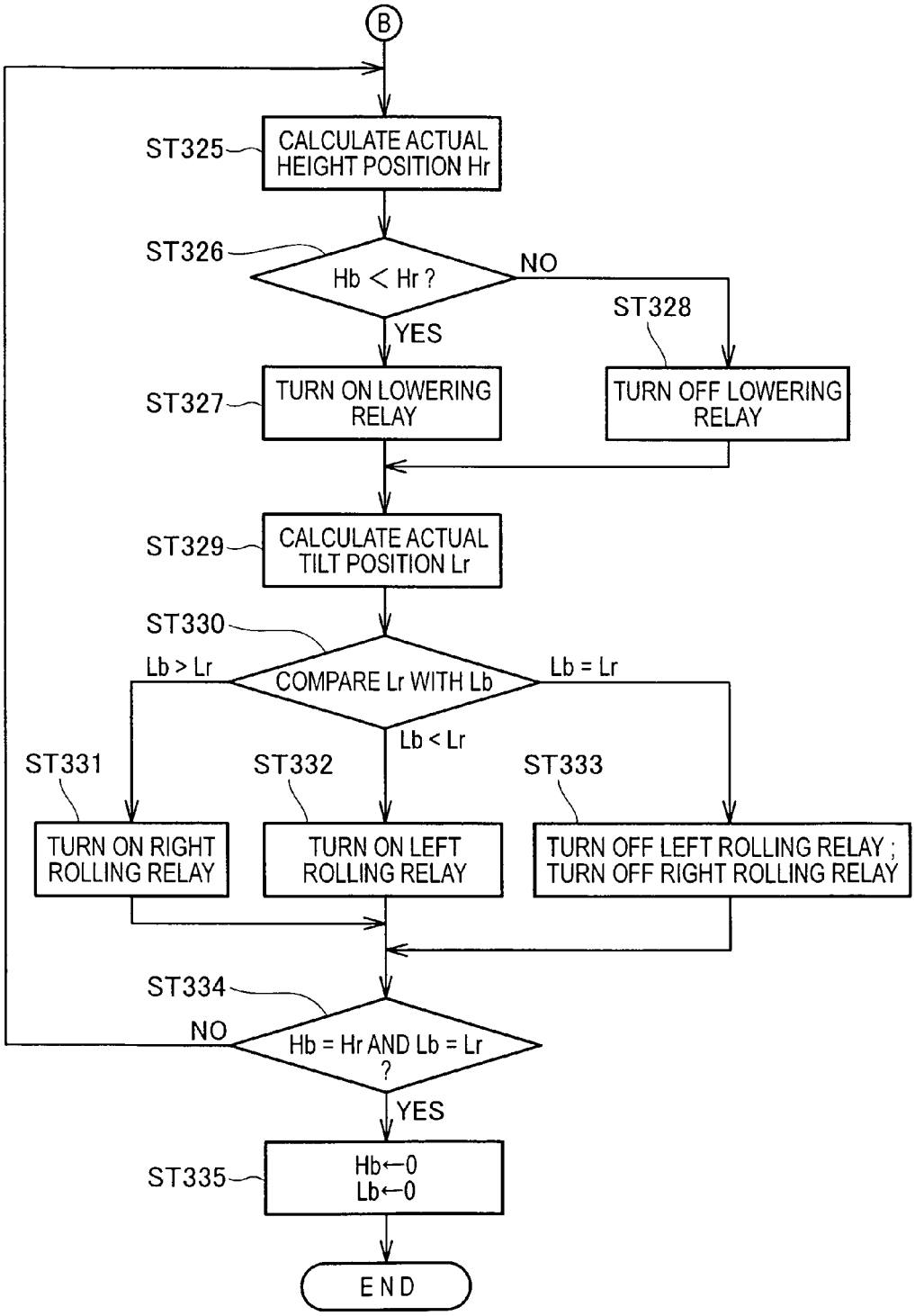

A second embodiment of the control routine will next be described based on FIGS. 14A through 14C with reference to FIGS. 3, 7, and 15A through 15D.

ST301: The last height position Hb and last tilt position Lb are set to the initial value "0" (last height position=0, last tilt position Lb=0) The values Hb=0 and Lb=0 are written into the memory 63. The term "last height position Hb" used herein refers to the height position of the implement 13 immediately before the implement 13 is raised when the snow remover 10 is traveling in reverse. The term "last tilt position Lb" used herein refers to the tilt position (rolling position) of the implement 13 immediately before the implement 13 is raised when the snow remover 10 is traveling in reverse.

ST302: The detection signals of the switches are read.

ST303: It is determined whether the snow remover 10 is performing snow removal (in other words, whether the snow-removing implement 13 is in operation). If YES, then the process proceeds to ST304. If NO, then the process returns to ST302.

In ST303, it is determined that snow removal is under way when any one condition is satisfied from among the following three conditions. The first condition is that the auger switch 45 is ON. The second condition is that the auger switch 45 is ON, and the electromagnetic clutch 31 is ON. The third condition is that the electromagnetic clutch 31 is ON. It may be determined in ST303 that snow removal is under way when two conditions are satisfied that include any one condition selected from the abovementioned first, second, and third conditions, as well as a fourth condition wherein the travel preparation switch 42*a* is ON (travel preparation lever 42 is being grasped).

ST304: It is determined whether the operating position of the directional speed lever 53 is the "reverse movement position." If YES, then the process proceeds to ST305. If NO, then it is determined that the directional speed lever 53 is in the middle position or the forward position, and the process returns to ST302.

Figure 15A:
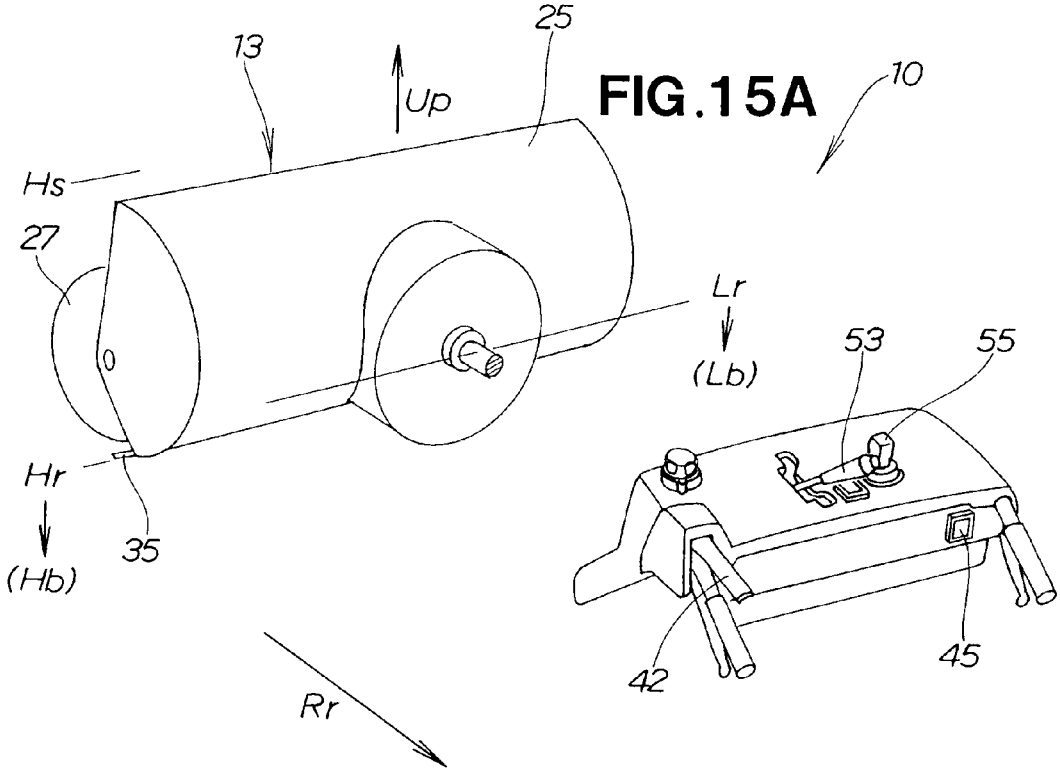
FIGS. 15A through 15D are views showing orientations of the snow-removing implement based on the control routine of the second embodiment shown in FIGS. 14A through 14C.

As shown in FIG. 15A, when the directional speed lever 53 is in the reverse position, the electric motors 21L, 21R are caused to rotate backwards so that the snow remover 10 travels in reverse as indicated by arrow Rr.

ST305: The electromagnetic clutch 31 is turned OFF. As a result, the auger 27 and the blower 28 are stopped.

ST306: The actual height position Hr of the implement 13 is calculated.

ST307: The actual tilt position Lr of the implement 13 is calculated.

ST308: The value of the last height position Hb is substituted with the value of the actual height position Hr calculated in ST306 and written into memory 63. The value of the last height position Hb substituted herein is assumed to be the "actual height position Hr immediately before the implement 13 is raised." The value of the last tilt position Lb is also substituted with the value of the actual tilt position Lr calculated in ST307 and written into memory 63. The value of the last tilt position Lb substituted herein is assumed to be the "actual tilt position Lr immediately before the implement 13 is raised."

ST309: It is determined whether the actual height position Hr has reached a predetermined reference upper-limit position Hs (Hr≧Hs). If NO, then the process proceeds to ST310. If YES, then the process proceeds to ST312. The reference upper-limit position Hs is set in advance to a height at which the lower end of the scraper 35 does not touch the snow surface when the snow remover 10 travels in reverse.

ST310: The elevating relay 96 is turned ON. As a result, the lift drive mechanism 16 raises the implement 13 as indicated by arrow Up in FIG. 15A.

ST311: After the actual height position Hr of the implement 13 is calculated, the process returns to ST309.

Figure 15B:
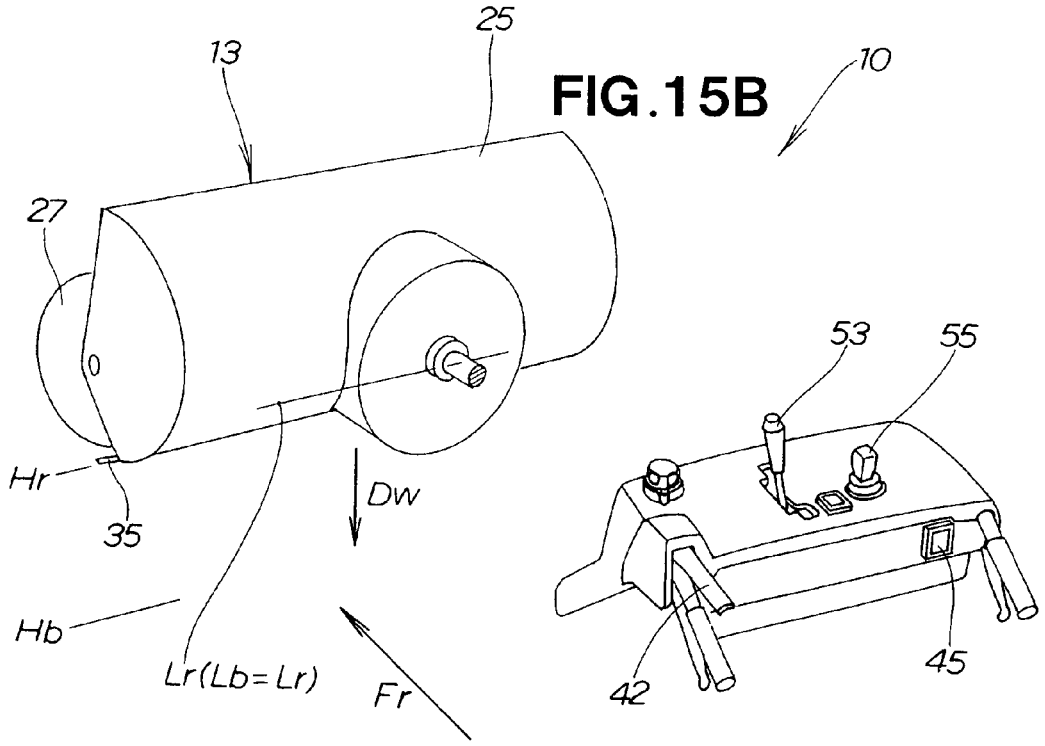

ST312: After the elevating relay 96 is turned OFF, the process proceeds to ST313 in FIG. 14B. As a result, the lift drive mechanism 16 stops lifting the implement 13, as shown in FIG. 15B.

ST313: The actual tilt position Lr of the implement 13 is calculated.

ST314: A predetermined reference horizontal position Ls and the actual tilt position Lr are compared with each other. The term "reference horizontal position Ls" refers to the rolling position of the implement 13 in which the lower end of the scraper 35 is in a horizontal alignment with respect to the flat surface fah shown in FIG. 7. In other words, the implement 13 in the reference horizontal position Ls is not tilted to the left or right.

When it is determined that the actual tilt position Lr is tilted downward and to the left in relation to the reference horizontal position Ls (Ls>Lr), i.e., the left end of the auger housing 25 is lowered, then the process proceeds to ST315.

When it is determined that the actual tilt position Lr is tilted downward and to the right in relation to the reference horizontal position Ls (Ls<Lr), i.e., the right end of the auger housing 25 is lowered, then the process proceeds to ST316.

When it is determined that the actual tilt position Lr matches the reference horizontal position Ls (Ls=Lr), i.e., the auger housing 25 is horizontal, then the process proceeds to ST317.

ST315: The right-rolling relay 98 is turned ON. As a result, the rolling drive mechanism 38 causes the implement 13 to roll to the right as indicated by arrow Ri in FIG. 15C.

ST316: The left rolling relay 97 is turned ON. As a result, the rolling drive mechanism 38 causes the implement 13 to roll to the left as indicated by arrow Le in FIG. 15D.

ST317: The left and right rolling relays 97, 98 are turned OFF. As a result, the lift drive mechanism 16 stops rolling the implement 13.

ST318: The detection signals of the switches are read.

ST319: It is determined whether the travel preparation switch 42*a* is ON. If YES, then the process proceeds to ST320. If NO, then the process proceeds to ST323. The travel preparation switch 42*a* is ON when the travel preparation lever 42 is being grasped in the hand of the operator.

ST320: It is determined whether the auger switch 45 is ON. If YES, then the process proceeds to ST321. If NO, then the process proceeds to ST323.

ST321: It is determined whether the operating position of the directional speed lever 53 is the "forward movement position." If YES, then the process proceeds to ST322. If NO, then it is determined that the directional speed lever 53 is in the middle position or the reverse position, and the process returns to ST318.

When the directional speed lever 53 is in the forward movement position, the control unit 61 performs control so that the electric motors 21L, 21R are rotated forward in order to cause the snow remover 10 to travel forward as indicated by arrow Fr in FIG. 15B.

ST322: After the electromagnetic clutch 31 is turned ON, the process proceeds to ST325 in FIG. 14C. As a result, operation of the auger 27 and blower 28 is restarted.

ST323: The last height position Hb and last tilt position Lb are reset to the value "0" (last height position=0, last tilt position Lb=0). The values Hb=0 and Lb=0 are written into the memory 63.

ST324: A transfer is made to manual operating mode. The operator can manually operate the aligning lever 55 shown in FIG. 15B to freely adjust the position of the implement 13. Control according to this control routine is ended by an end operation performed by the operator.

ST325: The actual height position Hr of the implement 13 is calculated.

ST326: It is determined whether the actual height position Hr with respect to the last height position Hb set in ST308 is high (Hb<Hr). If YES, then the process proceeds to ST327. If NO, then it is determined that the actual height position Hr has lowered to the last height position Hb (Hb=Hr), and the process proceeds to ST328. (p ST327: The lowering relay 95 is turned ON. As a result, the lift drive mechanism 16 lowers the implement 13 as indicated by arrow Dw in FIG. 15B.

ST328: The lowering relay 95 is turned OFF. As a result, the lift drive mechanism 16 stops lowering the implement 13.

ST329: The actual tilt position Lr of the implement 13 is calculated.

ST330: The last tilt position Lb set in ST308 and the actual tilt position Lr are compared with each other.

Figure 15C:
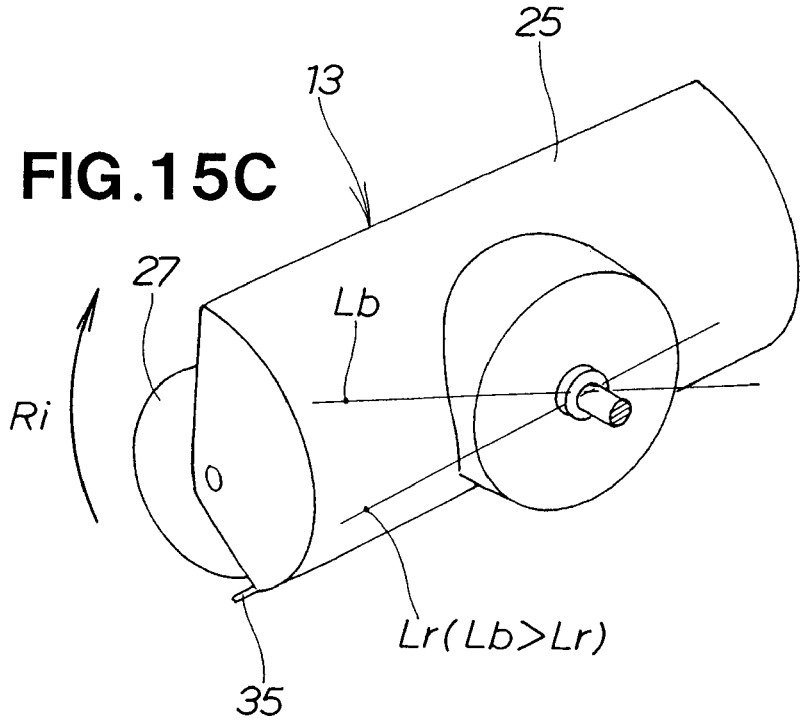

As shown in FIG. 15C, the process proceeds to ST331 when it is determined that the actual tilt position Lr is tilted downward and to the left with respect to the last tilt position Lb (Lb>Lr), i.e., when it is determined that the left end of the auger housing 25 is lowered.

Figure 15D:
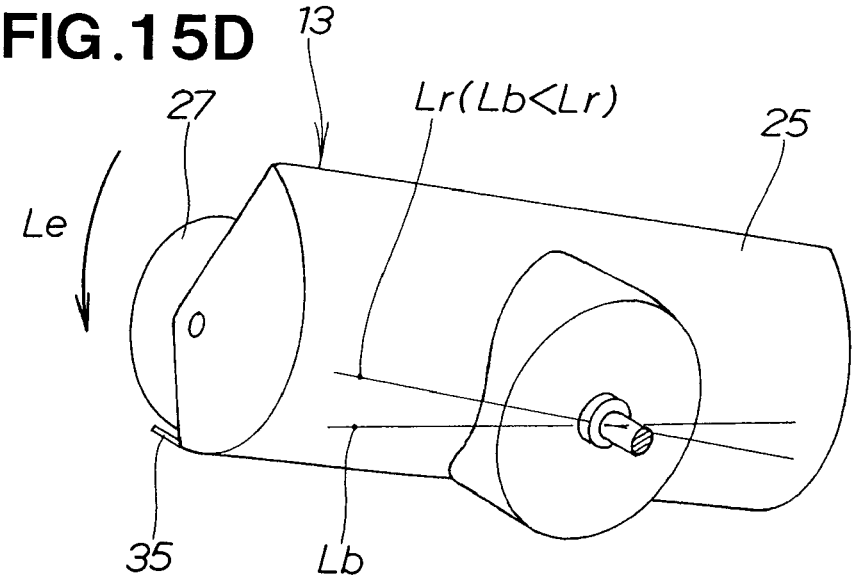

As shown in FIG. 15D, the process proceeds to ST332 when it is determined that the actual tilt position Lr is tilted downward and to the right with respect to the last tilt position Lb (Lb<Lr), i.e., when it is determined that the right end of the auger housing 25 is lowered.

As shown in FIG. 15B, the process proceeds to ST333 when it is determined that the actual tilt position Lr matches the last tilt position Lb (Lb=Lr), i.e., when it is determined that the auger housing 25 is horizontal.

ST331: The right-rolling relay 98 is turned ON. As a result, the rolling drive mechanism 38 causes the implement 13 to roll to the right as indicated by arrow Ri in FIG. 15C.

ST332: The left rolling relay 97 is turned ON. As a result, the rolling drive mechanism 38 causes the implement 13 to roll to the left as indicated by arrow Le in FIG. 15D.

ST333: The left and right rolling relays 97, 98 are turned OFF. As a result, the lift drive mechanism 16 stops the rolling of the implement 13.

ST334: It is determined whether conditions are satisfied wherein the actual height position Hr matches the last height position Hb (Hb=Hr), and the actual tilt position Lr matches the last tilt position Lb (Lb=Lr). If YES, then the process proceeds to ST335. If NO, then the process returns to ST325.

ST335: After the last height position Hb and last tilt position Lb are reset to the value "0" (last height position Hb=0 and last tilt position Lb=0), control by this control routine is ended. The values Hb=0 and Lb=0 are written into memory 63.

Steps ST325 through ST334 are thus repeated until the following conditions are satisfied: "Hb=Hr" and "Lb=Lr." The implement 13 can thereby be returned to the state (original alignment) of the last tilt position Lb in the last height position Hb.

An example was described in this embodiment in which the routine for lowering the implement 13 according to ST325 through ST328 and the routine for tilting the implement 13 according to ST329 through ST333 were executed separately. However, the routine of ST325 through ST328 and the routine of ST329 through ST333 may be configured as parallel routines that are executed simultaneously.

An example was described in the second embodiment in which the last tilt position Lb was a position in which the auger housing 25 (scraper 35) was horizontal, as previously mentioned. However, the last tilt position Lb is not limited to being a position in which the scraper 35 is horizontal.

For example, the scene where snow removal is performed includes tilted terrain, rolling terrain, and other terrain types. In this case, snow removal is performed while the implement 13 is tilted so as to conform to the terrain. The last tilt position Lb is therefore such that the scraper 35 is tilted to the left or right. According to the second embodiment, the implement 13 can be returned to a state of conformity with the terrain by resuming the last tilt position Lb. The implement 13 can therefore be returned to the snow removal position in accordance with various types of terrain.

Furthermore, the operator must be relatively experienced to manually adjust the tilt position of the implement 13. The adjustment for returning the implement 13 to the snow removal position therefore takes time. By automatically returning the implement 13 to the desired tilt position, the time required to return the implement 13 to the snow removal position is reduced, and the ability to remove snow can be even further enhanced.

The following is a summary of the control routine of the second embodiment described above.

The control unit 61 stores (ST308) in memory 63 the position (snow removal position) Hr, Lr of the implement 13 at the time at which two conditions are satisfied that include a condition (ST303) wherein "snow removal is under way" and a condition (ST304) wherein the directional speed lever 53 is in the "reverse travel position." In other words, the control unit 61 substitutes Hb for the value of Hr, substitutes the value of Lb for the value of Lr, and automatically raises the implement 13 (ST310).

After the implement 13 is raised, the control unit 61 automatically returns (ST325 through ST335) the implement 13 to the pre-stored original snow removal position Hb, Lb when three conditions are satisfied that include a condition (ST319) wherein the travel preparation switch 42*a* is ON, a condition (ST320) wherein the auger switch 45 is ON, and a condition (ST321) wherein the operating position of the directional speed lever 53 is the "forward movement position."

If the auger switch 45 is maintained in the ON state, and the travel preparation lever 42 is being grasped, then the implement 13 can thus be returned automatically and in a short time to the snow removal position Hb, Lb immediately prior to reverse travel merely by switching the directional speed lever 53 from the "reverse movement position" to the "forward movement position." It is therefore possible to eliminate the inconvenience of manually returning the implement 13 to the last snow removal position Hb, Lb prior to reverse movement when forward travel is resumed. The length of time that snow removal is interrupted can also be minimized.

On the other hand, after the implement 13 is raised, the control unit 61 switches to the manual operation mode (ST323 through ST324) without returning the implement 13 to the original snow removal position Hb, Lb even when the operating position of the directional speed lever 53 is switched to the "forward movement position" when at least one switch selected from the travel preparation switch 42*a* and the auger switch 45 is OFF (ST319 through ST320). In this case, the operator can manually operate the aligning lever 55 to adjust the implement 13 to an arbitrary height.

When two conditions are satisfied that include a condition (ST303) wherein "snow removal is under way" and a condition (ST304) wherein the operating position of the directional speed lever 53 is the "reverse movement position," i.e., when reverse travel of the snow remover 10 is initiated, the control unit 61 performs control (ST313 through ST317) not only for raising the implement 13, but also for making the implement 13 horizontal. In other words, the control unit 61 controls (ST313 through ST317) the rolling drive mechanism 38 so that the actual tilt position Lr matches the reference horizontal position Ls (Ls=Lr). Accordingly, the implement 13 can be placed in a horizontal state when the implement 13 is raised to the reference upper-limit position Hs. As a result, the lower end of the scraper 35 can be even more reliably set to a height where the lower end does not touch the snow surface when the snow remover 10 travels in reverse.

When the two conditions are satisfied that include a condition (ST303) wherein "snow removal is under way" and a condition (ST304) wherein the operating position of the directional speed lever 53 is the "reverse movement position," i.e., when reverse travel of the snow remover 10 is initiated, the control unit 61 turns OFF the electromagnetic clutch 31 (ST305). As a result, the auger 27 and the blower 28 can be stopped.

After the implement 13 is raised, the control unit 61 turns ON the electromagnetic clutch 31 (ST322) when three conditions are satisfied that include a condition (ST319) wherein the travel preparation switch 42*a* is ON, a condition (ST320) wherein the auger switch 45 is ON, and a condition (ST321) wherein the operating position of the directional speed lever 53 is the "forward movement position," i.e., when the snow remover 10 is switched to forward travel. As a result, the operation of the auger 27 and the blower 28 can be restarted.

The load placed on the engine 14 during reverse travel can thereby be alleviated, and fuel consumption can be reduced.

The detailed structure of the travel frame 12 and vehicle frame 15 in the machine body 19 will next be described. FIGS. 17 through 21B are views from the opposite side relative to FIGS. 1 and 16.

Figure 16:
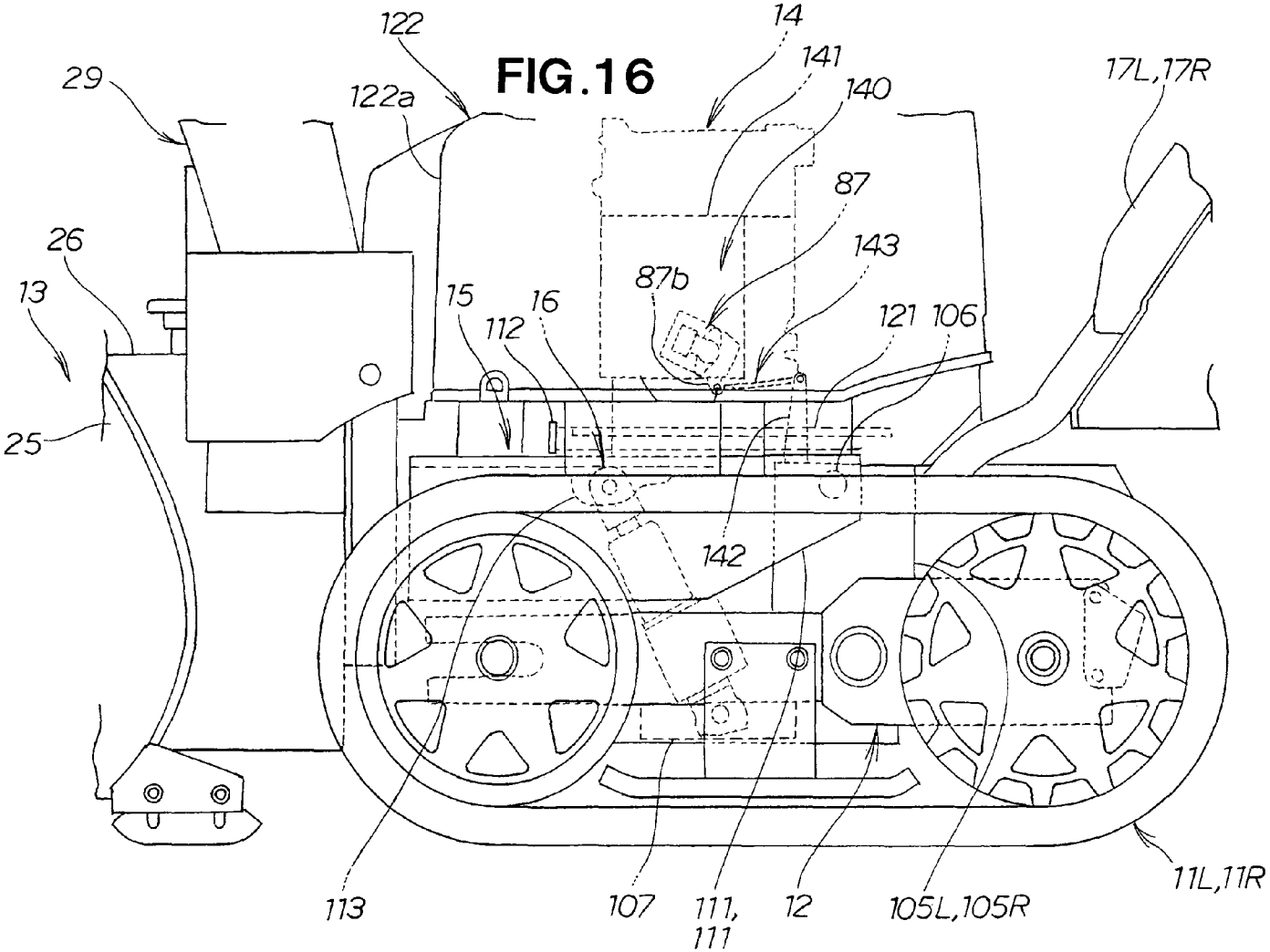
FIG. 16 is a side view of the machine body, the lift drive mechanism, the travel units, the engine, and the area around the engine cover shown in FIG. 2.
Figure 17:
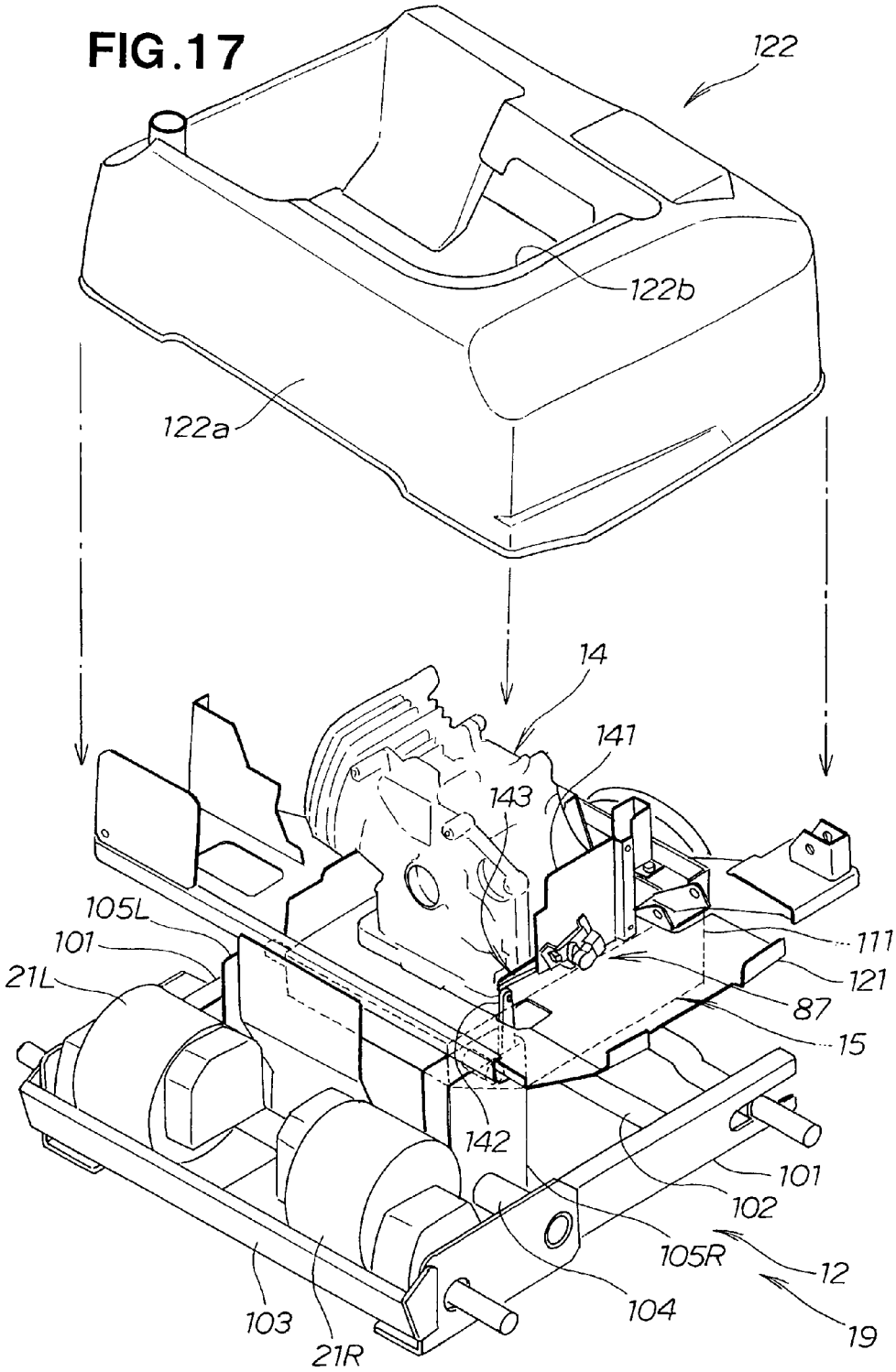
FIG. 17 is an exploded perspective view of the machine body, the engine, the engine cover, the bottom cover, and the area around the height position sensor shown in FIG. 16.

As shown in FIGS. 16 and 17, the travel frame 12 is composed of a pair of left and right side members 101, 101 extending forward and backward, a front cross member 102 spanning the length between the left and right side members 101, 101 at the front of the members, a rear cross member 103 spanning the length between the left and right side members 101, 101 at the back of the members, and a middle cross member 104 spanning the length between the left and right side members 101, 101 at the middle of the members.

The middle cross member 104 is provided with a pair of left and right side brackets 105L, 105R that extend upward. The pair of left and right side brackets 105L, 105R are substantially U-shaped braces (see FIG. 18) open at the rear when viewed from above, and have a support shaft 106 at the upper end. The support shaft 106 connects the rear end of the travel frame 12 so as to enable the rear end to swing vertically.

The vehicle frame 15 is also referred to as a main frame, a swing frame, or a main chassis, and is composed of a pair of left and right side frames 111 extending to the front and rear, and a plate-shaped motor mounting platform 112 spanning the length between the rear half of the left and right side frames 111. The motor mounting platform 112 is a platform for mounting the engine 14. The engine 14 is thus mounted at the rear of the vehicle frame 15.

One end of the lift drive mechanism 16 is connected to a support 107 of the travel frame 12, and the other end is connected to a support 113 of the vehicle frame 15.

The engine 14 is also protected from the outside by being mostly covered by a bottom cover 121 and an engine cover 122 (top cover 122). The bottom cover 121 and engine cover 122 are made of a resin or a metal.

The bottom cover 121 is a plate-shaped cover attached to the vehicle frame 15. Furthermore, the bottom cover 121 has a generally square shape as viewed from above, is larger than the motor mounting platform 112, and also functions as the bottom panel of the engine cover 122. For example, the bottom cover 121 is wide enough to partially or completely cover the left and right travel units 11L, 11R.

The engine cover 122 is a cover placed over the top of the engine 14 and attached so as to be superposed over the bottom cover 121. This engine cover 122 is also generally square shaped as viewed from above. The size of the engine cover 122 is about the same as that of the bottom cover 121 when viewed from above. However, the front end portion 122*a* of the engine cover 122 extends to the vicinity of the front end of the vehicle frame 15. The upper half of the electromagnetic clutch 31 and transmission mechanism 32 shown in FIG. 2 can therefore also be covered by the engine cover 122. The ceiling portion of the engine cover 122 has an opening 122*b* in the center. This opening 122*b* is a hole that is disposed above the engine 14 and exposes the fuel tank 131, the air cleaner 132, and the muffler 133 shown in FIG. 1 at the top of the engine 14.

Figure 18:
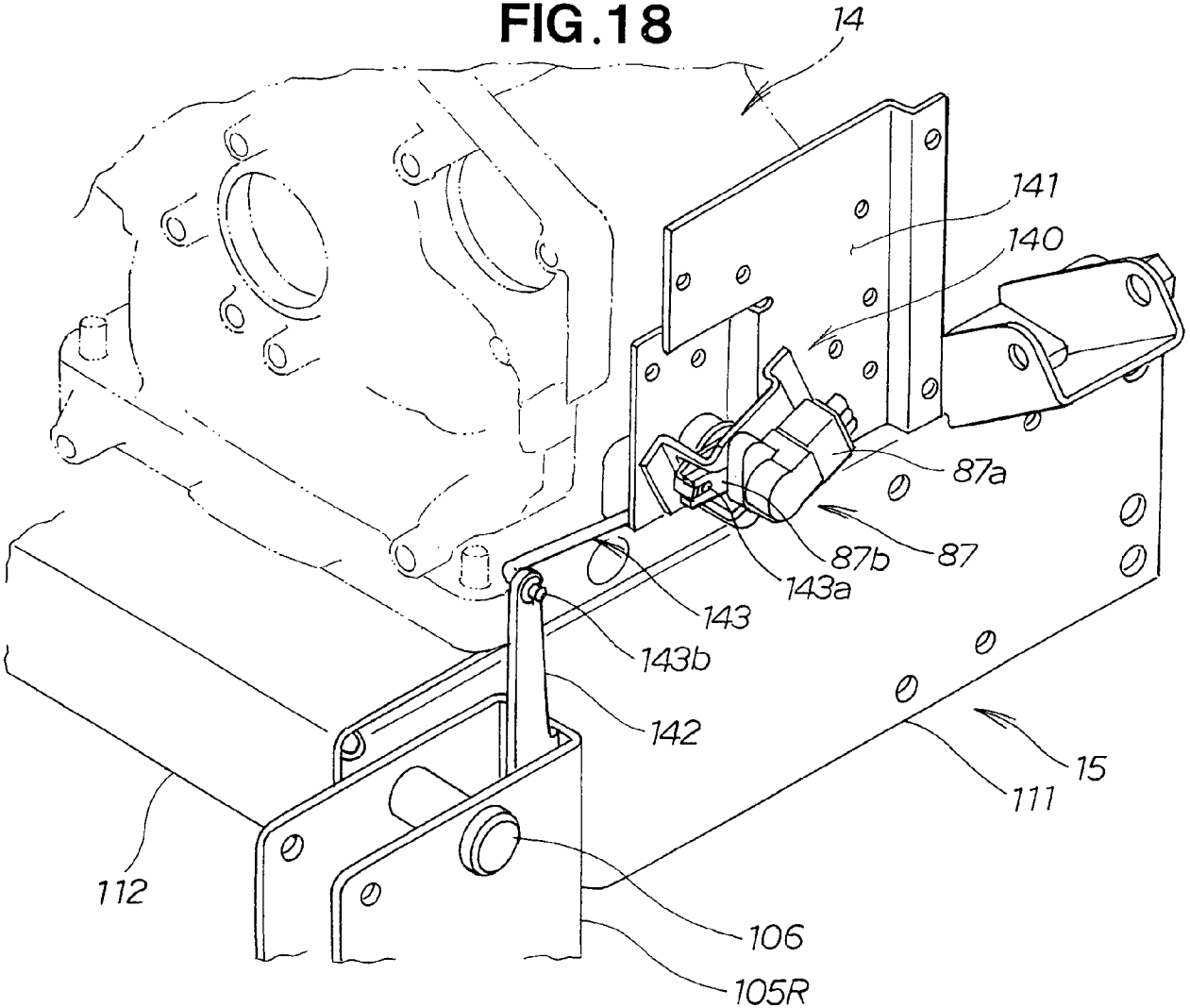
FIG. 18 is a perspective view of the machine body, the engine, and the area around the height position sensor shown in FIG. 17.

As described above, the height position sensor 87 is a potentiometer (wound variable resistor or the like). As shown in FIG. 18, the height position sensor 87 is composed of a detector body portion 87*a* and an actuating arm 87*b*. The detector body portion 87*a* houses a resistor element and a sliding contact that slides along the resistor element. The actuating arm 87*b* is a bar that swings vertically in relation to the detector body portion 87*a* in order to operate the sliding contact inside the detector body portion 87*a*.

As shown in FIGS. 16 and 18, the height position sensor 87 is disposed near the engine 14 and also higher than the left and right travel units 11L, 11R and further forward than the left and right side brackets 105L, 105R. For example, the height position sensor 87 is adjacent to the crankcase of the engine 14. The height position sensor 87 thus disposed is attached to the vehicle frame 15. More specifically, the detector body portion 87*a* is attached to a bracket 141 extending upward from the upper end of the vehicle frame 15.

The height position sensor 87 may also be attached directly to the engine 14. In this case, the height position sensor 87 is attached to the vehicle frame 15 via the engine 14.

The actuating arm 87*b* is connected to the travel frame 12. The following is a more specific description. The travel frame 12 is provided with a fixing arm 142 extending upward from the upper end of the right side bracket 105R. The actuating arm 87*b* extends generally downward from the detector body portion 87*a*. The distal end of the actuating arm 87*b* is connected to the upper end of the fixing arm 142 via a connecting rod 143 so as to be able to swing.

Figure 19:
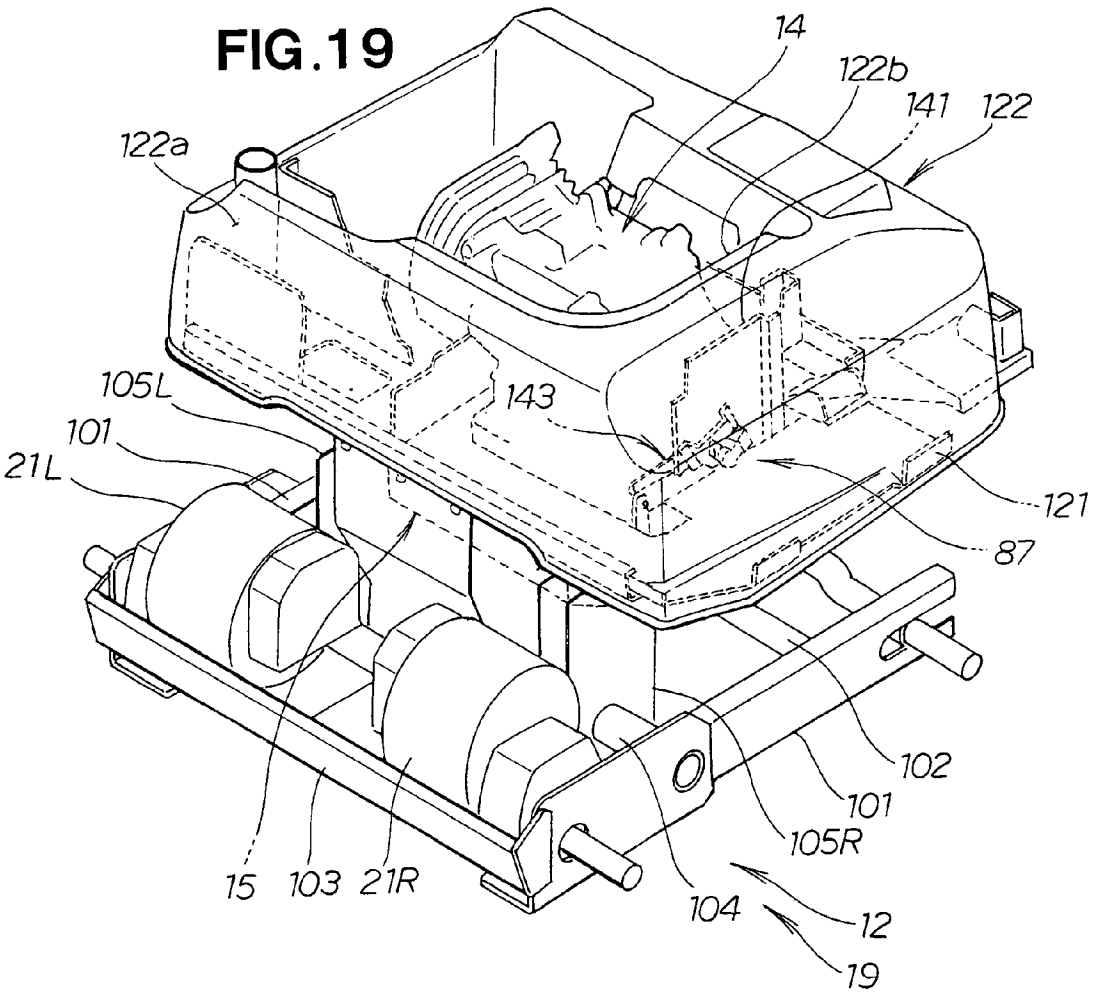
FIG. 19 is a perspective view showing the assembled state of the machine body, the engine, the engine cover, the bottom cover, and the area around the height position sensor shown in FIG. 17.

As shown in FIGS. 17 through 19, the connecting rod 143 is a round rod that is bent over at both ends. One end 143*a* of the connecting rod 143 is swingably hooked to the distal end of the actuating arm 87*b*. The other end 143*b* of the connecting rod 143 is swingably hooked to the upper end of the fixing arm 142.

Since the engine 14 is covered by the bottom cover 121 and engine cover 122, the height position sensor 87 disposed near the engine 14 is also covered.

As shown in FIG. 16, the structure formed by the assembly of the lift drive mechanism 16, the height position sensor 87, the connecting rod 143, and the control unit 61 (see FIG. 3) constitutes a snow removal unit height control device 140. The snow removal unit height control device 140 controls the height of the implement 13.

The action of the machine body 19 that accompanies operation of the lift drive mechanism 16 will next be described.

Figure 20A:
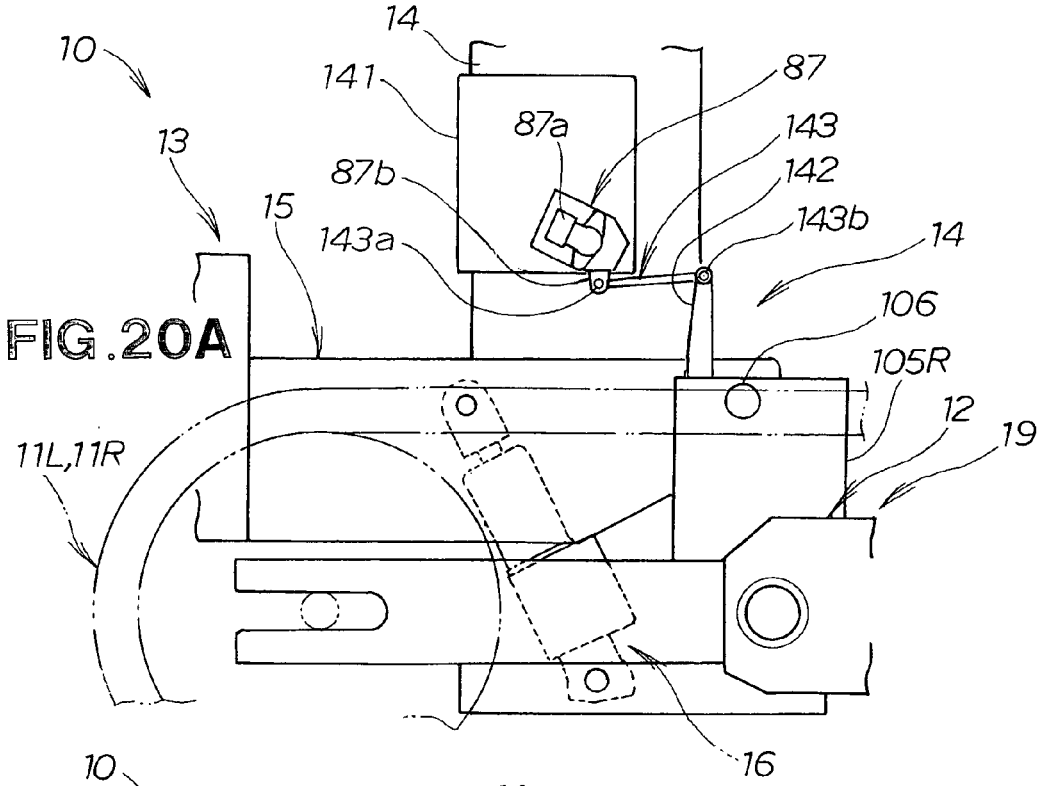
FIGS. 20A through 20D are views showing the operation of the lift drive mechanism, the machine body, and the height position sensor shown in FIG. 16.
Figure 20B:
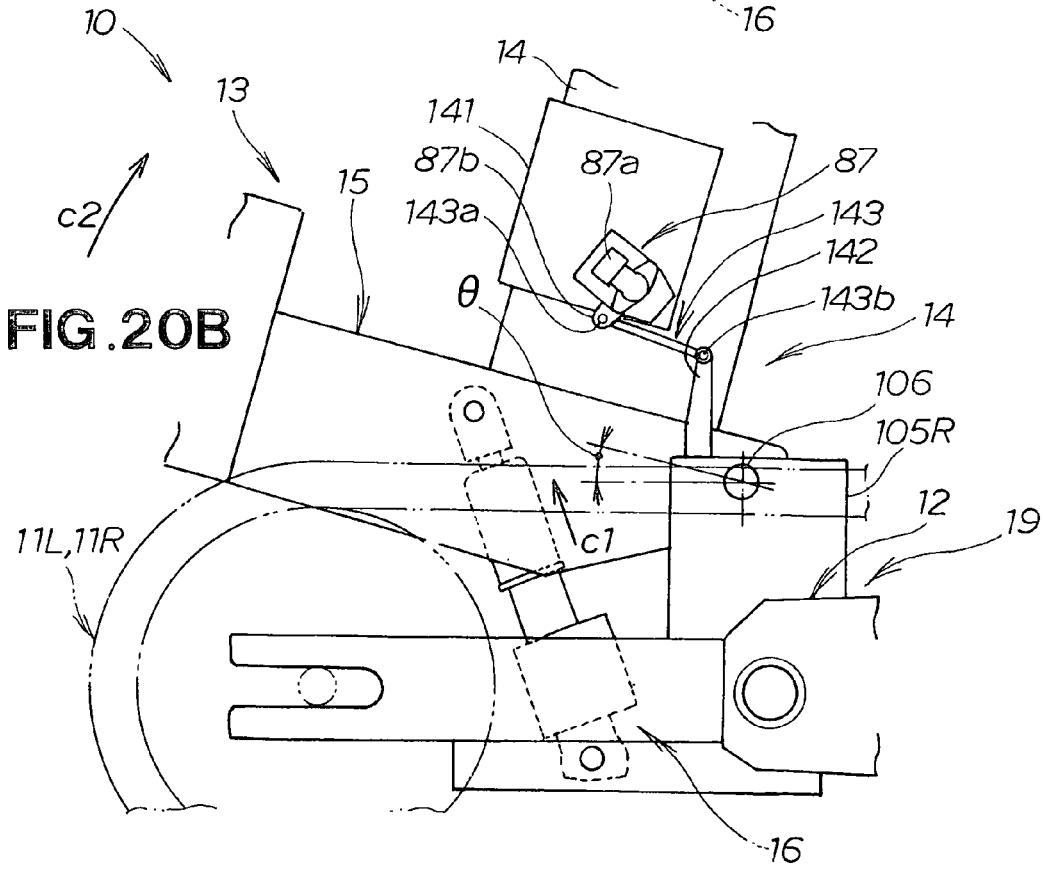
Figure 20C:
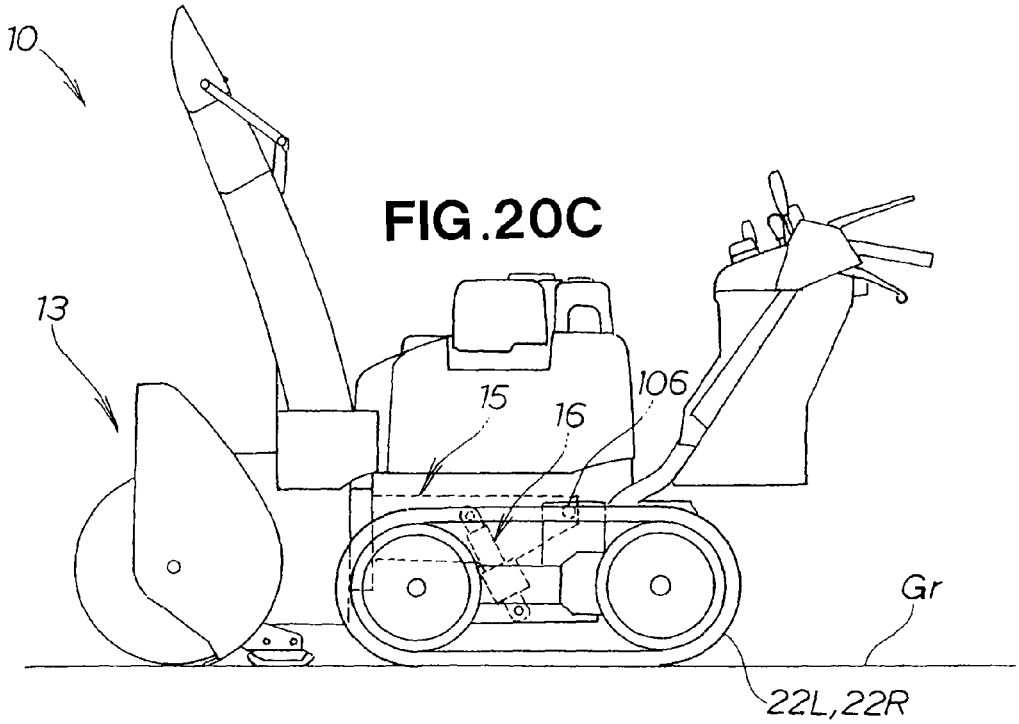

In FIGS. 20A and 20C, since the lift drive mechanism 16 is in its fully contracted state, the vehicle frame 15 is in its lowest position in relation to the travel frame 12. As a result, the implement 13 is also in its lowest position.

Figure 20D:
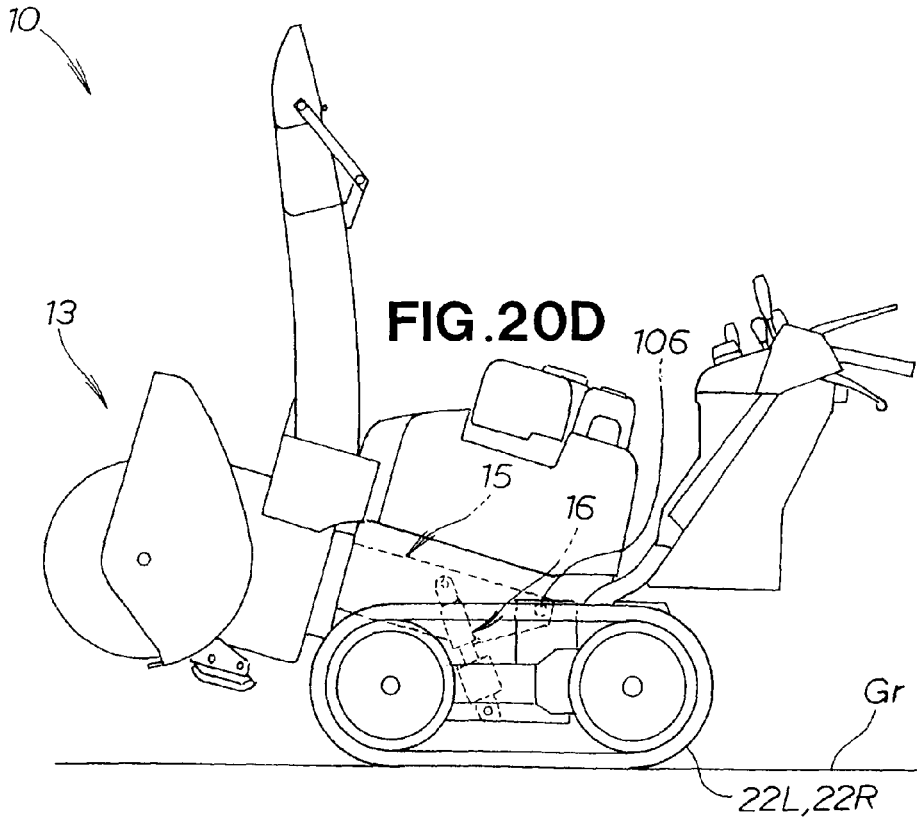

When the lift drive mechanism 16 then extends in the direction of arrow c1 as shown in FIG. 20B, the vehicle frame 15 swings upward as indicated by arrow c2. When the lift drive mechanism 16 is in its fully extended state, the vehicle frame 15 is in its highest position in relation to the travel frame 12, as shown in FIGS. 20B and 20D.

The vehicle frame 15 thus swings vertically in relation to the travel frame 12 according to the telescopic action of the lift drive mechanism 16. The implement 13, the engine 14, and the height position sensor 87 also swing vertically together with the vehicle frame 15.

The height position sensor 87 operates in the following manner at this time. As shown in FIGS. 20A and 20B, the detector body portion 87*a* is attached to the vehicle frame 15, and therefore swings vertically about the support shaft 106. Since the actuating arm 87*b* is connected to the fixing arm 142 via the connecting rod 143, the swinging range of the actuating arm is limited. In other words, the actuating arm 87*b* is able to swing in a range in which the connecting rod 143 can swing vertically about the upper end of the fixing arm 142. Therefore, a relative difference (displacement difference) in the amount of swing occurs between the detector body portion 87*a* and the actuating arm 87*b*. The height position sensor 87 can detect the swing angle θ with respect to the travel frame 12, i.e., the actual height position Hr of the implement 13 shown in FIG. 7, by detecting the displacement difference.

Protection of the height position sensor 87 from snow will next be described.

Figure 21A:
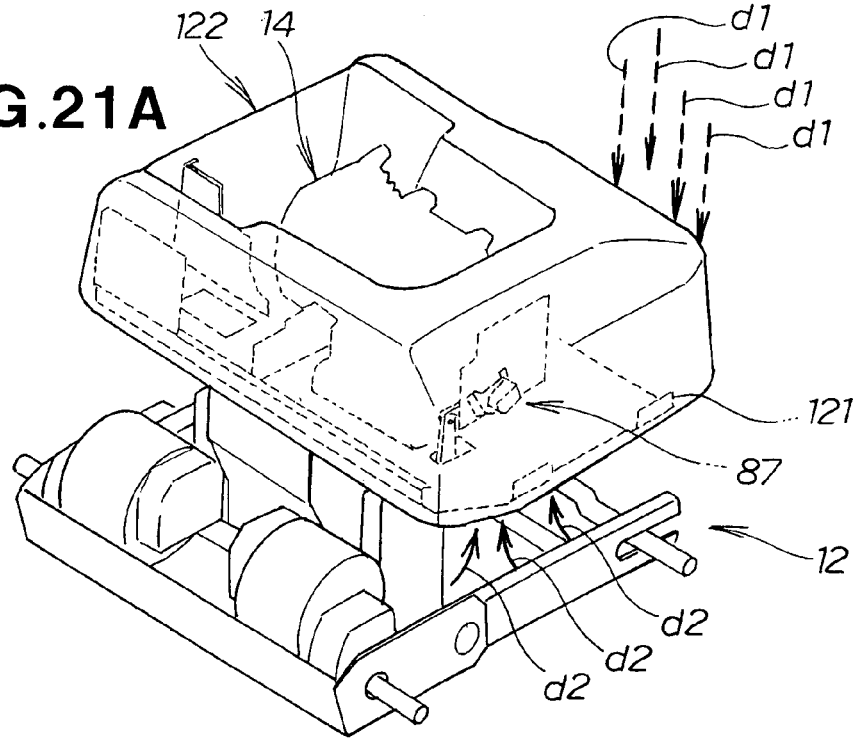
FIGS. 21A and 21B are views showing a function whereby the height position sensor shown in FIG. 19 is protected from snow.

As shown in FIG. 21A, the engine cover 122 not only covers the engine 14, but also covers the top of the height position sensor 87. The height position sensor 87 is not exposed to snow that falls as indicated by arrow d1. It is difficult for falling snow to adhere to the height position sensor 87.

As shown in FIG. 16, the height position sensor 87 is disposed at a higher elevation than the left and right travel units 11L, 11R. The bottom cover 121 also covers the bottom of the height position sensor 87 so that snow carried up in the direction of arrow d2 by the travel unit 11R during travel does not directly contact the height position sensor 87. The height position sensor 87 is not directly exposed to upswept snow. It is difficult for upswept snow to adhere to the height position sensor 87.

The bottom cover 121 and the engine cover 122 can thus provide protection so that snow does not adhere to or freeze onto the height position sensor 87. In other words, the height position sensor 87 can be protected from snow. Accordingly, maintenance of the height position sensor 87 can be reduced during snow removal, and the operating properties of the snow remover 10 (see FIG. 16) can therefore be enhanced.

The height position sensor 87 can also be protected by the bottom cover 121 and engine cover 122 for covering the engine 14. There is therefore no need to provide a separate specialized cover for covering the height position sensor 87. The cost of the snow remover 10 can therefore be reduced.

Figure 21B:
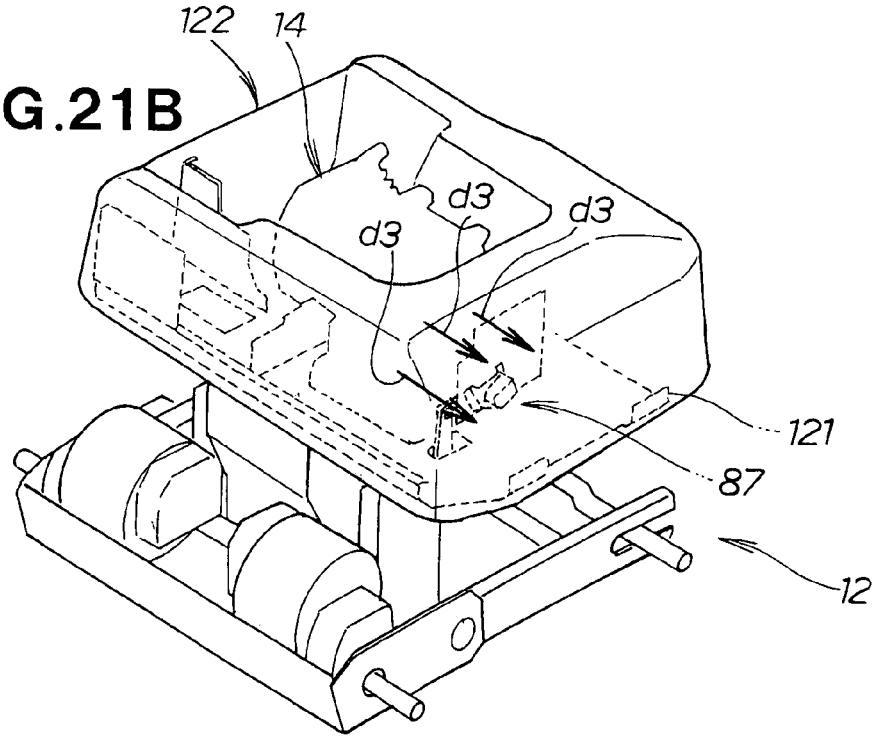

As shown in FIG. 21B, the height position sensor 87 is disposed in a position near the engine 14. Heat generated by the engine 14 during operation is circulated to the height position sensor 87 as indicated by arrow d3. As a result, the height position sensor 87 can be kept warm by the heat generated by the engine 14 during snow removal. The height position sensor 87 can be prevented from freezing during operation. Accordingly, since maintenance of the height position sensor 87 can be reduced during snow removal, the snow remover 10 (see FIG. 16) can be made easier to operate.

As shown in FIG. 20A, the snow remover 10 is also configured so that the actuating arm 87*b* of the height position sensor 87 is swingably connected via the connecting rod 143 to the fixing arm 142 extending upward from the travel frame 12. Accordingly, the height position sensor 87 can be disposed in a higher position than the travel unit 11R. The effects of snow swept up by the travel unit 11R during travel can therefore be minimized.

The relationship between the snow-removing implement 13, the vehicle frame 15, the rolling drive mechanism 38, and the rolling position sensor 88 will next be described in detail.

Figure 22:
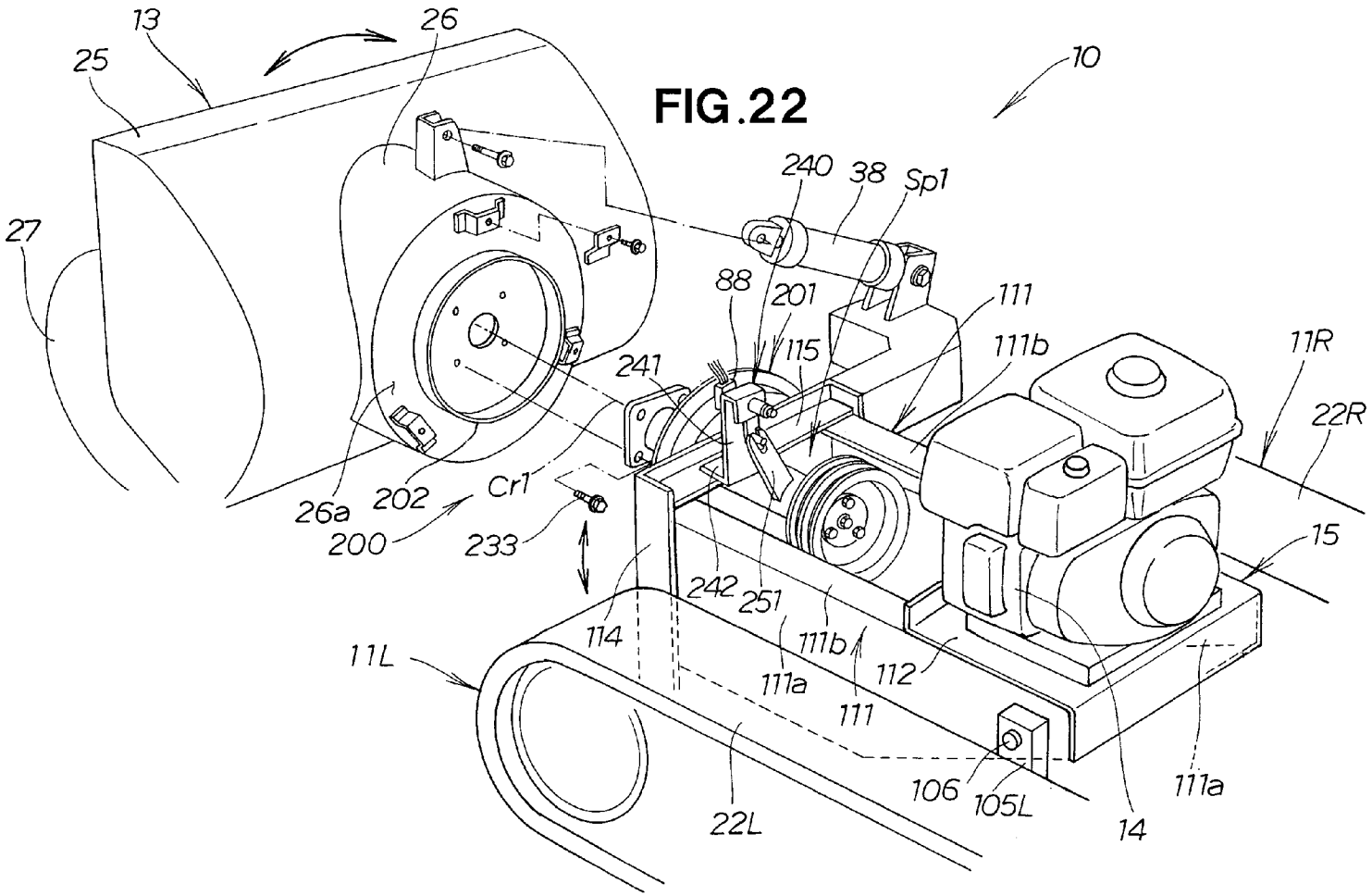
FIG. 22 is an exploded perspective view of the snow remover shown in FIG. 2.

As shown in FIG. 22, the vehicle frame 15 is disposed between the left and right travel units 11L, 11R as viewed from above. Since the front support member 114 spans the length between the front ends of the pair of left and right side frames 111, the vehicle frame 15 as a whole forms a rectangular frame elongated towards the front and rear as viewed from above. The front support member 114 has a plate-shaped cross plate 115 on the upper surface thereof spanning the length between the left and right side frames 111.

The side walls 111*a*, 111*a* of the left and right side frames 111 are plate-shaped and extend further upward than the upper ends of the left and right crawler belts 22L, 22R. Therefore, the upper surfaces 111*b*, 111*b* of the left and right side frames 111, 111 are higher than the left and right travel units 11L, 11R. The space between the internal space Sp1 inside the vehicle frame 15 and the left and right travel units 11L, 11R can be partitioned by the side walls 111*a*, 111*a*. Snow swept up by the left and right travel units 11L, 11R can be prevented from penetrating into the internal space Sp1 by the side walls 111*a*, 111*a*.

Figure 23:
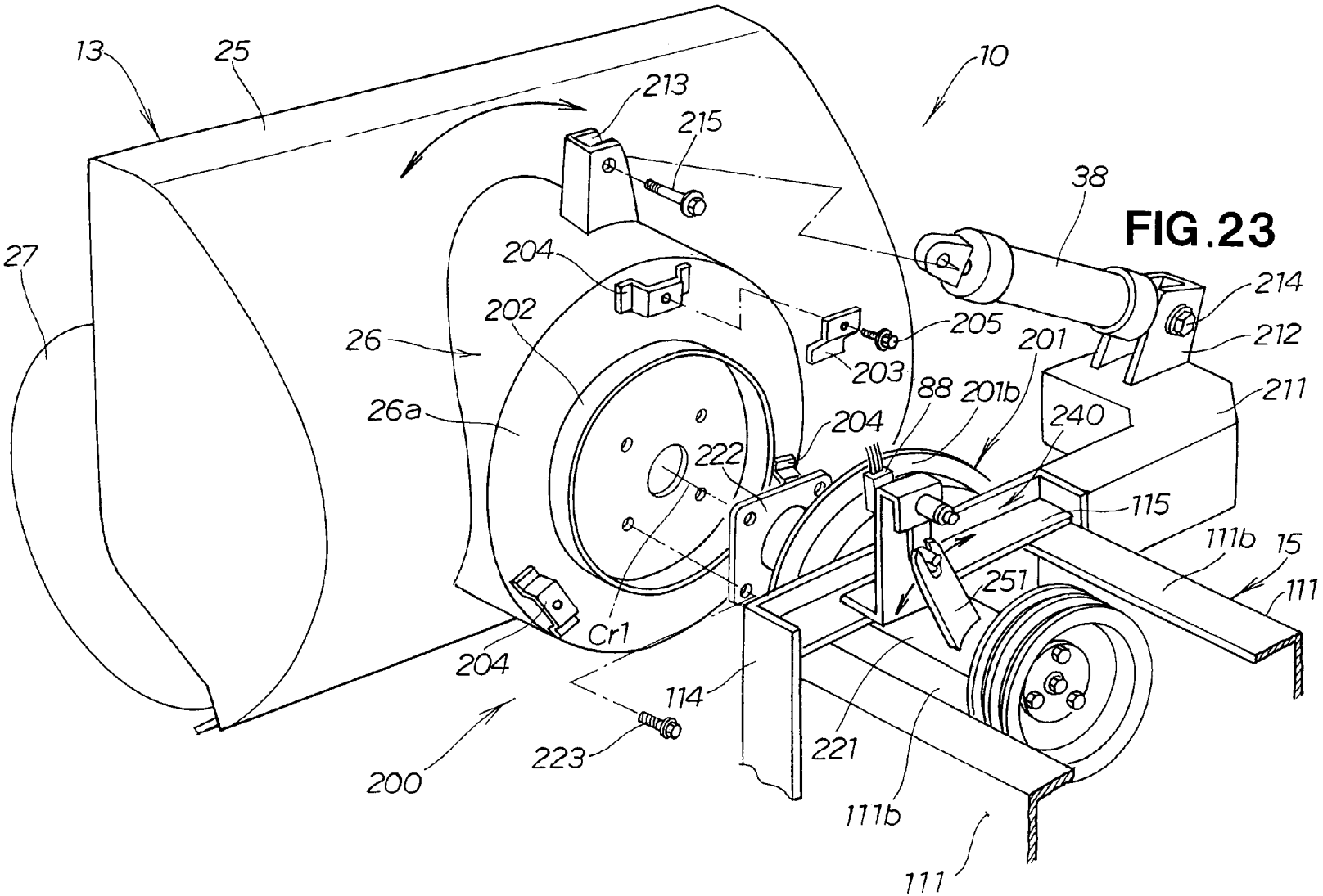
FIG. 23 is an exploded perspective view of the machine body, the snow-removing implement, the rolling support device, and the area around the rolling position sensor shown in FIG. 22.
Figure 24:
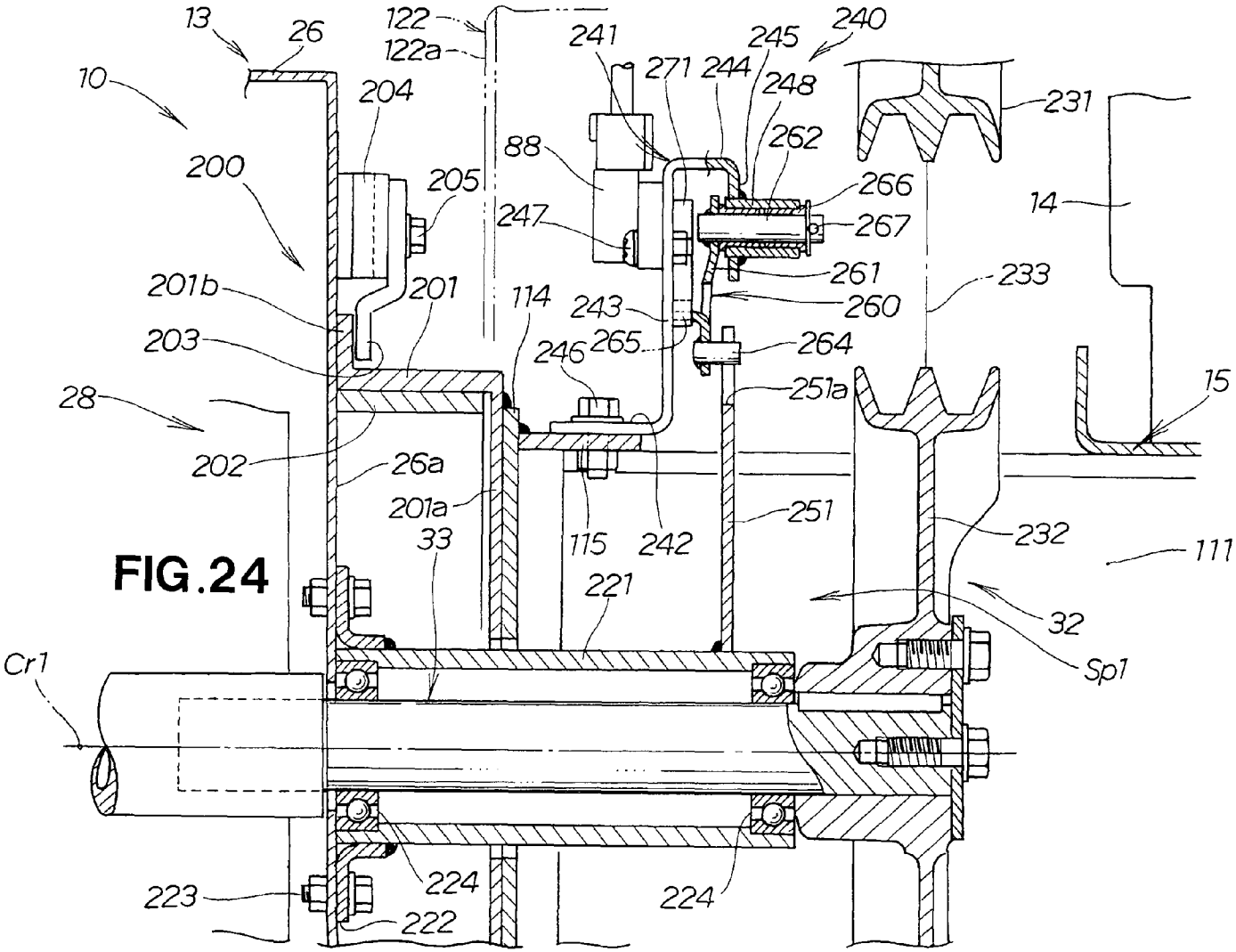
FIG. 24 is a sectional view of the machine body, the snow-removing implement, and the area around the rolling position detection device shown in FIG. 23, wherein the detector is viewed from the side.

As shown in FIGS. 23 and 24, the implement 13 can roll about the axis line Cr1 with respect to the vehicle frame 15. This arrangement will be described in detail hereinafter.

A rolling support device 200 (rotation support device 200) is provided to the front of the vehicle frame 15, i.e., to the front support member 114. The rolling support device 200 supports the implement 13 on the vehicle frame 15 so as to enable rolling.

The rolling support device 200 is composed of a rolling support member 201, a rolled support member 202, and a plurality of locking tabs 203. The rolling support member 201 (rotation support member 201) is a bottomed cylinder that is centered on the axis line Cr1 and extends towards the back surface wall 26*a* of the blower case 26 from the front support member 114. The base panel 201*a* of the rolling support member 201 is attached to the front end of the front support member 114. Among the rolling support members 201, a flange 201*b* is provided on the external peripheral surface of the disengaged end that faces the back surface wall 26*a*.

The supported member 202 is a cylinder that is centered on the axis line Cr1 and extends towards the vehicle frame 15 from the back surface wall 26*a*. The supported member 202 is rotatably fitted inside the rolling support member 201, and the flange 201*b* is stacked together with the back surface wall 26*a*. The supported member 202 can therefore be rotatably supported by the rolling support member 201.

The back surface wall 26*a* is provided with a plurality of concentric brackets 204 centered on the axis line Cr1. A locking tab 203 is superposed on each of the plurality of brackets 204 and can be attached by a bolt 205. The flange 201*b* can therefore be rotatably held by the back surface wall 26*a* and locking tabs 203 by superposing the locking tabs 203 on the flange 201*b* superposed on the back surface wall 26*a* and fastening the locking tabs 203 to the brackets 204.

The vehicle frame 15 can thus support the blower case 26 and auger housing 25 so as to enable rotation thereof about the axis line Cr1.

As shown in FIG. 24, the front support member 114 is provided with an extension frame 211 (base 211) extending from the right upper end to the right side. The extension frame 211 is provided with a base bracket 212. A bracket 213 is provided to the upper end of the blower case 26. One end of the rolling drive mechanism 38 is connected by a bolt 214 to the base bracket 212 so as to be able to swing vertically, and the other end is connected by a bolt 215 to the bracket 213 so as to be able to swing vertically. The blower case 26 is rolled in relation to the vehicle frame 15 about the axis line Cr1 by the telescopic motion of the rolling drive mechanism 38. As a result, the implement 13 rolls.

As shown in FIGS. 23 and 24, the back surface wall 26*a* is provided with a support tube 221 extending towards the vehicle frame 15. Specifically, the support tube 221 is a pipe that is centered on the axis line Cr1 and has a flange 222 (mounting bracket 222) at the proximal end. The flange 222 is attached to the back surface wall 26*a* by a plurality of bolts 223. The support tube 221 can therefore rotate in conjunction with the rolling of the blower case 26.

As shown in FIG. 24, the support tube 221 rotatably supports the auger transmission shaft 33 via two bearings 224, 224 in the interior. The transmission mechanism 32 for transmitting the motive force of the engine to the auger transmission shaft 33 is composed of a drive pulley 231, a driven pulley 232, and a belt 233. The drive pulley 231 is attached to the electromagnetic clutch 31 (see FIG. 2). The driven pulley 232 is attached to the auger transmission shaft 33.

The rolling position detector 240 (tilt detection means 240) that uses the rolling position sensor 88 will next be described based on FIGS. 23 through 25.

As described above, the rolling position sensor 88 is a potentiometer (wound variable resistor or the like). As shown in FIG. 25, the rolling position sensor 88 is composed of a detector body portion 88*a* and an operating shaft 88*b*. The detector body portion 88*a* houses a resistor element and a sliding contact that slides along the resistor element. The operating shaft 88*b* rotates in relation to the detector body portion 88*a* in order to operate the sliding contact inside the detector body portion 88*a*, and is a shaft parallel to the axis line Cr1. The operating shaft 88*b* has an insertion hole 88*c* at the end The insertion hole 88*c* is disposed on the axis line Cr2 (see FIG. 25) of the operating shaft 88*b* and faces the side of the vehicle frame 15.

Figure 25:
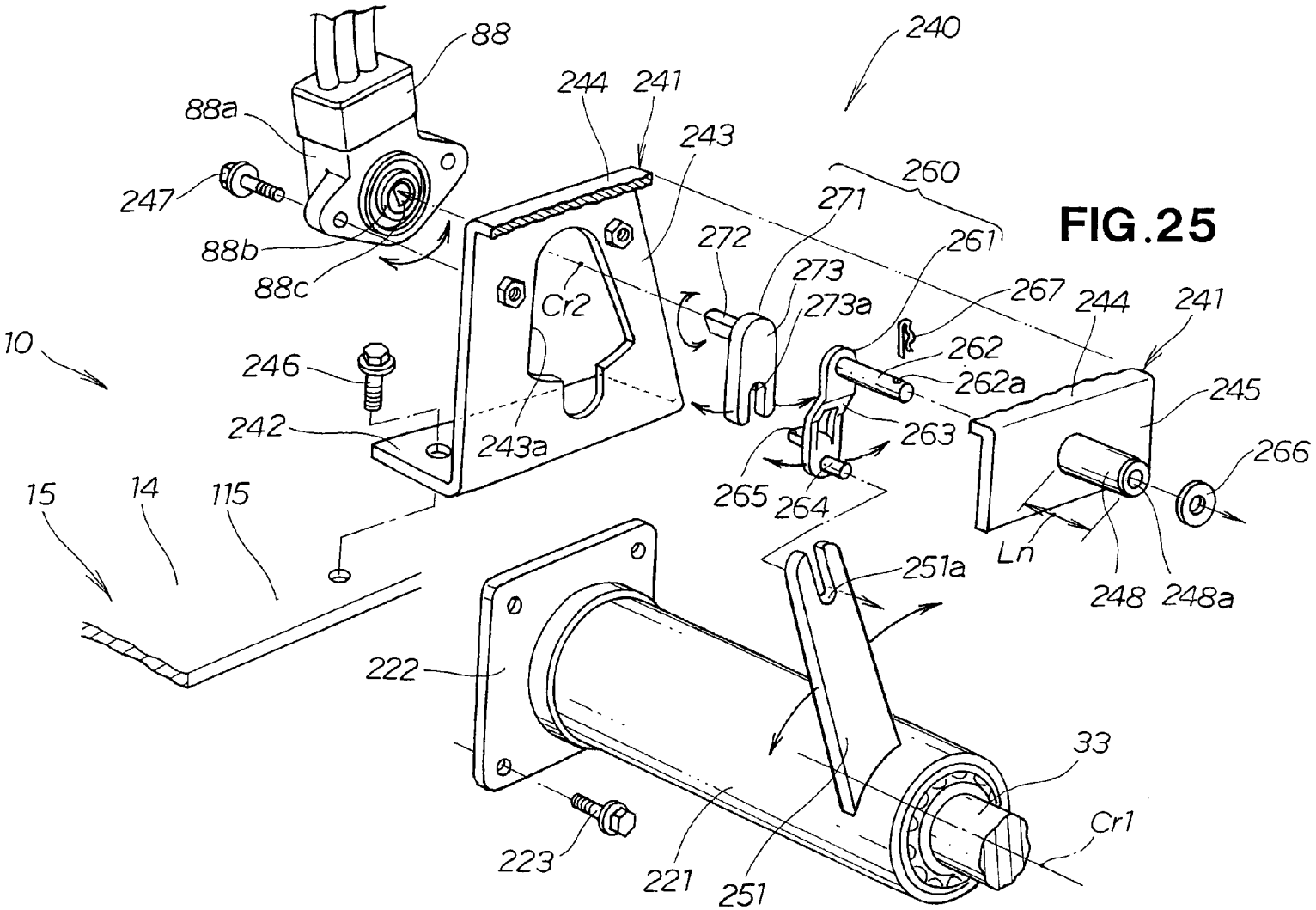
FIG. 25 is an exploded view of the rolling position detector shown in FIG. 24.

As shown in FIGS. 23 through 25, the rolling position detector 240 is composed of the rolling position sensor 88, a bracket 241 for attaching the rolling position sensor 88 to the vehicle frame 15, a swing arm 251 (swinging member 251) attached to the support tube 221, and a transmission unit 260 for transmitting the amount of swing of the swing arm 251 to the rolling position sensor 88. The rolling position detector 240 is covered by the engine cover 122 (see FIG. 24).

The bracket 241 is disposed higher than the support tube 221, and is detachably attached at the front upper portion of the vehicle frame 15, i.e., above the cross plate 115.

More specifically, the bracket 241 is a bent molded panel composed of a horizontal mount 242 attached above the cross plate 115, a front wall portion 243 extending upward from the rear end of the horizontal mount 242, an upper side horizontal portion 244 (ceiling portion 244) extending to the rear from the upper end of the front wall portion 243, and a rear wall portion 245 extending downward from the rear end of the upper side horizontal portion 244. An exploded view of the upper side horizontal portion 244 is shown in FIG. 25 in order to simplify the description.

The horizontal mount 242 is attached to the cross plate 115 by a bolt 246. The front wall portion 243 and the rear wall portion 245 are disposed parallel to each other, are separated from each other by a predetermined interval, and are panels normal to the axis line Cr1.

An open portion 243*a* is formed through the front wall portion 243. The detector body portion 88*a* of the rolling position sensor 88 is attached by a bolt 247 to the front surface in the upper portion of the front wall portion 243. The insertion hole 88*c* of the operating shaft 88*b* faces the open portion 243*a*. The open portion 243*a* is an escape hole for preventing the transmission unit 260 from interfering with the front wall portion 243.

The rear wall portion 245 is provided with a support pipe 248 (sleeve 248). The support pipe 248 is composed of a pipe extending to the rear from the rear wall portion 245, and has a through-hole 248*a* disposed above the axis line Cr2 of the operating shaft 88*b*. This through-hole 248*a* passes through the rear wall portion 245 and faces the insertion hole 88*c* of the rolling position sensor 88.

As shown in FIGS. 23 through 25, the support tube 221 has a swing arm 251 extending further upward than the vehicle frame 15 from the upper end of the rear portion upward at an angle to the left. The swing arm 251 is an elongated flat panel parallel to the front wall portion 243, and a connecting groove (slit) 251*a* is formed in the upper end 85*a* thereof. The rolling position sensor 88 is thus disposed above the swing arm 251.

The swing arm 251 does not extend vertically upward from the support tube 221, but extends upward at an angle to the left. The reason for adopting this configuration is described hereinafter.

The distance between the electromagnetic clutch 31 (see FIG. 2) and the axis line Cr1 is limited by the overall design of the snow remover 10. When the rolling position sensor 88 is lowered to a position that prevents interference with the electromagnetic clutch 31 (see FIG. 2), the distance from the axis line Cr1 to the operating shaft 88*b* of the rolling position sensor 88 must be reduced. The swing arm 251 is disposed at an angle in order to allow smooth operation of the transmission unit 260 disposed in such a confined space. Tilting the swing arm 251 creates essentially the same conditions as when a large distance is set between the two axis lines Cr1 and Cr2. Accordingly, the transmission unit 260 can be more smoothly operated.

The transmission unit 260 is disposed in a space Sp2 enclosed by the front wall portion 243, the upper side horizontal portion 244, and the rear wall portion 245. Since the transmission unit 260 is surrounded by the front wall portion 243, the upper side horizontal portion 244, and the rear wall portion 245, snow on the periphery can be prevented from adhering to the transmission unit 260. The transmission unit 260 is composed of a first lever 261 and a second lever 271.

The first lever 261 (rear operating lever 261) is attached to the bracket 241 so as to be able to move in swinging fashion, and is connected to the swing arm 251. Specifically, the first lever 261 is composed of a support pin 262 rotatably fitted in the through-hole 248*a* of the support pipe 248, a lever main body 263 extending downward from the front end of the support pin 262, a connecting pin 264 extending to the rear from the lower end of the lever main body 263, and a connecting tab 265 extending to the front from the middle of the longitudinal direction of the lever main body 263.

In the support pin 262, a washer 266 is fitted to the rear end that extends to the rear from the through-hole 248*a*, and a lock pin 267 is fastened in a pin insertion hole 262*a*. Therefore, the support pin 262 does not come out of the support pipe 248. The lever main body 263 is composed of an elongated panel. The connecting pin 264 is parallel to the support pin 262 and is fitted in the connecting groove 251*a* of the swing arm 251 so as to be able to swing to the left and right. The connecting tab 265 is formed by cutting out a portion of the lever main body 263 towards the front.

The second lever 271 (front operating lever 271) is connected to the first lever 261 and to the insertion hole 88*c* of the rolling position sensor 88. Specifically, the second lever 271 is composed of an operating pin 272 fitted in the insertion hole 88*c* while allowed restricted rotation, and a lever main body 273 extending downward from the rear end of the operating pin 272. The operating pin 272 passes through the open portion 243*a* of the front wall portion 243. The lever main body 273 is composed of an elongated panel with a connecting groove (slit) 273*a* formed in the lower end thereof. The connecting tab 265 of the first lever 261 is fitted in the connecting groove 273*a* so as to be able to swing to the left and right.

The reason for forming the transmission unit 260 from the two members that include the first lever 261 and the second lever 271 will be described hereinafter.

The rolling position detector 240 is covered by the engine cover 122 and the left and right side frames 111 as shown in FIGS. 22 and 24, and snow usually does not adhere to the connecting groove 251*a* of the swing arm 251.

However, when snow does adhere to the connecting groove 251*a*, it is possible for the adhering snow to freeze to the connecting groove 251*a* and connecting pin 264. In other words, the connecting pin 264 can become locked with respect to the connecting groove 251*a*.

In this state, the swing arm 251 swings in the same direction as the implement 13 when the implement 13 is rolled, as shown in FIGS. 23 and 25. On the other hand, the first lever 261 swings about the support pin 262 at the upper end thereof. The first lever 261 cannot swing in the same direction as the swing arm 251. A force that releases the locked state caused by freezing, i.e., an unlocking force, therefore acts between the connecting groove 251*a* and the connecting pin 264. As a result, the locked state is overcome. By the subsequent swinging of the swing arm 251, the first lever 261 can swing, and the operating shaft 88*b* of the rolling position sensor 88 can be turned via the second lever 271. Accordingly, an excessive unlocking force does not act on the rolling position sensor 88. The rolling position sensor 88 can be adequately protected. This is the reason for adopting the configuration whereby the transmission unit 260 is composed of two members that include the first lever 261 and the second lever 271.

Since the first lever 261 and the support pipe 248 for supporting the first lever 261 receive the unlocking force that acts on the first lever 261, these components are made of steel in order to increase their rigidity. Furthermore, the support pipe 248 is provided with a large length Ln in order to have enhanced support rigidity. An excessive unlocking force does not act on the second lever 271. The second lever 271 may be provided with less rigidity than the first lever 261, and may be made of a resin, for example. Production properties can be improved by forming this component from a resin.

The operation of the rolling drive mechanism 38 and the rolling position detector 240 will next be described. Exploded views are shown in FIGS. 26A through 26D in order to facilitate understanding of this operation.

Figure 26A:
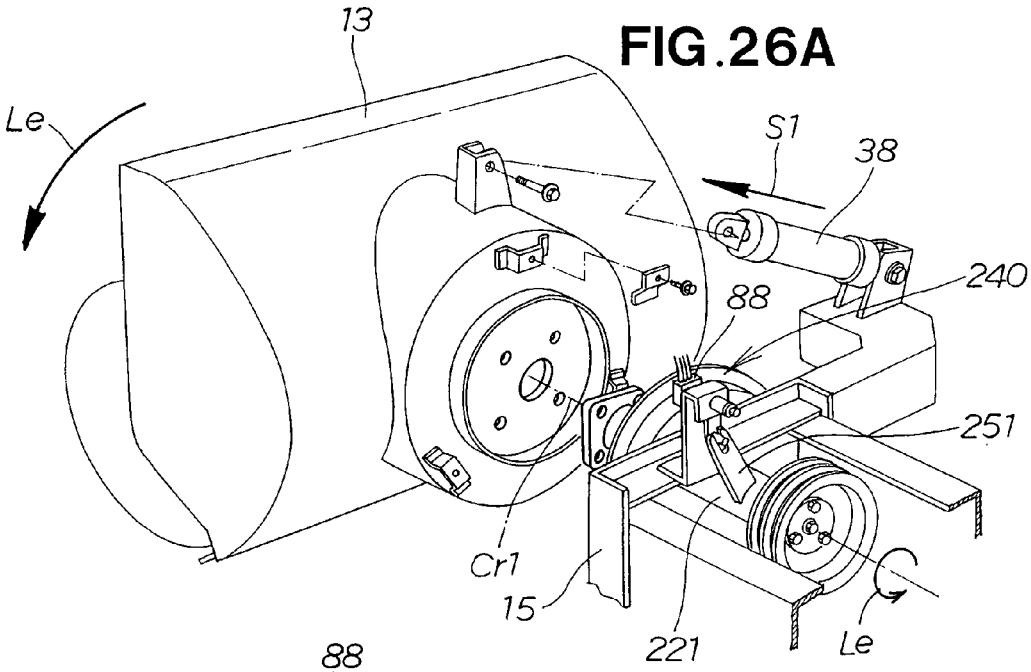
FIGS. 26A through 26D are views showing the functioning of the snow-removing implement, the rolling support device, and the rolling position sensor shown in FIGS. 23 through 25.
Figure 26B:
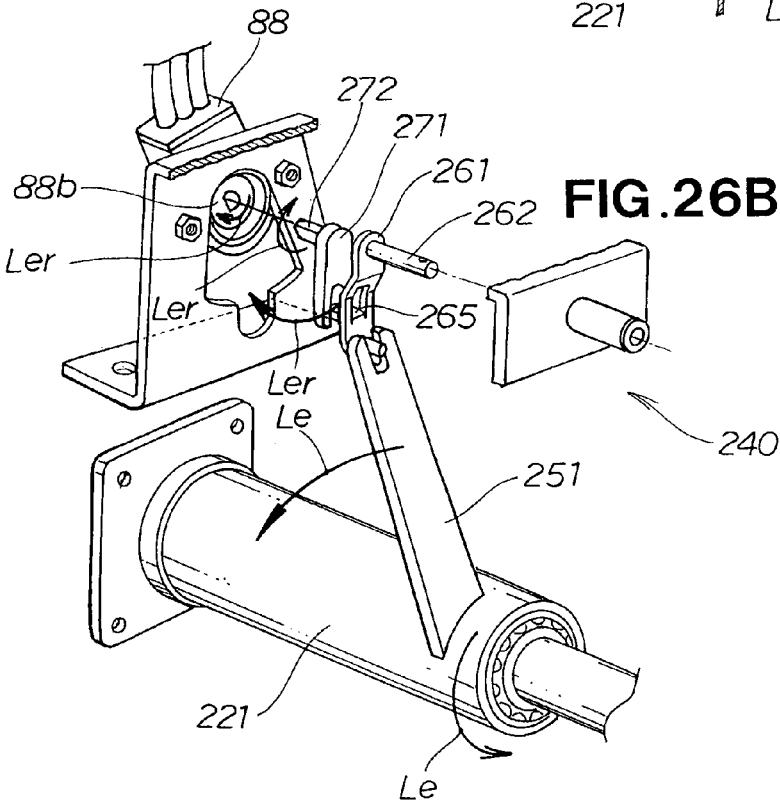

In FIGS. 26A and 26B, the rolling drive mechanism 38 extends as indicated by arrow S1, whereby the implement 13 rolls about the axis line Cr1 to the left as indicated by arrow Le in relation to the vehicle frame 15. The support tube 221 rotates in the direction of arrow Le about the axis line Cr1. The swing arm 251 swings in the direction of arrow Le. The first lever 261 swings about the support pin 262 in the direction of arrow Ler in the opposite direction from the swing arm 251. The second lever 271 swings about the operating pin 272 in the direction of arrow Ler in the same direction as the first lever 261. The operating pin 272 turns in the direction of arrow Ler and turns the operating shaft 88*b* of the rolling position sensor 88. As a result, the amount that the implement 13 rolls to the left, i.e., the rolling position of the implement 13, can be detected by the rolling position sensor 88, which detects the rotation angle of the operating shaft 88*b*.

Figure 26C:
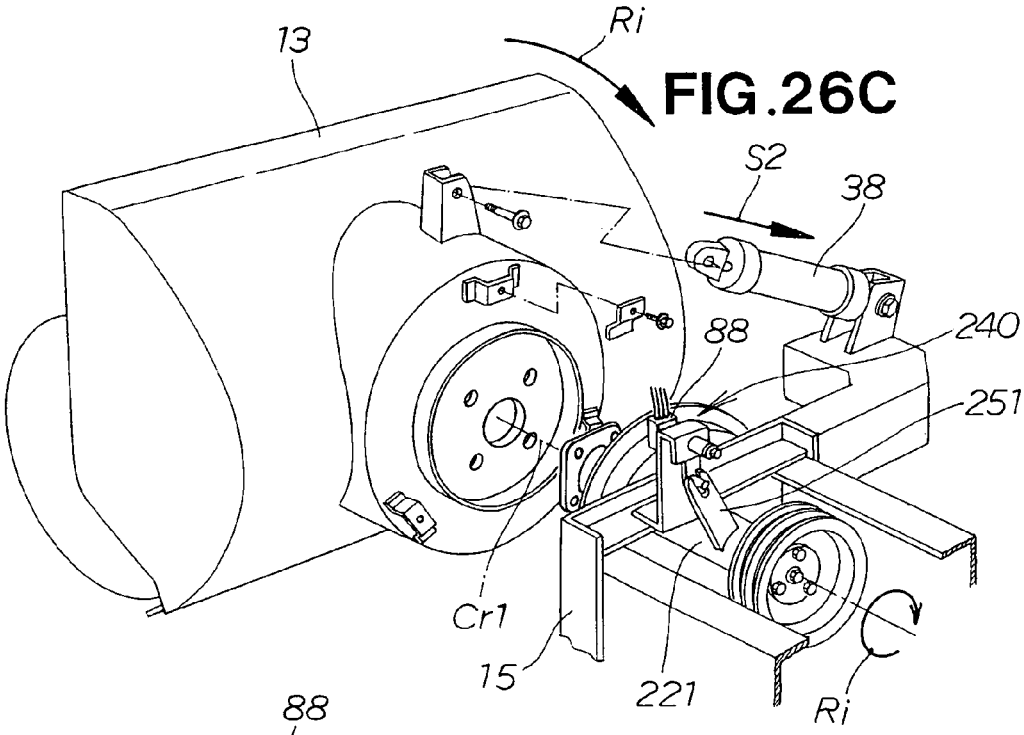
Figure 26D:
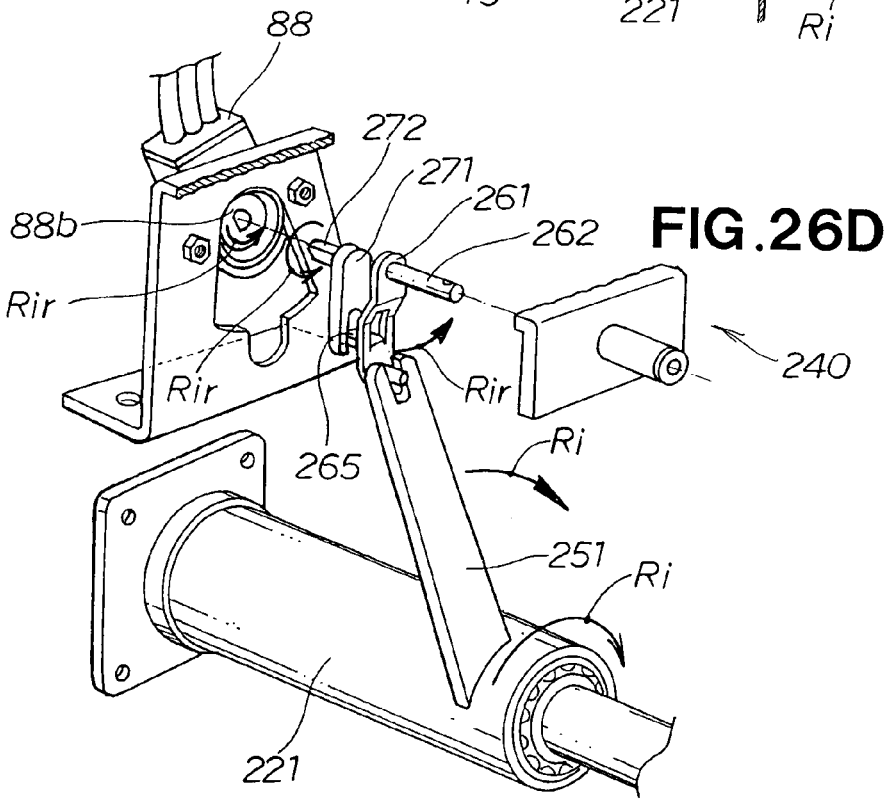

The rolling drive mechanism 38 then contracts as indicated by arrow S2 in FIGS. 26C and 26D, whereby the implement 13 rolls about the axis line Cr1 to the right as indicated by arrow Ri in relation to the vehicle frame 15. The support tube 221 rotates in the direction of arrow Ri about the axis line Cr1. The swing arm 251 swings in the direction of arrow Ri. The first lever 261 swings in the direction of arrow Rir in the opposite direction from the swing arm 251 about the support pin 262. The second lever 271 swings in the direction of arrow Rir in the same direction as the first lever 261 about the operating pin 272. The operating pin 272 turns in the direction of arrow Rir and turns the operating shaft 88*b* of the rolling position sensor 88. As a result, the amount that the implement 13 rolls to the right, i.e., the rolling position of the implement 13, can be detected by the rolling position sensor 88, which detects the rotation angle of the operating shaft 88*b*.

An example of the manner in which the rolling position detector 240 is protected from snow will next be described.

Figure 27A:
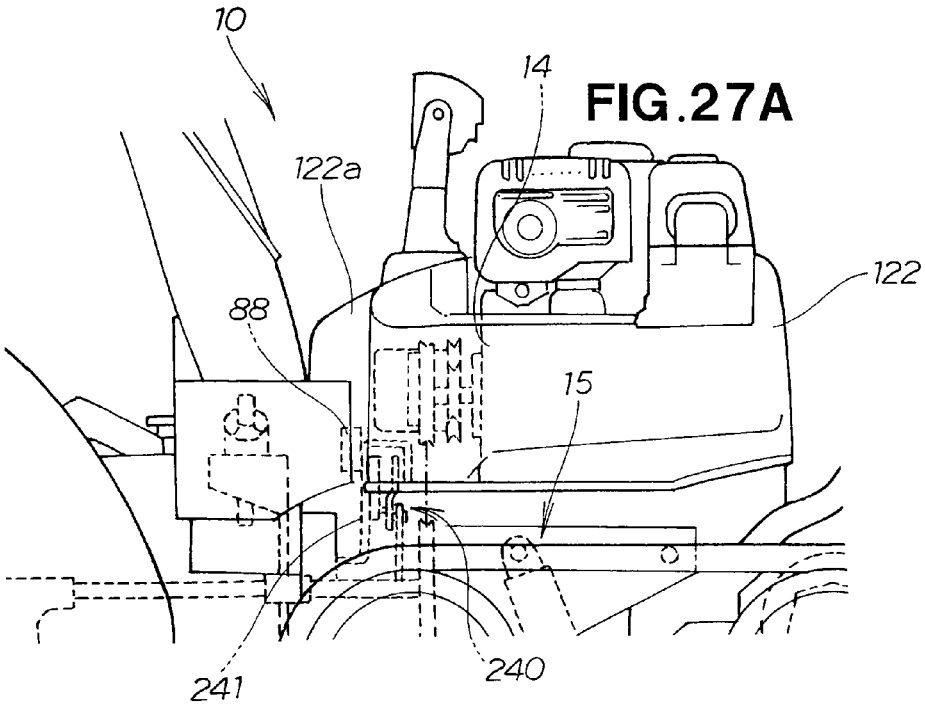
FIGS. 27A and 27B are views showing a function whereby the rolling position sensor shown in FIG. 22 is protected from snow.
Figure 27B:
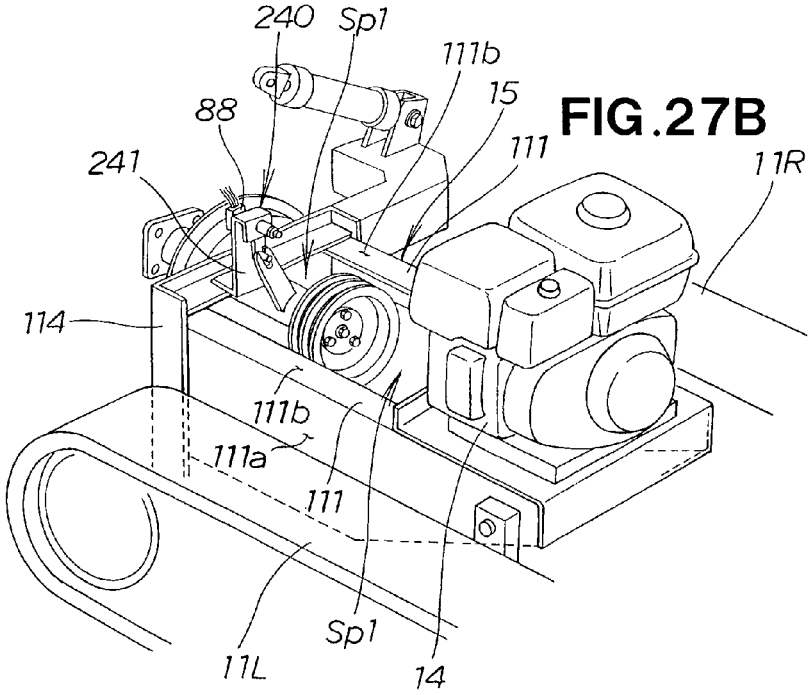
Figure 28:
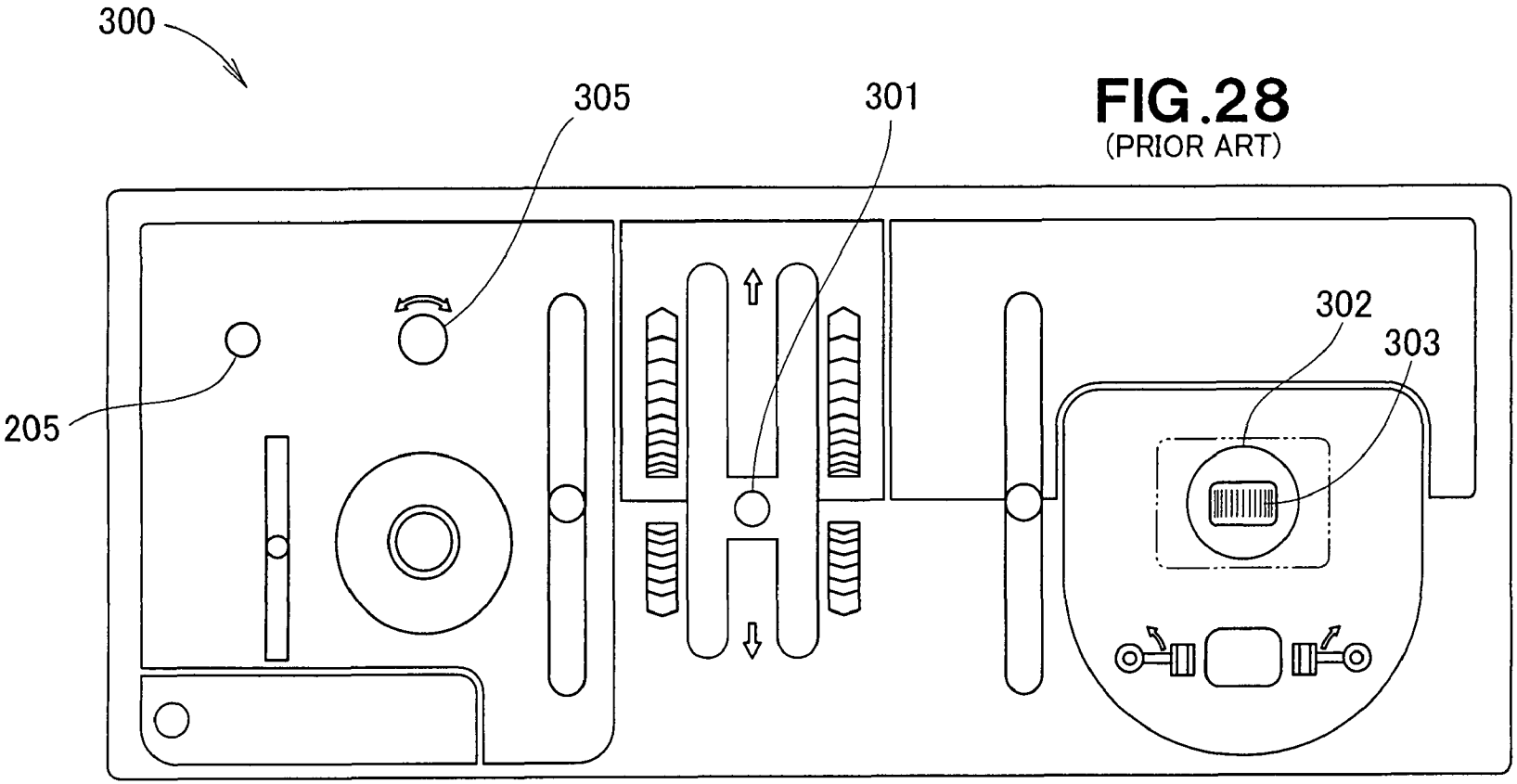
FIG.28 (PRIOR ART)
FIG. 28 is a plan view of the operating unit in the conventional self-propelled snow remover.

As shown in FIGS. 27A and 27B, the rolling position sensor 88 is attached to the vehicle frame 15 via the bracket 241 above the front support member 114. The rolling position sensor 88 is therefore disposed in a higher position than the vehicle frame 15.

The engine cover 122 is provided above the vehicle frame 15, and the front end portion 122*a* thereof extends to the front portion of the vehicle frame 15 and covers the rolling position sensor 88. By covering the rolling position sensor 88 with the engine cover 122, snow can be prevented from adhering to the rolling position sensor 88. It is thus possible to prevent snow from adhering to and freezing on the rolling position sensor 88.

Since the engine cover 122 also functions as a protective cover for the rolling position sensor 88, there is no need to provide a special protective cover for protecting the rolling position sensor 88. Furthermore, by covering the rolling position sensor 88 with the engine cover 122, the rolling position sensor 88 can be disposed in the same space as the engine 14. Therefore, even when snow penetrates under the engine cover 122, the intruding snow can be melted by the heat of the engine 14. Intruding snow can thus be even more effectively prevented from adhering to the rolling position sensor 88. Snow can therefore be even more reliably prevented from adhering to and freezing on the rolling position sensor 88.

Furthermore, the vehicle frame 15 is disposed between the left and right travel units 11L, 11R when viewed from above, as shown in FIG. 27B. The rolling position sensor 88 is disposed in a higher position than the vehicle frame 15, in the center of width direction of the vehicle frame 15. The rolling position sensor 88 is therefore disposed between the left and right travel units 11L, 11R as viewed from above. As shown in FIG. 24, the rolling position sensor 88 is disposed directly above the internal space Sp1 in the vehicle frame 15.

The plate-shaped side walls 111*a*, 111*a* of the left and right side frames 111 extend further upward than the upper ends of the left and right crawler belts 22L, 22R. By adopting this configuration, the space between the internal space Sp1 inside the vehicle frame 15 and the left and right travel units 11L, 11R can be partitioned by the side walls 111*a*, 111*a*.

The swing arm 251 is disposed between the left and right side frames 111 of the travel frame 12 (in other words, in the internal space Sp1). The upper surfaces 111*b*, 111*b* of the left and right side frames 111 are higher than the left and right travel units 11L, 11R.

When snow is being removed by the snow remover 10, it is possible for snow swept up by the left and right travel units 11L, 11R to drift to the vicinity of the upper portions of the travel units 11L, 11R. The rolling position sensor 88 is therefore provided in a higher position than the vehicle frame 15. The rolling position sensor 88 is thus disposed in a higher position than the left and right travel units 11L, 11R. The rolling position sensor 88 can be disposed higher than the drifting snow. Drifting snow can be even more reliably prevented from adhering to the rolling position sensor 88.

Since the rolling position sensor 88, the swing arm 251, and the transmission unit 260 in the rolling position detector 240 are covered by the travel frame 12 and the engine cover 122 (see FIG. 24), snow is even more reliably prevented from adhering to or freezing on these components.

The implement 13 in the present invention is not limited to being a snow removal unit provided with an auger 27, and may be provided with a snow removal plate (snow removal blade), for example.

The indicator lamp 57 is also not limited to being provided to the reset switch 54, and may also be provided separately.

In the control routine of the second embodiment, the tilt reference position Lo is not limited to a value of "0," and may be set to any position. Arbitrarily setting the tilt reference position Lo makes it possible to adapt the snow remover 10 to the terrain of the area where snow is cleared.

In the abovementioned control routines, the system in which the drive of the left and right electric motors 21L, 21R is controlled by the control unit 61 may be a pulse-width modulation system (PWM system) for feeding a pulse voltage to a motor terminal, for example. The motor drivers 84L, 84R may issue a pulse signal having a controlled pulse width in accordance with the control signal of the control unit 61 to control the rotation of the electric motors 21L, 21R.

The height position sensor 87 or the rolling position sensor 88 may also be a non-contact-type sensor that uses a photodiode or the like.

The self-propelled snow remover 10 of the present invention is suitable as an auger-type snow remover whereby snow is gathered and removed by an auger at the front while the machine travels forward.

Obviously, various minor changes and modifications of the present invention are possible in light of the above teaching. It is therefore to be understood that within the scope of the appended claims the invention may be practiced otherwise than as specifically described.

What is claimed is:

1. A self-propelled snow remover comprising:

a machine body;

a snow-removing implement mounted to a front part of the machine body for undergoing rolling and vertical movement relative to the machine body;

an operating unit mounted to a rear part of the machine body for operation by an operator of the self-propelled snow remover;

an alignment operating member mounted to the operating unit for rolling and vertically moving the snow-removing implement, the alignment operating member being disposed on one of opposite sides of a widthwise central line of the machine body; and a return operating member mounted to the operating unit for automatically returning the snow-removing implement to a predetermined reference position, the return operating member being disposed proximate to the alignment operating member at a position closer to the widthwise central line of the machine body than the alignment operating member and further towards the rear part of the machine body than the alignment operating member to enable operation and control of both the return operating member and the alignment operating member by a single hand of the operator of the self-propelled snow remover.

2. The snow remover of claim 1, further comprising:

a lift drive mechanism for vertically moving the snow-removing implement;

a rolling drive mechanism for rolling the snow-removing implement; and a control unit for controlling the lift drive mechanism and the rolling drive mechanism;

wherein the reference position consists of two values comprising a height reference position as a reference for a height position of the snow-removing implement, and a rolling reference position as a reference for a rolling position of the snow-removing implement; and wherein the control unit performs control by controlling the lift drive mechanism and the rolling drive mechanism by executing a reference position return mode for issuing two instructions whereby an adjustment drive instruction is issued to the lift drive mechanism so as to match the height position of the snow-removing implement to the height reference position, and an adjustment drive instruction is issued to the rolling drive mechanism so as to match the rolling position of the snow-removing implement to the rolling reference position according to an operating signal of the return operating member.

3. The snow remover of claim 2, further comprising:

a height position detector for detecting a height position of the snow-removing implement; and a rolling position detector for detecting a rolling position of the snow-removing implement;

wherein the control unit controls the lift drive mechanism and the rolling drive mechanism by issuing an adjustment drive instruction to the lift drive mechanism so as to match the height position detected by the height position detector to the height reference position, and issuing an adjustment drive instruction to the rolling drive mechanism so as to match the rolling position detected by the rolling position detector to the rolling reference position.

4. The snow remover of claim 2, further comprising a display unit for indicating a return of the snow-removing implement to the reference position.

5. The snow remover of claim 2, wherein the control unit further controls the lift drive mechanism and the rolling drive mechanism by executing a reference position changing mode for arbitrarily changing a value of the height reference position and a value of the rolling reference position.

6. The snow remover of claim 5, wherein in response to a switching operation of the return operating member, the control unit performs control by switching to and executing one mode selected from the reference position return mode and the reference position changing mode.

7. The snow remover of claim 2, further comprising:

travel units for performing self-propulsion of the snow remover; and a travel operating member operable to switch the travel units between forward travel and reverse travel;

wherein the control unit further performs control by:

(a) storing the height position of the snow-removing implement at a time at which it is determined that two conditions are satisfied, including a condition wherein the snow-removing implement is in operation and a condition wherein the travel units are switched to reverse travel by the travel operating member;

(b) issuing a lift drive instruction to the lift drive mechanism so as to lift the snow-removing implement; and (c) thereafter issuing a lowering drive instruction so as to return the height position of the snow-removing implement to the stored original height position when a condition is satisfied wherein the travel units are switched to forward travel by the travel operating member.

8. The snow remover of claim 7, wherein the control unit further performs control by storing the rolling position of the snow-removing implement at the time at which it is determined that the two conditions are satisfied, and issuing an adjustment drive instruction to the rolling drive mechanism so as to match the tilt of the snow-removing implement to the stored original rolling position when the condition that the travel operating member is switched to forward travel is satisfied.

9. The snow remover of claim 7, wherein the control unit further performs control by issuing a control signal to the rolling drive mechanism so as to place the snow-removing implement in a horizontal state relative to a ground surface when it is determined that the two conditions are satisfied.

10. The snow remover of claim 7, wherein the snow-removing implement further comprises an auger; and wherein the control unit performs control so as to stop operation of the auger when it is determined that the two conditions are satisfied.

11. The snow remover of claim 3, further comprising a drive source for driving the snow-removing implement, a top cover for covering at top of each of the drive source and the rolling and height position detectors, and a bottom cover for covering a bottom of the drive source and disposed under the height position detector for preventing snow particles carried up by the travel units from adhering onto the height position detector.

12. The snow remover of claim 1, wherein the return operating member is positioned relative to the alignment operating member to enable operation of the return operating member with the thumb of the operator's hand when the alignment operating member is grasped by the same operator's hand.

13. The snow remover of claim 1, further comprising a rolling support device that supports the snow-removing implement to the front part of the machine body to enable rolling movement of the snow-removing implement, the rolling support device comprising a rolling support member mounted on the machine body and a rolled support member mounted on the snow-removing implement and rotatably supported by the rolling support member.

* * * * *